US012570438B2

(12) United States Patent
Braun et al.

(10) Patent No.: US 12,570,438 B2
(45) Date of Patent: Mar. 10, 2026

(54) MOBILE STORAGE FOR MODULAR SYSTEMS

(71) Applicant: Milwaukee Electric Tool Corporation, Brookfield, WI (US)

(72) Inventors: Christian R. Braun, Milwaukee, WI (US); Benjamin T. Jones, St. Francis, WI (US); Aaron M. Williams, Milwaukee, WI (US); Aura Mariani de J. Escobar Padilla, Milwaukee, WI (US); Grant T. Squiers, Cudahy, WI (US); Caleb C. Adams, Milwaukee, WI (US); Charlie G. Noble, New Berlin, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 214 days.

(21) Appl. No.: 18/354,404

(22) Filed: Jul. 18, 2023

(65) Prior Publication Data

US 2024/0010390 A1 Jan. 11, 2024

Related U.S. Application Data

(63) Continuation of application No. PCT/US2023/027235, filed on Jul. 10, 2023.

(Continued)

(51) Int. Cl.
*B65D 21/08* (2006.01)
*B65D 25/28* (2006.01)

(52) U.S. Cl.
CPC ..... *B65D 21/086* (2013.01); *B65D 21/083* (2013.01); *B65D 25/2841* (2013.01)

(58) Field of Classification Search
CPC ..... B65D 21/086; B65D 21/083; B65D 25/2841; A47B 57/10; A47B 47/025;

(Continued)

(56) References Cited

U.S. PATENT DOCUMENTS 3,424,334 A 1/1969 Goltz
4,249,295 A 2/1981 Lance (Continued)

FOREIGN PATENT DOCUMENTS

CN 103737566 4/2014
CN 203752130 8/2014

(Continued)

OTHER PUBLICATIONS

International Search Report and Written Opinion for International Application No. PCT/US2023/027235, dated Oct. 24, 2023, 11 pages.

(Continued)

*Primary Examiner* — Kareen K Thomas
(74) *Attorney, Agent, or Firm* — Reinhart Boerner Van Deuren s.c.

(57) ABSTRACT

One or more support platforms for a modular system are provided. The support platforms are configured to detachably support and optionally couple with utility modules in a system, such as modular tool storage units. The support platforms include one or more components, such as shelves and/or top panels, that include couplers configured to coupled to modular tool storage units.

19 Claims, 44 Drawing Sheets

Related U.S. Application Data

(60) Provisional application No. 63/485,650, filed on Feb. 17, 2023, provisional application No. 63/407,884, filed on Sep. 19, 2022, provisional application No. 63/400,219, filed on Aug. 23, 2022, provisional application No. 63/388,071, filed on Jul. 11, 2022.

(58) Field of Classification Search
CPC ..... A47B 47/0041; A47B 47/0025; B25H 3/023; B60N 3/002
See application file for complete search history.

(56) References Cited

U.S. PATENT DOCUMENTS

| | | | | |
|---|---|---|---|---|
| 4,659,154 | A * | 4/1987 | Jenkins | A01K 97/26 312/277 |
| 4,971,234 | A | 11/1990 | Hay | |
| 5,069,342 | A * | 12/1991 | Dickinson | B25H 3/028 312/902 |
| 5,082,037 | A | 1/1992 | Hammons et al. | |
| 5,244,265 | A * | 9/1993 | Chiang | B25H 3/023 312/902 |
| 5,331,904 | A | 7/1994 | Disimone | |
| 5,890,613 | A | 4/1999 | Williams | |
| 6,276,736 | B1 | 8/2001 | Cook et al. | |
| 6,550,836 | B2 | 4/2003 | Rigau | |
| 6,983,946 | B2 | 1/2006 | Sullivan et al. | |
| 7,641,253 | B2 | 1/2010 | Steiger et al. | |
| 7,784,489 | B2 | 8/2010 | Paulin et al. | |
| 7,784,885 | B2 | 8/2010 | Steiger et al. | |
| 7,823,948 | B2 | 11/2010 | Redman et al. | |
| 8,388,073 | B2 | 3/2013 | Richter | |
| 8,740,010 | B1 | 6/2014 | Page | |
| 8,763,820 | B2 | 7/2014 | Hanley | |
| 8,944,483 | B2 | 2/2015 | Richter | |
| 8,974,160 | B2 | 3/2015 | Bender | |
| 9,010,830 | B2 | 4/2015 | Hanley | |
| 9,173,486 | B2 | 11/2015 | Richter | |
| 9,233,647 | B1 | 1/2016 | Hanley et al. | |
| 9,346,391 | B2 | 5/2016 | Workman et al. | |
| 9,375,835 | B1 | 6/2016 | Lin | |
| 9,381,872 | B2 | 7/2016 | Hanley | |
| 9,669,773 | B2 | 6/2017 | Hanley | |
| 9,764,692 | B2 | 9/2017 | Beere | |
| 9,796,339 | B2 | 10/2017 | Hanley et al. | |
| 9,834,149 | B2 | 12/2017 | Hanley | |
| 9,878,649 | B2 | 1/2018 | Beere | |
| 10,017,086 | B2 | 7/2018 | Paunov | |
| 10,046,719 | B2 | 8/2018 | Workman et al. | |
| 10,106,094 | B2 | 10/2018 | Hanley | |
| 10,172,452 | B2 | 1/2019 | Hanley et al. | |
| 10,334,944 | B2 | 7/2019 | Hanley | |
| 10,414,342 | B2 | 9/2019 | Williams et al. | |
| 10,443,271 | B1 | 10/2019 | Rose et al. | |
| 10,449,906 | B2 | 10/2019 | Richter | |
| 10,485,345 | B2 | 11/2019 | Bishop | |
| 10,583,962 | B2 | 3/2020 | Brunner et al. | |
| 10,610,012 | B2 | 4/2020 | Hanley et al. | |
| 10,676,043 | B2 | 6/2020 | Klatt et al. | |
| 10,703,292 | B2 | 7/2020 | Hanley | |
| 10,750,833 | B2 | 8/2020 | Burchia | |
| 10,779,641 | B2 | 9/2020 | Beere | |
| 10,882,456 | B2 | 1/2021 | Williams et al. | |
| 10,913,398 | B2 | 2/2021 | Hanley | |
| 10,994,407 | B2 | 5/2021 | Wehking et al. | |
| 11,000,123 | B2 | 5/2021 | Hanley et al. | |
| 11,000,943 | B2 | 5/2021 | Reynolds | |
| 11,046,371 | B2 | 6/2021 | Rosenfeld et al. | |
| 11,186,235 | B2 | 11/2021 | Klatt et al. | |
| 2003/0139080 | A1 | 7/2003 | Lafragette et al. | |
| 2005/0225108 | A1 | 10/2005 | Panasewicz et al. | |
| 2007/0138041 | A1 | 6/2007 | Welsh | |
| 2010/0313972 | A1 | 12/2010 | Paulin et al. | |
| 2011/0018411 | A1 | 1/2011 | Steiger et al. | |
| 2011/0260588 | A1 | 10/2011 | Lin | |
| 2013/0127129 | A1 | 5/2013 | Bensman et al. | |
| 2014/0265440 | A1 | 9/2014 | Chen et al. | |
| 2016/0128471 | A1 | 5/2016 | Chang | |
| 2017/0166352 | A1 | 6/2017 | Hoppe et al. | |
| 2017/0341923 | A1 | 11/2017 | DeWitt | |
| 2017/0341924 | A1 | 11/2017 | DeWitt | |
| 2019/0225371 | A1 | 7/2019 | Hoppe et al. | |
| 2020/0147781 | A1 | 5/2020 | Squiers et al. | |
| 2020/0165036 | A1 | 5/2020 | Squiers et al. | |
| 2021/0009041 | A1 | 1/2021 | Herriman et al. | |
| 2021/0076820 | A1 | 3/2021 | Wolle et al. | |
| 2021/0101535 | A1 | 4/2021 | Williams et al. | |
| 2021/0114498 | A1 | 4/2021 | Beere et al. | |
| 2021/0146849 | A1 | 5/2021 | Hanley | |
| 2021/0153645 | A1 | 5/2021 | Beere et al. | |
| 2021/0219716 | A1 | 7/2021 | Hanley et al. | |
| 2021/0231153 | A1 | 7/2021 | Lorusso | |
| 2021/0237254 | A1 | 8/2021 | Reynolds | |
| 2023/0122425 | A1 | 4/2023 | Camp et al. | |

FOREIGN PATENT DOCUMENTS

| | | | |
|---|---|---|---|
| CN | 105415333 | | 3/2016 |
| CN | 107776466 | | 3/2018 |
| CN | 109015570 | | 12/2018 |
| DE | 4406817 | | 6/1995 |
| DE | 19515639 | | 10/1996 |
| DE | 20001968 | | 5/2000 |
| DE | 20001969 | | 5/2000 |
| DE | 10155588 | | 4/2003 |
| DE | 202004020506 | | 9/2005 |
| DE | 102004005362 | | 1/2006 |
| DE | 102012204883 | | 10/2013 |
| DE | 102012204886 | | 10/2013 |
| DE | 202014103695 | | 12/2014 |
| DE | 102014104117 | | 9/2015 |
| DE | 102014105723 | | 10/2015 |
| DE | 202018100183 | | 3/2018 |
| DE | 102018007161 | | 3/2019 |
| DE | 202017107337 | | 4/2019 |
| DE | 202018102791 | | 9/2019 |
| DE | 202018102792 | | 10/2019 |
| DE | 202018106072 | | 3/2020 |
| DE | 102016115404 | | 11/2020 |
| DE | 102016115410 | | 11/2020 |
| DE | 202019106307 | | 3/2021 |
| DE | 202021103785 | | 8/2021 |
| DE | 202019005719 | | 9/2021 |
| EP | 0611633 | | 8/1994 |
| EP | 0611863 | | 10/1997 |
| EP | 1308345 | | 5/2003 |
| EP | 0911121 | | 9/2003 |
| EP | 1724069 | A2 | 11/2006 |
| EP | 1950091 | | 7/2008 |
| EP | 1523907 | | 4/2015 |
| EP | 2772155 | | 8/2015 |
| EP | 2537641 | B1 | 9/2016 |
| EP | 2338650 | B1 | 10/2016 |
| EP | 3569101 | | 11/2019 |
| EP | 3491970 | | 6/2020 |
| EP | 3569108 | | 1/2021 |
| GB | 2211486 | | 7/1989 |
| JP | 10-234498 | | 9/1998 |
| JP | 2005-152578 | | 6/2005 |
| KR | 20-0212656 | | 6/2002 |
| KR | 10-1300759 | | 8/2013 |
| WO | WO9212026 | | 7/1992 |
| WO | WO08156384 | | 12/2008 |
| WO | WO09046480 | | 4/2009 |
| WO | WO11000432 | | 1/2011 |
| WO | WO2014/125484 | | 8/2014 |
| WO | WO19020689 | | 1/2019 |

OTHER PUBLICATIONS

Inter Partes Review No. 2024-01400, "Petition for Inter Partes Review of U.S. Pat. No. 11,365,026" Filed Sep. 17, 2024, 147 pages.

(56) References Cited

OTHER PUBLICATIONS

Exhibit 1001 in "Petition for Inter Partes Review of U.S. Pat. No. 11,365,026" Filed Sep. 17, 2024, 66 pages.
Exhibit 1002 in "Petition for Inter Partes Review of U.S. Pat. No. 11,365,026" Filed Sep. 17, 2024, 324 pages.
Exhibit 1003 in "Petition for Inter Partes Review of U.S. Pat. No. 11,365,026" Filed Sep. 17, 2024, 139 pages.
Exhibit 1004 in "Petition for Inter Partes Review of U.S. Pat. No. 11,365,026" Filed Sep. 17, 2024, 17 pages.
Exhibit 1005 in "Petition for Inter Partes Review of U.S. Pat. No. 11,365,026" Filed Sep. 17, 2024, 9 pages.
Exhibit 1006 in "Petition for Inter Partes Review of U.S. Pat. No. 11,365,026" Filed Sep. 17, 2024, 21 pages.
Exhibit 1007 in "Petition for Inter Partes Review of U.S. Pat. No. 11,365,026" Filed Sep. 17, 2024, 16 pages.
Exhibit 1008 in "Petition for Inter Partes Review of U.S. Pat. No. 11,365,026" Filed Sep. 17, 2024, 31 pages.
Exhibit 1009 in "Petition for Inter Partes Review of U.S. Pat. No. 11,365,026" Filed Sep. 17, 2024, 6 pages.
Exhibit 1010 in "Petition for Inter Partes Review of U.S. Pat. No. 11,365,026" Filed Sep. 17, 2024, 4 pages.
Exhibit 1011 in "Petition for Inter Partes Review of U.S. Pat. No. 11,365,026" Filed Sep. 17, 2024, 16 pages.
Exhibit 1012 in "Petition for Inter Partes Review of U.S. Pat. No. 11,365,026" Filed Sep. 17, 2024, 8 pages.
Exhibit 1013 in "Petition for Inter Partes Review of U.S. Pat. No. 11,365,026" Filed Sep. 17, 2024, 19 pages.
Exhibit 1014 in "Petition for Inter Partes Review of U.S. Pat. No. 11,365,026" Filed Sep. 17, 2024, 35 pages.
Exhibit 1015 in "Petition for Inter Partes Review of U.S. Pat. No. 11,365,026" Filed Sep. 17, 2024, 11 pages.
Exhibit 1016 in "Petition for Inter Partes Review of U.S. Pat. No. 11,365,026" Filed Sep. 17, 2024, 193 pages.
Exhibit 1017 in "Petition for Inter Partes Review of U.S. Pat. No. 11,365,026" Filed Sep. 17, 2024, 29 pages.
Exhibit 1018 in "Petition for Inter Partes Review of U.S. Pat. No. 11,365,026" Filed Sep. 17, 2024, 15 pages.
Exhibit 1019 in "Petition for Inter Partes Review of U.S. Pat. No. 11,365,026" Filed Sep. 17, 2024, 19 pages.
Exhibit 1020 in "Petition for Inter Partes Review of U.S. Pat. No. 11,365,026" Filed Sep. 17, 2024, 18 pages.
Exhibit 1021 in "Petition for Inter Partes Review of U.S. Pat. No. 11,365,026" Filed Sep. 17, 2024, 313 pages.
Exhibit 1030 in "Petition for Inter Partes Review of U.S. Pat. No. 11,365,026" Filed Sep. 17, 2024, 95 pages.
Exhibit 1031 in "Petition for Inter Partes Review of U.S. Pat. No. 11,365,026" Filed Sep. 17, 2024, 5 pages.
Exhibit 1032 in "Petition for Inter Partes Review of U.S. Pat. No. 11,365,026" Filed Sep. 17, 2024, 19 pages.
Inter Partes Review No. 2024-01401, "Petition for Inter Partes Review of U.S. Pat. No. 11,794,952" Filed Sep. 17, 2024, 165 pages.
Exhibit 1001 in "Petition for Inter Partes Review of U.S. Pat. No. 11,794,952" Filed Sep. 17, 2024, 67 pages.
Exhibit 1002 Part 1 in "Petition for Inter Partes Review of U.S. Pat. No. 11,794,952" Filed Sep. 17, 2024, 227 pages.
Exhibit 1002 Part 2 in "Petition for Inter Partes Review of U.S. Pat. No. 11,794,952" Filed Sep. 17, 2024, 278 pages.
Exhibit 1003 in "Petition for Inter Partes Review of U.S. Pat. No. 11,794,952" Filed Sep. 17, 2024, 168 pages.
Exhibit 1004 in "Petition for Inter Partes Review of U.S. Pat. No. 11,794,952" Filed Sep. 17, 2024, 17 pages.
Exhibit 1005 in "Petition for Inter Partes Review of U.S. Pat. No. 11,794,952" Filed Sep. 17, 2024, 9 pages.
Exhibit 1006 in "Petition for Inter Partes Review of U.S. Pat. No. 11,794,952" Filed Sep. 17, 2024, 21 pages.
Exhibit 1007 in "Petition for Inter Partes Review of U.S. Pat. No. 11,794,952" Filed Sep. 17, 2024, 16 pages.
Exhibit 1008 in "Petition for Inter Partes Review of U.S. Pat. No. 11,794,952" Filed Sep. 17, 2024, 31 pages.
Exhibit 1009 in "Petition for Inter Partes Review of U.S. Pat. No. 11,794,952" Filed Sep. 17, 2024, 6 pages.
Exhibit 1010 in "Petition for Inter Partes Review of U.S. Pat. No. 11,794,952" Filed Sep. 17, 2024, 4 pages.
Exhibit 1011 in "Petition for Inter Partes Review of U.S. Pat. No. 11,794,952" Filed Sep. 17, 2024, 16 pages.
Exhibit 1012 in "Petition for Inter Partes Review of U.S. Pat. No. 11,794,952" Filed Sep. 17, 2024, 8 pages.
Exhibit 1013 in "Petition for Inter Partes Review of U.S. Pat. No. 11,794,952" Filed Sep. 17, 2024, 19 pages.
Exhibit 1014 in "Petition for Inter Partes Review of U.S. Pat. No. 11,794,952" Filed Sep. 17, 2024, 35 pages.
Exhibit 1015 in "Petition for Inter Partes Review of U.S. Pat. No. 11,794,952" Filed Sep. 17, 2024, 11 pages.
Exhibit 1016 in "Petition for Inter Partes Review of U.S. Pat. No. 11,794,952" Filed Sep. 17, 2024, 193 pages.
Exhibit 1017 in "Petition for Inter Partes Review of U.S. Pat. No. 11,794,952" Filed Sep. 17, 2024, 29 pages.
Exhibit 1018 in "Petition for Inter Partes Review of U.S. Pat. No. 11,794,952" Filed Sep. 17, 2024, 15 pages.
Exhibit 1019 in "Petition for Inter Partes Review of U.S. Pat. No. 11,794,952" Filed Sep. 17, 2024, 19 pages.
Exhibit 1020 in "Petition for Inter Partes Review of U.S. Pat. No. 11,794,952" Filed Sep. 17, 2024, 18 pages.
Exhibit 1021 in "Petition for Inter Partes Review of U.S. Pat. No. 11,794,952" Filed Sep. 17, 2024, 313 pages.
Exhibit 1022 in "Petition for Inter Partes Review of U.S. Pat. No. 11,794,952" Filed Sep. 17, 2024, 324 pages.
Exhibit 1023 in "Petition for Inter Partes Review of U.S. Pat. No. 11,794,952" Filed Sep. 17, 2024, 5 pages.
Exhibit 1024 in "Petition for Inter Partes Review of U.S. Pat. No. 11,794,952" Filed Sep. 17, 2024, 7 pages.
Exhibit 1025 in "Petition for Inter Partes Review of U.S. Pat. No. 11,794,952" Filed Sep. 17, 2024, 15 pages.
Exhibit 1026 in "Petition for Inter Partes Review of U.S. Pat. No. 11,794,952" Filed Sep. 17, 2024, 37 pages.
Exhibit 1027 in "Petition for Inter Partes Review of U.S. Pat. No. 11,794,952" Filed Sep. 17, 2024, 7 pages.
Exhibit 1028 in "Petition for Inter Partes Review of U.S. Pat. No. 11,794,952" Filed Sep. 17, 2024, 33 pages.
Exhibit 1030 in "Petition for Inter Partes Review of U.S. Pat. No. 11,794,952" Filed Sep. 17, 2024, 95 pages.
Exhibit 1031 in "Petition for Inter Partes Review of U.S. Pat. No. 11,794,952" Filed Sep. 17, 2024, 5 pages.
Exhibit 1032 in "Petition for Inter Partes Review of U.S. Pat. No. 11,794,952" Filed Sep. 17, 2024, 60 pages.

* cited by examiner

MOBILE STORAGE FOR MODULAR SYSTEMS

CROSS-REFERENCE TO RELATED PATENT APPLICATIONS

The present application is a continuation of International Application No. PCT/US2023/027235, filed Jul. 10, 2023, which claims the benefit of and priority to U.S. Provisional Application No. 63/485,650, filed on Feb. 17, 2023, U.S. Provisional Application No. 63/407,884, filed on Sep. 19, 2022, U.S. Provisional Application No. 63/400,219, filed on Aug. 23, 2022, and U.S. Provisional Application No. 63/388,071, filed on Jul. 11, 2022, each of which is incorporated herein by reference in its entirety.

BACKGROUND OF THE INVENTION

The present disclosure is directed generally to the field of containers and related devices. The present disclosure relates specifically to support platforms configured to support and detachably couple to utility modules (e.g., units) within a modular system.

Tool storage units are often used to transport tools and tool accessories. Some storage units are designed to incorporate into a modular storage system. Various platforms can be configured to support units within a modular system, such as a platform for storing and/or moving units within a modular system.

SUMMARY OF THE INVENTION

One embodiment of the invention relates to a support structure for coupling to and supporting a utility module for transit, the support structure detachably coupling to one or more male couplers of the utility module. The support structure includes a base, a first wall coupled to and extending upward from the base, a second wall coupled to and extending upward from the base opposite the first wall, a storage area collectively defined by the first wall, the second wall, and the base, a first shelf slidably engaged with the first wall and the second wall, a handle coupled to the first shelf, and a first female coupler defined by the first shelf. The first wall is configured to detachably couple to a support bar, and the support bar couples the first wall to a wall of a vehicle. The first shelf slidably actuates along an axis between a stowed position and an extended position with respect to the first wall and the second wall. The first shelf defines a length along the axis such that, when the first shelf is in the stowed position, greater than 50% of the length of the first shelf is within the storage area, and, when the first shelf is in the extended position, greater than 50% of the length of the first shelf is extended out of the storage area. The handle actuates between a locked position and an unlocked position such that the first shelf is slidable relative to the first wall and the second wall when the handle is in the unlocked position, and the first shelf is biased to remain retracted within the storage area when the handle is in the locked position. The first female coupler is defined by the first shelf. The first female coupler includes a back wall, a first sidewall, a second sidewall opposite the first sidewall, a first rib extending from the first sidewall towards the second sidewall, and a second rib extending from the second sidewall towards the first sidewall. The first female coupler is configured to slidably engage with a first male coupler of a first utility module.

Another embodiment of the invention relates to a support structure including a lateral wall, a first wall coupled to the lateral wall, a second wall coupled to the lateral wall opposite the first wall, a storage area collectively defined by the first wall, the second wall, and the lateral wall, a brace coupled to and extending between the first wall and the second wall, a first shelf slidably engaged with the brace, and a first female coupler defined by the first shelf. The first shelf slidably actuates between a stowed position and an extended position with respect to the brace such that the first shelf is within the storage area and positioned above the brace when the first shelf is in the stowed position and the first shelf extends out of the storage area when the first shelf is in the extended position. The first female coupler includes a back wall, a first sidewall, a second sidewall opposite the first sidewall, a first rib extending from the first sidewall towards the second sidewall, and a second rib extending from the second sidewall towards the first sidewall. The first female coupler is configured to slidably engage with a first male coupler of a first utility module.

Another embodiment of the invention relates to a stack of a plurality of components of a support structure for coupling to and supporting a utility module for transit. The stack includes a base, a first wall, a second wall, and a top panel. The top panel defines a first female coupler including a back wall, a front wall opposite the back wall, a first sidewall, a second sidewall opposite the first sidewall, a first rib, and a second rib. The first rib extends from the first sidewall towards the second sidewall and from the back wall towards the front wall, and the second rib extends from the second sidewall towards the first sidewall and from the back wall towards the front wall. The first female coupler is configured to slidably engage with a first male coupler of a first utility module. The base, the first wall, the second wall, and the top panel are stacked on top of one another in an unassembled configuration such that a major side surface of one of the base, the first wall, the second wall, and the top panel faces a major side surface of an adjacent one of the base, the first wall, the second wall, and the top panel in the stack. The base, the first wall, the second wall, and the top panel are configured to be coupled together to form an assembled configuration such that when the base, the first wall, the second wall, and the top panel are in the assembled configuration, the first wall is coupled to and extending upward from the base, the second wall is coupled to and extending upward from the base opposite the first wall, and the top panel is coupled to and extends between the first wall and the second wall above the base.

Another embodiment of the invention relates to a support platform including a base, a first wall, a second wall, a first shelf, and a first plate coupled to the first shelf. A storage area is collectively defined by the base, the first wall, and the second wall. The first wall is coupled to and extends upward from the base, and the first wall includes a first inner surface that includes a first plurality of channels. The second wall is coupled to and extends upward from the base, and the second wall includes a second inner surface that includes a second plurality of channels. The first inner surface and the second inner surface face towards each other. The first shelf is slidably engaged with the first wall via sliding within a first channel of the first plurality of channels and the first shelf is slidably engaged with the second wall via sliding within a second channel of the second plurality of channels. The first shelf actuates into and out of the storage area via a front of the storage area. The first plate is coupled to the first shelf such that the first plate and the first shelf define a first plurality of female couplers. Each of the first plurality of female couplers includes a recessed surface defined by the shelf, a first rib, and a second rib, the first rib and the second rib each extending over the recessed surface. Each of the first plurality of female couplers are configured for arresting engagement with male couplers of a first utility module.

In various embodiments, each of the first plurality of female couplers includes a back wall, a first sidewall, a second sidewall opposite the first sidewall, and a front wall opposite the back wall. The front wall is between the back wall and the front of the storage area. The first rib extends from the back wall towards the front wall and the first rib extends from the first sidewall towards the second sidewall. The second rib extends from the backwall towards the front wall and the second rib extends from the second sidewall towards the first sidewall.

In various embodiments, the support platform includes a rear wall coupled to and extending upward from the base, the rear wall extending between the first wall and the second wall, and a lid coupled to a top of the first wall, the second wall, and the rear wall.

In various embodiments, the support platform includes a second plate coupled to the lid, the second plate and the lid defining a second plurality of female couplers.

In various embodiments, the first plurality of channels includes a first subset of channels and a second subset of channels. Each of the first subset of channels extends horizontally across the first wall, and each of the second subset of channels extends horizontally and vertically across the first wall such that a front of the respective channel is higher than a rear of the respective channel.

Another embodiment of the invention relates to a storage platform for units within a modular system. The storage platform includes a housing and one or more shelving walls, each of which include an upper surface and an opposing lower surface. In various embodiments, at least one of the upper surfaces is coupled to a first panel including a plurality of couplers, such as female couplers, configured to couple to a lower surface of a unit within the modular system. In various embodiments, at least one of the lower surfaces is coupled to a second panel including a plurality of couplers, such as male couplers, configured to couple to an upper surface of a unit within the modular system.

One embodiment of the invention relates to a storage platform. The storage platform includes a housing, such as sidewalls or vertical bars, extending vertically and an upper plate coupled to the housing. The housing includes a plurality of female couplers defined by the upper plate. Each of the female couplers includes a first rib and a second rib, each of the first and second ribs extends from a rear wall of the respective female coupler to a front wall of the respective female coupler in a first direction, each of the first ribs extends from a sidewall of the respective female coupler towards the second rib of the respective female coupler and each of the second ribs extends from a sidewall of the respective female coupler towards the first rib of the respective female coupler. Each of the female couplers are configured for arresting engagement with male couplers of a first utility module.

In various embodiments, the storage platform further includes a plurality of support plates slidably coupled to the support bars. One or more of the support plates includes a plurality of female couplers.

Another embodiment of the invention relates to a support system including a bottom wall, a first wall coupled to and extending upward from the bottom wall, a second wall coupled to and extending upward from the bottom wall opposite the first wall, a storage area collectively defined by the bottom wall, the first wall, and the second wall, a brace engaged with and extending between the first wall and the second wall, a first shelf slidably engaged with the brace, a first coupler defined by the first shelf, and a second coupler defined by the first shelf. The first coupler includes a back wall, a first sidewall, a second sidewall opposite the first sidewall, and an aperture in between. The first coupler includes a first rib extending from the first sidewall towards the second sidewall, and a second rib extending from the second sidewall towards the first sidewall. The first coupler is configured to slidably engage with a first male coupler of a first utility module. The second coupler includes a third rib extending from the second sidewall towards the first sidewall, and the second coupler is configured to slidably engage with a second male coupler of the first utility module.

In various embodiments, the second sidewall linearly extends between the first rib and the third rib.

In various embodiments, the support structure includes a second shelf rigidly coupled to and extending between the first wall and the second wall, a third coupler defined by the second shelf, and a fourth coupler defined by the second shelf. The third coupler includes a second back wall, a third sidewall, a fourth sidewall opposite the third sidewall, a fourth rib extending from the third sidewall towards the fourth sidewall, and a fifth rib extending from the fourth sidewall towards the third sidewall, the third coupler configured to slidably engage with a first male coupler of a second utility module. The fourth coupler includes a sixth rib extending from the third sidewall towards the fourth sidewall, and a seventh rib extending from the fourth sidewall towards the third sidewall, the fourth coupler configured to slidably engage with a second male coupler of the second utility module.

In various embodiments, the third sidewall linearly extends between the fourth rib and the sixth rib, and the fourth sidewall linearly extends between the fourth rib and the sixth rib.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments. In addition, alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
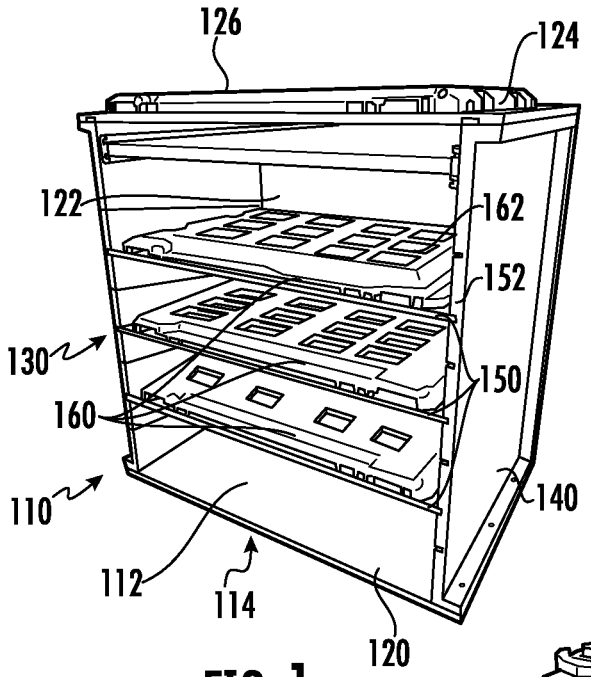
FIGS. 1-7 show various views of a support platform, according to an exemplary embodiment.
Figure 2:
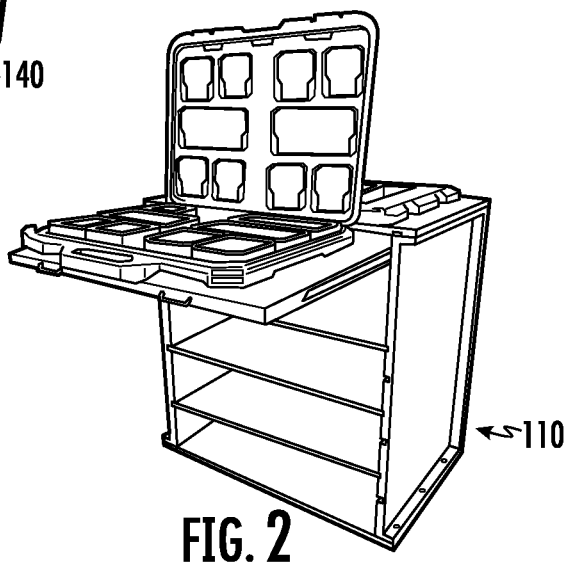

Referring generally to the figures, support platforms that support utility modules within a modular system designed for use within a vehicle are shown. When moving a stack of utility modules within a modular system, the utility modules may rattle when stored within a moving vehicle (e.g., back of a van), and it may be difficult to quickly access specific modules within the modular system. The support platforms described herein facilitate moving, storing, and accessing utility modules with a vehicle.

Specifically, in various embodiments, the support platforms and structures discussed herein include a slidable shelf that includes coupling features that engaging corresponding coupling features of a utility module, and also includes a handle-actuated locking mechanism that locks the shelf in the stowed position to limit inadvertent sliding of the shelf while the vehicle is in motion. Applicant has found that the handle-actuated locking mechanisms discussed herein both securely stow the shelf when the vehicle is in motion while still providing quick and easy access for the user when the vehicle is on location and the shelf needs to be unlocked and extended so the user can access the utility module coupled to the shelf.

In other specific embodiments, Applicant has developed a support platform with a brace structure coupled between walls of the support platform such that the shelf slides relative to the brace. Applicant has found that the brace structure discussed herein provides structural stability to the support platform, and particularly to the walls of the support platform, and also provides a stable structure to which the shelf can be slidably coupled.

In other specific embodiments, Applicant has developed support platform components that are stackable in a flat compact unassembled stack that facilitates packaging and shipping, while also being configured to be assembled to provide the vehicle storage functionality discussed herein. Specifically, the wall, base, shelf components, and optionally top panel actuate between a stacked configuration in which each of the major side surfaces are facing along a uniform axis, and an assembled configuration of a support platform that couples to modular components, such as a utility module in a modular system. Applicant has found that providing a reduced volume for the stacked components facilitates transporting the components before assembly while still enabling construction of a support platform configured to be assembled within a vehicle and that includes modular coupling components for integration with and coupling to utility modules in the modular system.

The term 'utility module' is used hereinafter in its broad meaning and is meant to denote a variety of articles such as, storage containers, travel luggage, tool boxes, organizers, compacted work benches, cable storage, tools (e.g. hand tools, power generators and power sources), communication modules, carrying platforms, locomotion platforms, beverage containers, etc., of any shape and size, and wherein any utility module can be detachably attached to the modular system.

Referring to FIGS. 1-7, various aspects of a mechanism, shown as support platform 110, for supporting and storing utility modules are shown. Support platform 110 includes base 120, rear wall 122, lid 124, first wall 130, and second wall 140. First wall 130 and second wall 140 are each coupled to and extend from base 120, such as extending vertically upwards. Storage area 112 of support platform 110 is defined by one or more of base 120, rear wall 122, lid 124, first wall 130, and second wall 140 (e.g., each of base 120, rear wall 122, lid 124, first wall 130, and second wall 140).

First wall 130 includes first inner surface 138, the first inner surface 138 including a first plurality of channels 132. In various embodiments, first plurality of channels 132 includes first subset 134 of channels 132 and second subset 136 of channels 132. Each of the channels 132 in the first subset 134 of channels 132 extends horizontally across the first wall 130 (e.g., level to the ground), and each of the second subset 136 of channels 132 extends horizontally and vertically across the first wall 130 such that a front of the respective channel 132 is higher than a rear of the respective channel 132. In various embodiments second wall 140 is a mirror-image of first wall 130, such that second wall 140 includes an inner surface that faces the inner surface 138 of first wall 130, and second wall 140 includes corresponding channels and subsets of channels as first wall 130.

One or more of shelves 150 (e.g., first shelf 152) are slidably and detachably engaged with first wall 130 and second wall 140. In particular, the one or more shelves 150 are slidably and detachably engaged with the first wall 130 via sliding within a first channel 132 of the first plurality of channels 132 and the shelf (e.g., first shelf 152) slidably and detachably engaged with the second wall 140 via sliding within a second channel of the second plurality of channels in the second wall 140. The one or more shelves 150 actuate into and out of the storage area 112 via a front 114 of the storage area 112. In various embodiments, support platform 510 includes a snap feature that automatically engages to secure the shelves 150 within the walls when the shelves 150 are inserted.

One or more plates 160 are coupled to the one or more shelves 150. For example, first plate 162 is coupled to first shelf 152. First plate 162 and first shelf 152 collectively define a plurality of female couplers 170. The female couples are configured to arresting engagement with male couplers of a utility module, such as to rigidly couple the utility module to the first plate 162 and/or first shelf 152.

In various embodiments, the couplers described herein and shown in the figures are compatible with the coupling mechanism(s) described in International Patent International Patent Publication No. WO 2017/191628, which is hereby incorporated by reference in its entirety. In various embodiments, the female couplers and male couplers described herein engage with each other to rigidly couple the utility modules that the female couplers and male couplers extend from.

Figure 3:
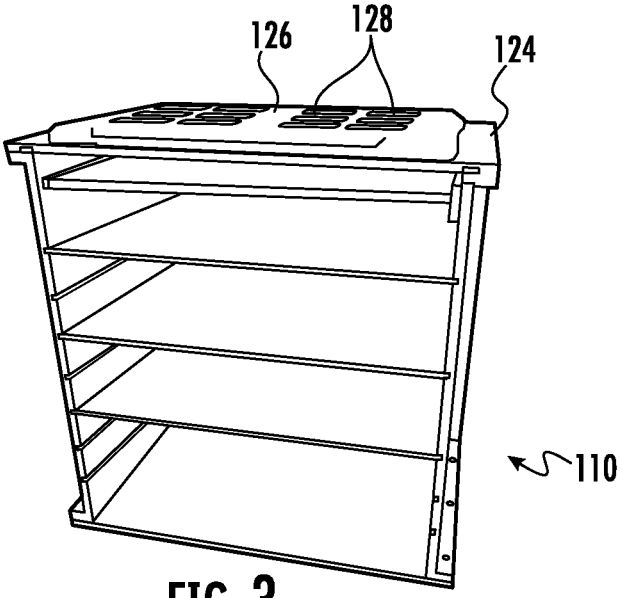
Figure 4:
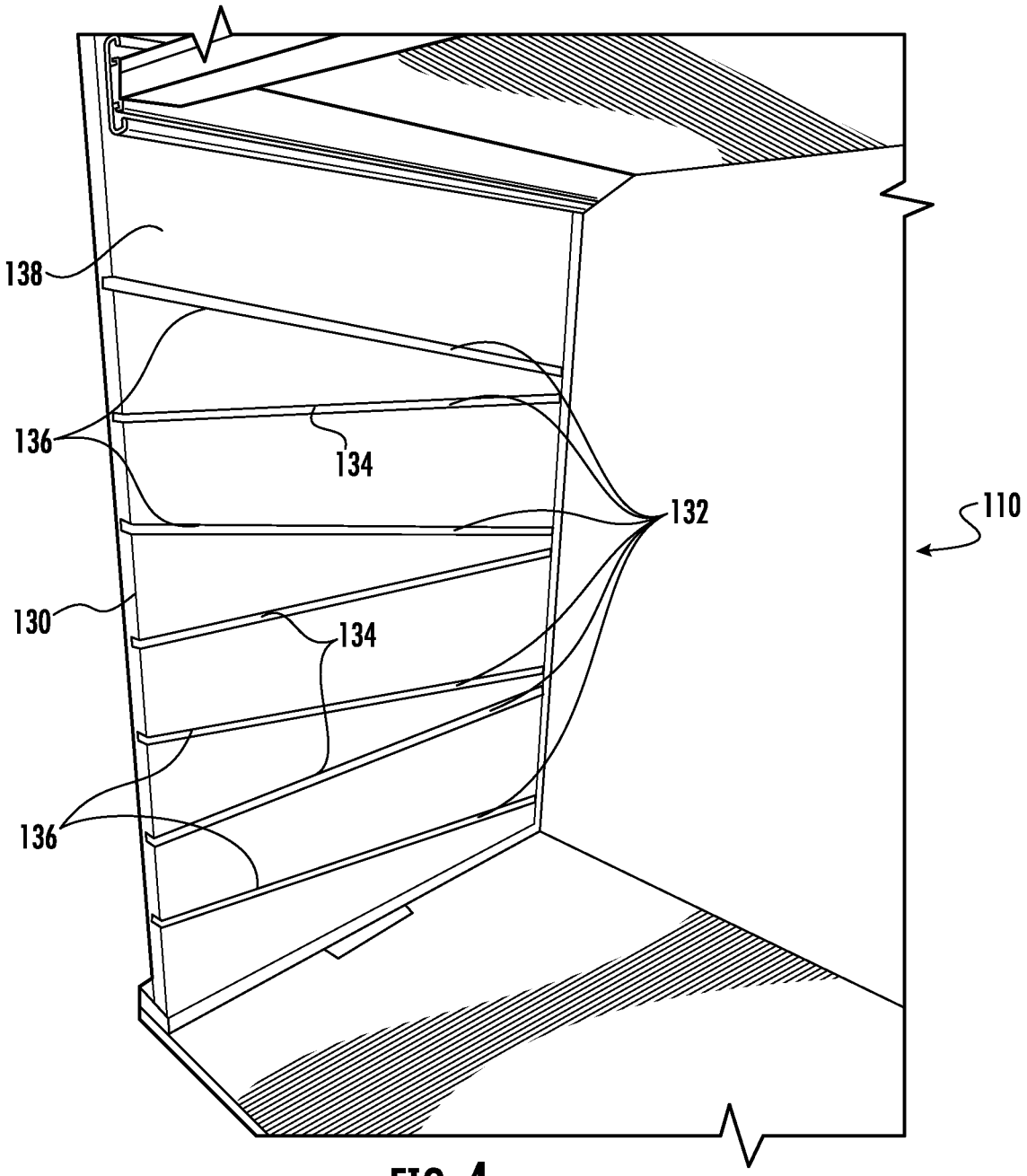

Referring to FIG. 3, in an alternate configuration shelves 150 are coupled to first wall 130 and second wall 140 such that the female couplers 170 face downward, not upward. In various embodiments, each shelf 150 is coupled to a plate 160 on only one side of the shelf 150. Thus, when the shelf 150 is being inserted the user can decide whether the shelf 150 should include the plate 160 facing upward or the plate 160 facing downward.

Figure 5:
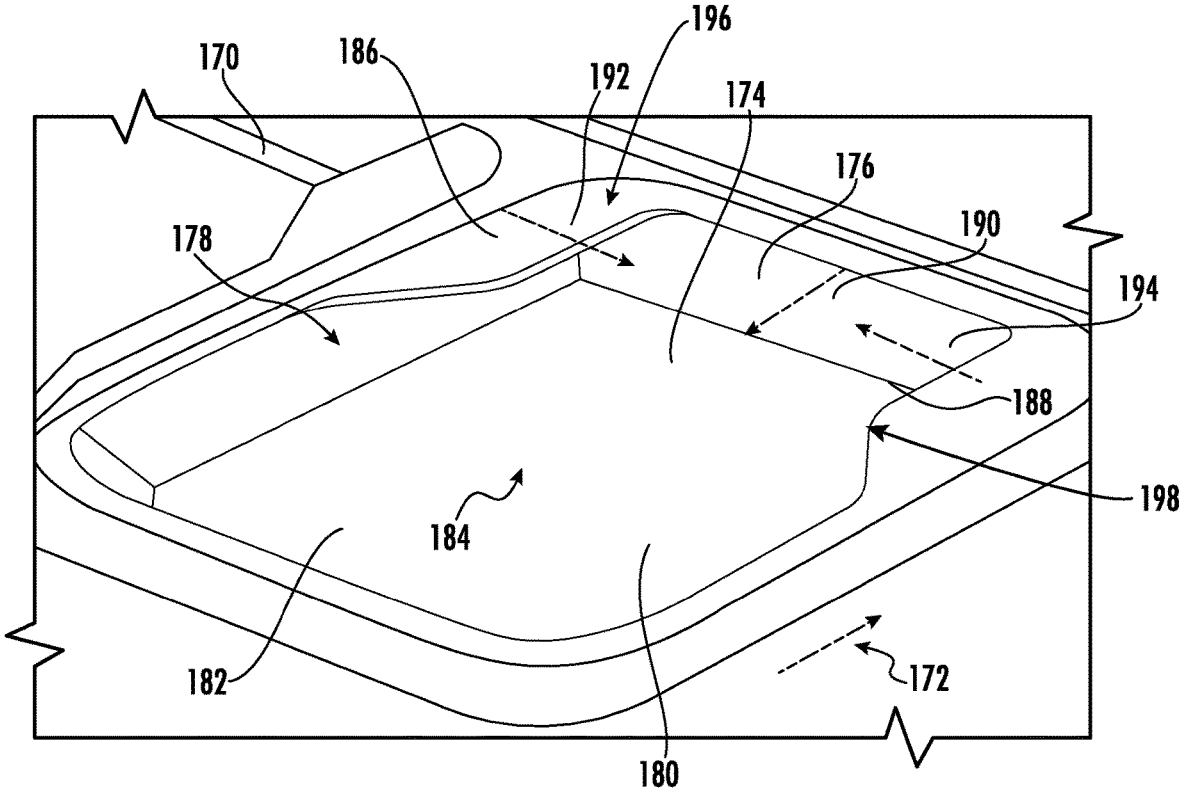

Referring to FIG. 5, female coupler 170 includes a recessed surface 174 (e.g., upper surface of first shelf 152) below top surface 142. Back wall 176, opposing front wall 182, first sidewall 178, and opposing second sidewall 180 extend upward from recessed surface 174. Female coupler 170 includes a pocket 184 collectively defined by recessed surface 174, back wall 176, front wall 182, first sidewall 178, and second sidewall 180.

First rib 186 extends from back wall 176 and first sidewall 178 above pocket 184 and/or recessed surface 174. In particular, first rib 186 extends in direction 192 from first sidewall 178 and first rib 186 extends in direction 190 from back wall 176. First rib 186 includes upper surface 196 that faces upward and away from recessed surface 174. Second rib 188 extends from back wall 176 and second sidewall 180 above pocket 184 and/or recessed surface 174. In particular, second rib 188 extends in direction 194 from second sidewall 180 and second rib 188 extends in direction 190 from back wall 176. Second rib 188 includes upper surface 198 that faces upward and away from recessed surface 174.

In various embodiments, second plate 126 is coupled to an upper surface of lid 124. Second plate 126 and lid 124 collectively define a plurality of female couplers 128. In various embodiments, female couplers 128 are functionally and/or structurally the same as female couplers 170.

To couple a male coupler (e.g., male coupler 200) to female coupler 170, the male coupler moves in coupling direction 172 until portions of the male coupler (e.g., tongues) are between ribs 186, 188 and recessed surface 174.

Figure 6:
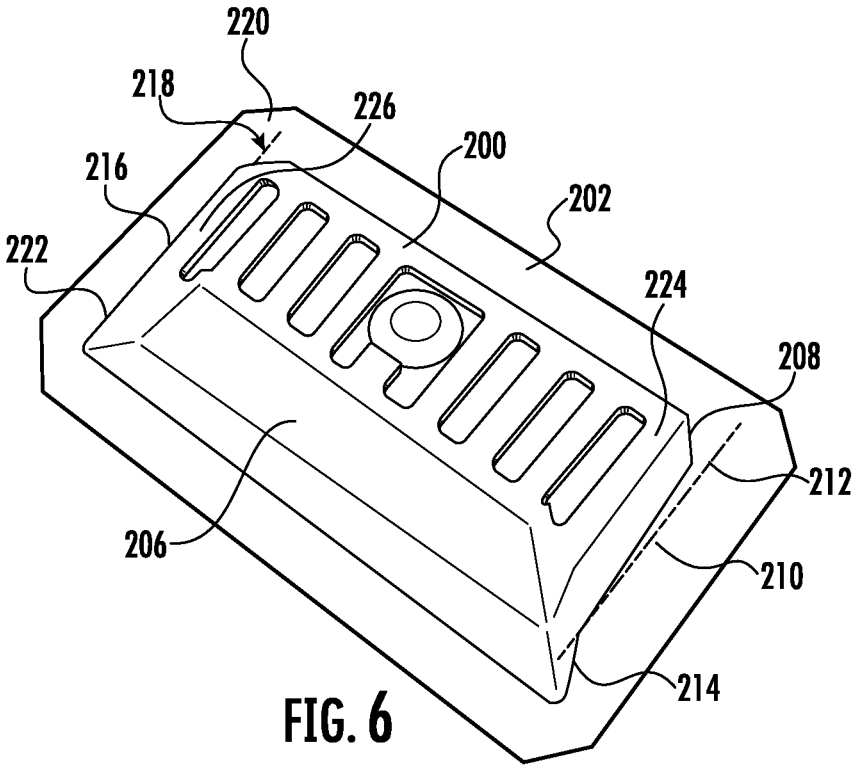
Figure 7:
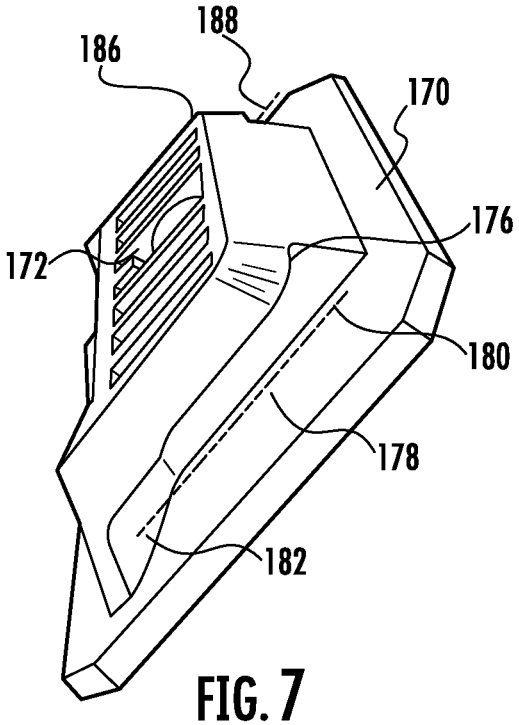
Figure 8:
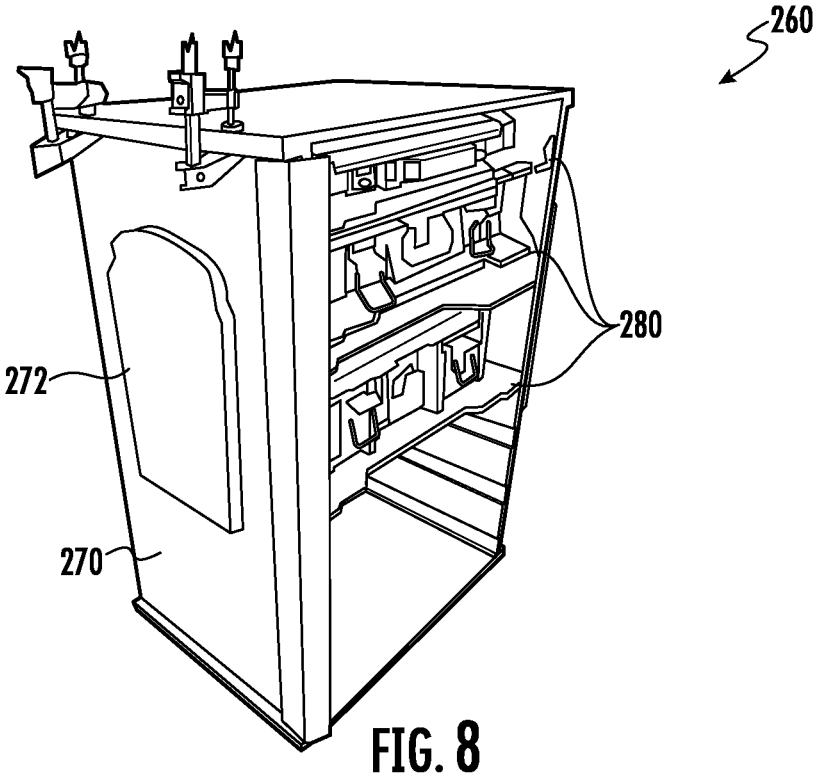
FIGS. 8-11 show various views of a support platform, according to another exemplary embodiment.
Figure 9:
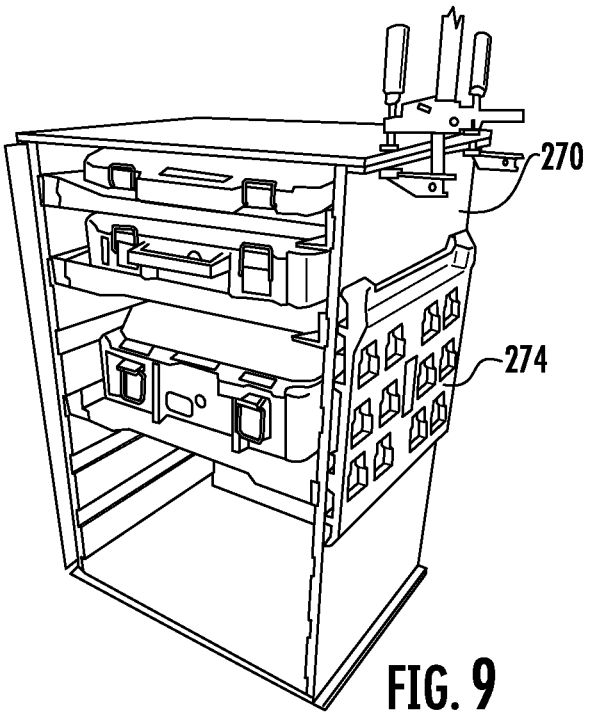
Figure 10:
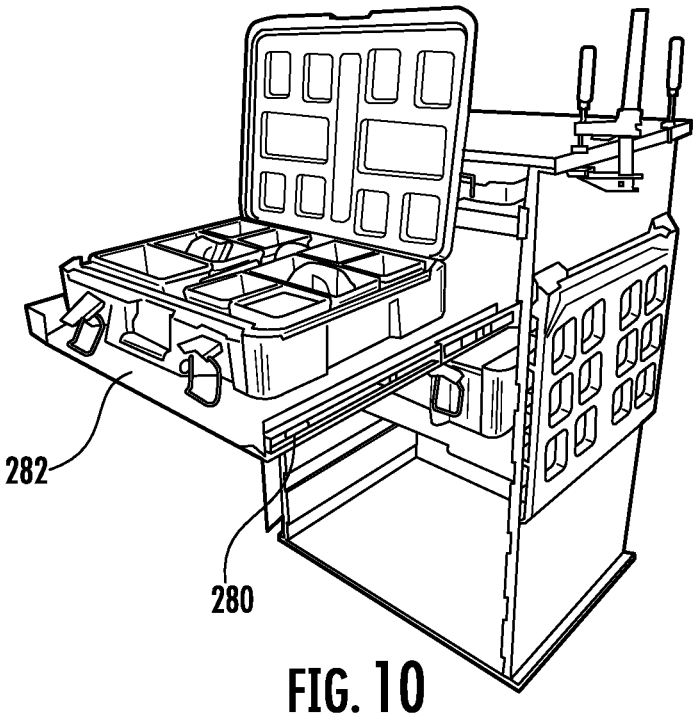

In various embodiments, one or more male couplers 200 are coupled to and/or extend from a bottom of base 120, and male couplers 200 are arranged in a grid similar to female couplers 170 shown in FIG. 1. Referring to FIGS. 6-7, in various embodiments male couplers 200 include a body 206 extending from the bottom surface 202 of base 120, a first tongue 208, and a second tongue 216. The first tongue 208 and the second tongue 216 both extend from the body 206 and both are offset from and above the bottom surface of base 120. The first tongue 208 defines a first channel 210 between the bottom surface of base 120 and the first tongue 208, and the second tongue 216 defines a second channel 218 between the bottom surface of base 120 and the second tongue 216. The first channel 210 and second channel 218 each extend on opposing sides (e.g., first side 224 and opposing second side 226) of the body 206.

Each of first channel 210 and second channel 218 includes a front open end and a back closed end. For example, first channel 210 includes a front open end 212 and a back closed end 214, and second channel 218 includes a front open end 220 and a back closed end 222.

Referring to FIGS. 8-11, support platform 260 is shown according to an exemplary embodiment. Support platform 260 is substantially the same as support platform 110 except for the differences discussed herein.

In various embodiments, support platform 260 includes one or more plates, shown as plates 272, 274, coupled to sidewall 270 thereby permitting utility modules to be coupled to a side of the support platform 260. The plates 272, 274 and the respective sidewalls 270 that plates 272, 274 are coupled to collectively define a plurality of female couplers that are functionally and/or structurally the same as female couplers 170.

One or more shelves 280 are coupled to sidewalls 270 such that the base of the respective shelves 280 slides out of the storage area defined by support platform 260. For each shelf 280, a plate 282 is coupled to the shelf 280 such that the plate and shelf collectively define a plurality of female couplers that are functionally and/or structurally the same as female couplers 170.

In various embodiments, support platform 260 is 40" tall, and the work top is detachable. In various embodiments, the shelves 280 can be gang locked to secure the shelves 280.

Figure 11:
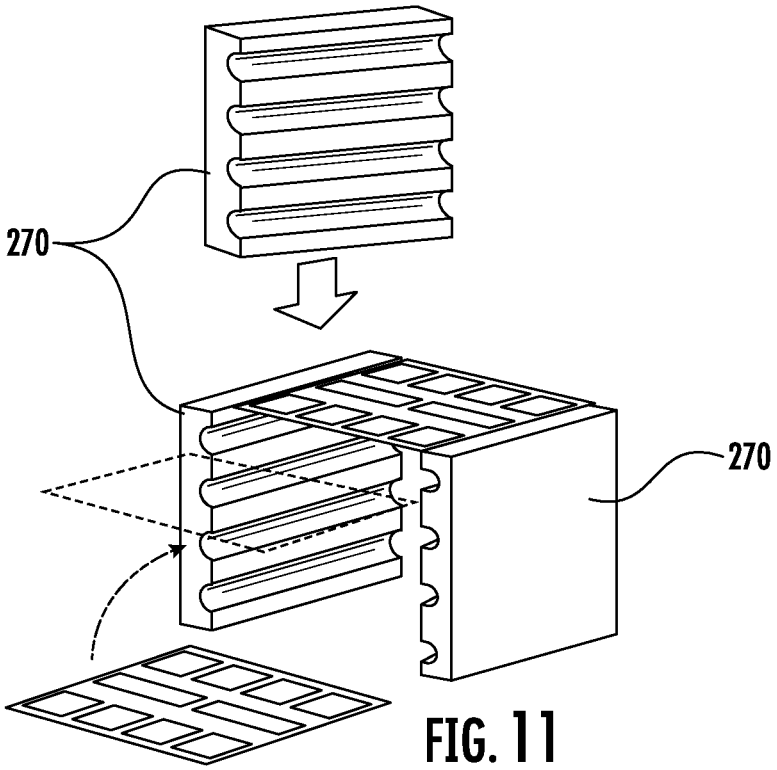
Figure 12:
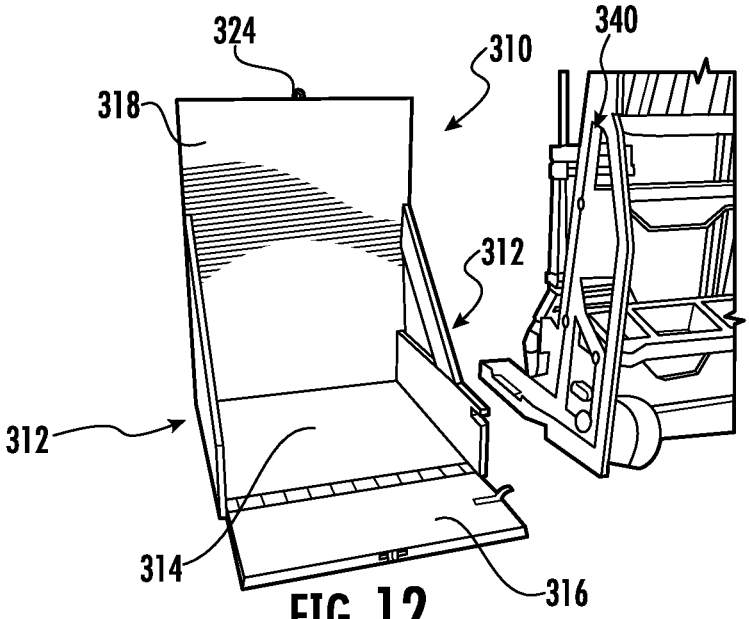
FIGS. 12-17 show various views of a support platform, according to another exemplary embodiment.
Figure 13:
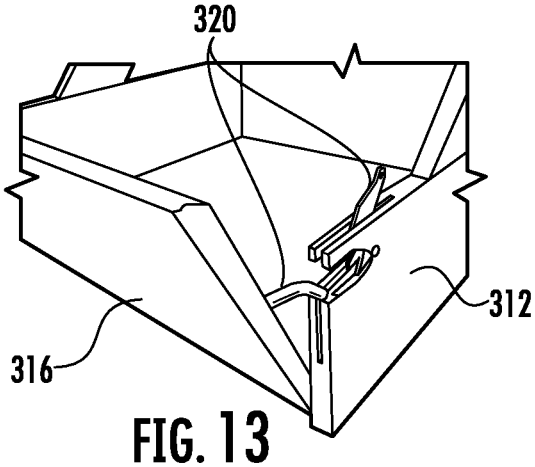

Referring to FIG. 11, support platform 260 is modular and/or stackable such that sidewalls 270 can be stacked on top of another sidewall 270, thereby vertically expanding the storage area of the support platform 260.

Referring to FIGS. 12-17, support platform 310 is shown according to an exemplary embodiment. Support platform 310 is substantially the same as support platform 110 or support platform 260 except for the differences discussed herein.

Sidewalls 312 are coupled to opposing sides of base 314. Front wall 316 is pivotally coupled to a front of base 314. Back wall 318 is coupled to a back of base 314 opposite front wall 316.

Figure 14:
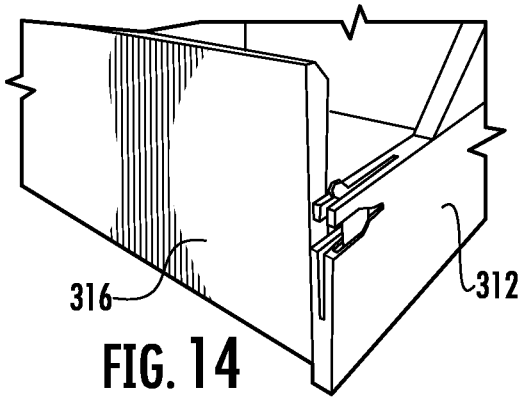
Figure 15:
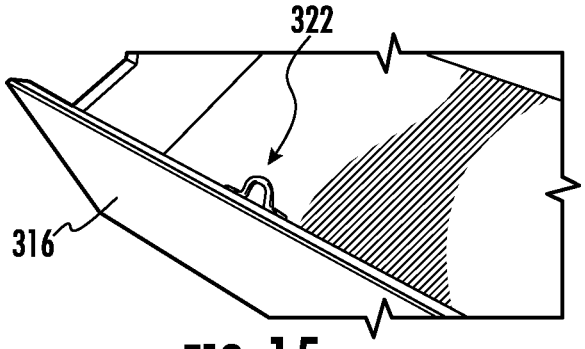
Figure 16:
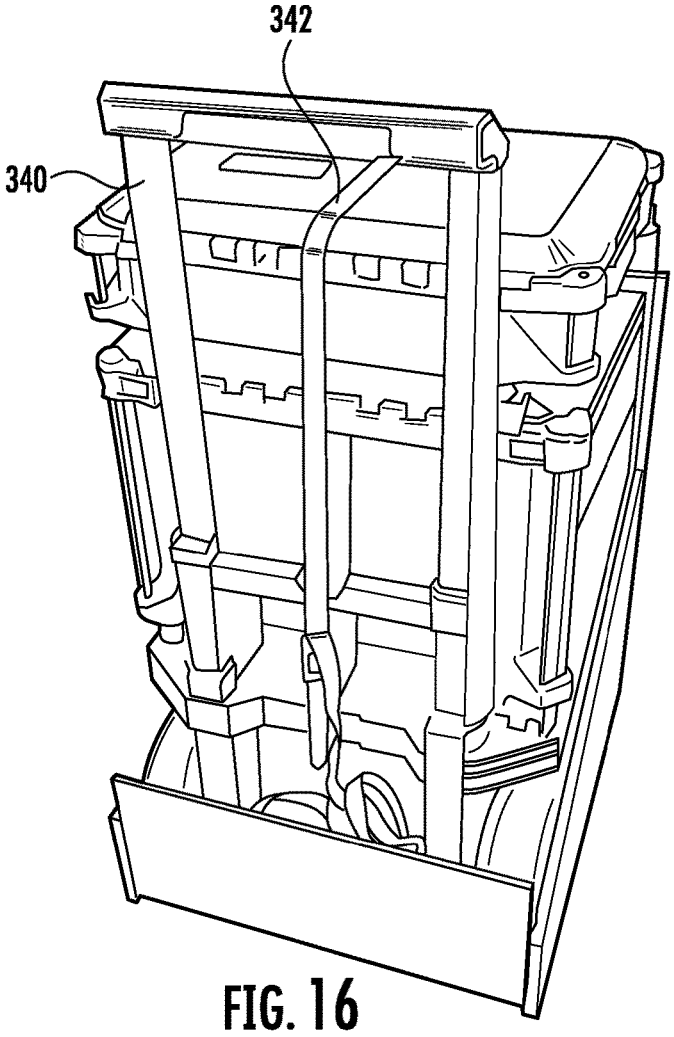
Figure 17:
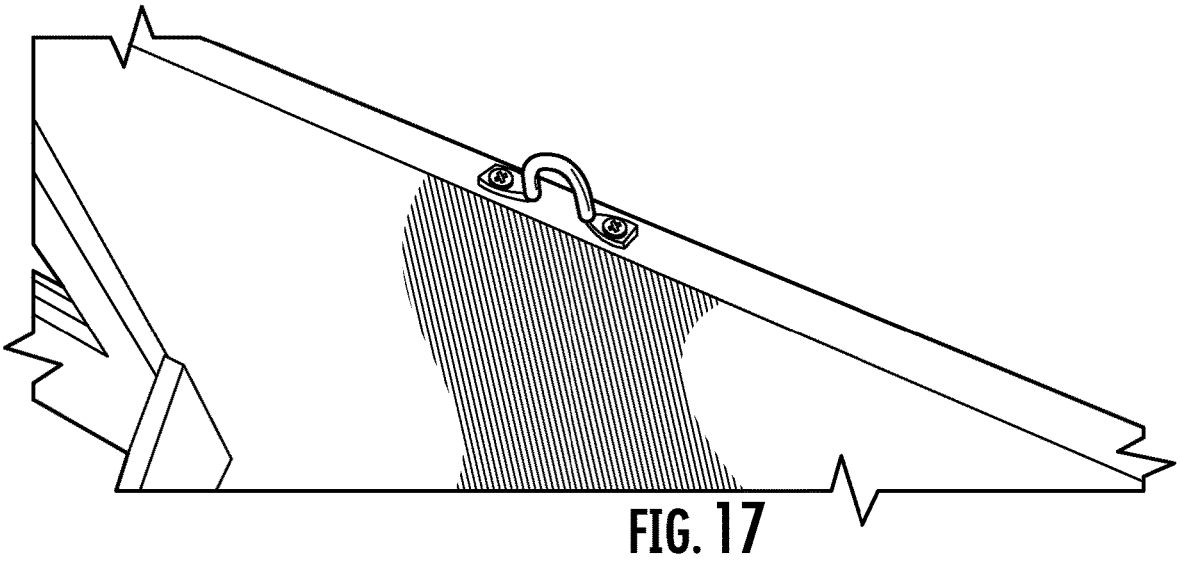
Figure 18:
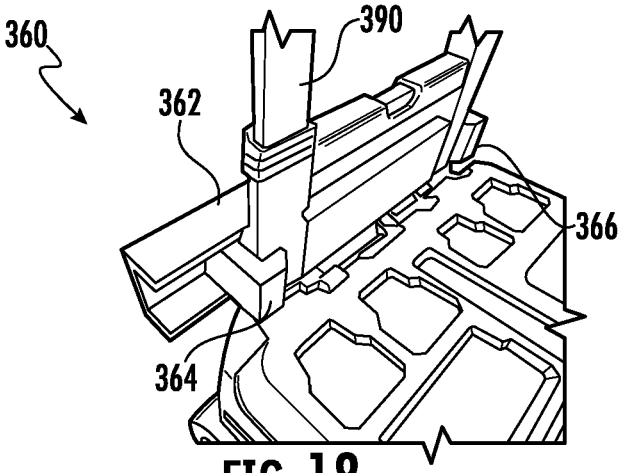
FIGS. 18-27 show various views of a support platform, according to another exemplary embodiment.

Front wall 316 actuates between an open position (FIG. 12) and a closed position (FIG. 14). Locking mechanism 320 detachably couples front wall 316 to one of sidewalls 312, thereby securing front wall 316 in the closed position.

Ringlet 322 is coupled to front wall 316, and ringlet 324 is coupled to back wall 318. In use, an elongate securing structure, shown as strap 342, is coupled to ringlet 322 and ringlet 324 to secure rollable utility module 340 within support platform 310. To remove rollable utility module 340, strap 342 is decoupled from one or both of ringlets 322, 324 and locking mechanism 320 is released to permit front wall 316 to pivot to the open position.

Referring to FIGS. 18-27, support platform 360 is shown according to an exemplary embodiment. Support platform 360 is substantially the same as support platform 110, support platform 260 or support platform 310 except for the differences discussed herein.

First clamp 364 and second clamp 366 are coupled to opposing sides of base 362. First clamp 364 and second clamp 366 collectively and detachably couple base 362 to a utility module 390.

Figure 23:
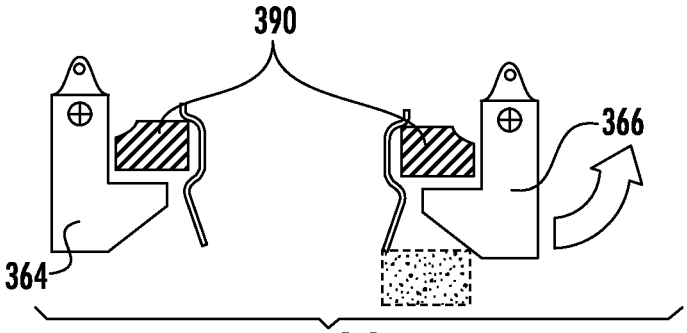

Referring to FIG. 23, to secure utility module 390 the utility module 390 is moved towards the base, and the chamfered outer surfaces of clamps (e.g., second clamp 366) bias the clamps away from each other, thereby permitting utility module 390 to be secured by the clamps.

Figure 19:
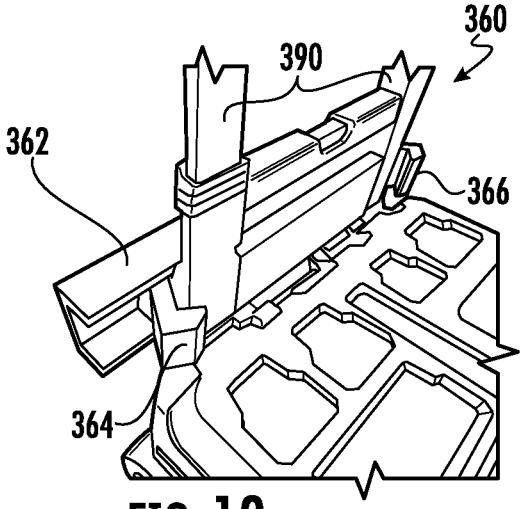
Figure 20:
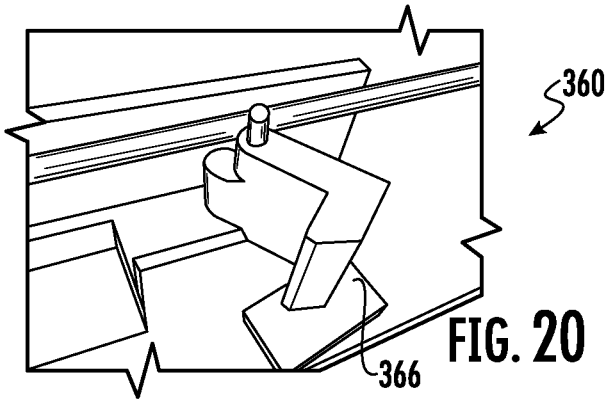
Figure 21:
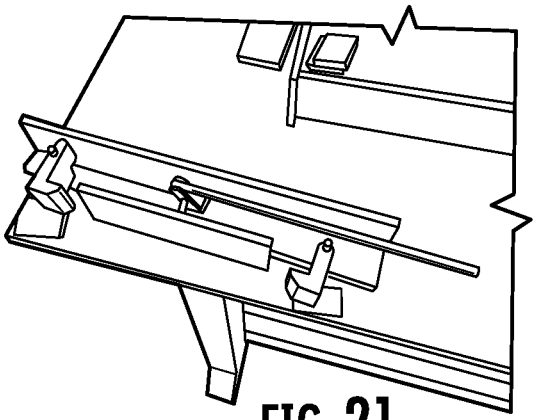
Figure 22:
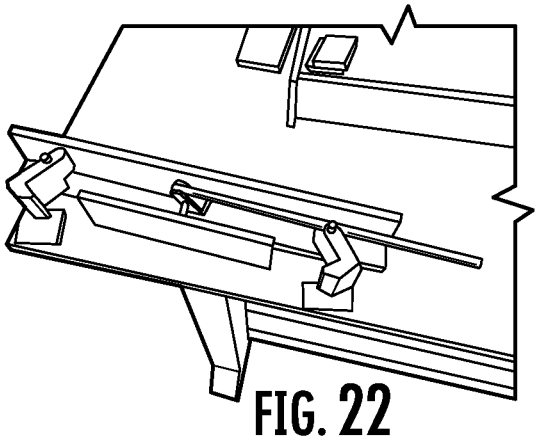
Figure 24:
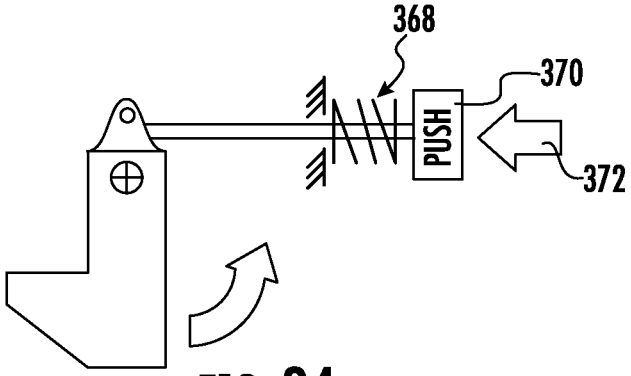

Referring to FIG. 24, to release utility module 390, a button 370 is actuated in direction 372 to move clamps to pivot away from each other (shown in FIG. 19). In various embodiments, a spring 368 biases button 370 in opposite direction 372, thereby biasing the clamps to be pivoted towards each other (shown in FIG. 18).

Figure 25:
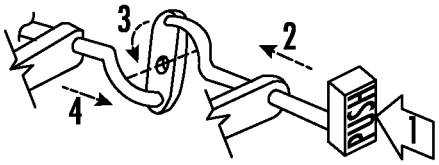
Figure 26:
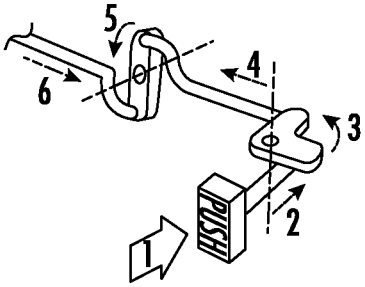
Figure 27:
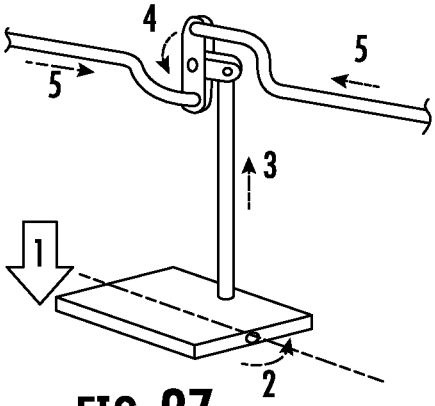

Referring to FIGS. 25-27, various linkage options are shown that actuate the clamps 364, 366. FIG. 25 depicts an exemplary linkage that uses side button, FIG. 26 depicts an exemplary linkage that uses a front button, and FIG. 27 depicts an exemplary linkage that uses a foot pedal.

Figure 28:
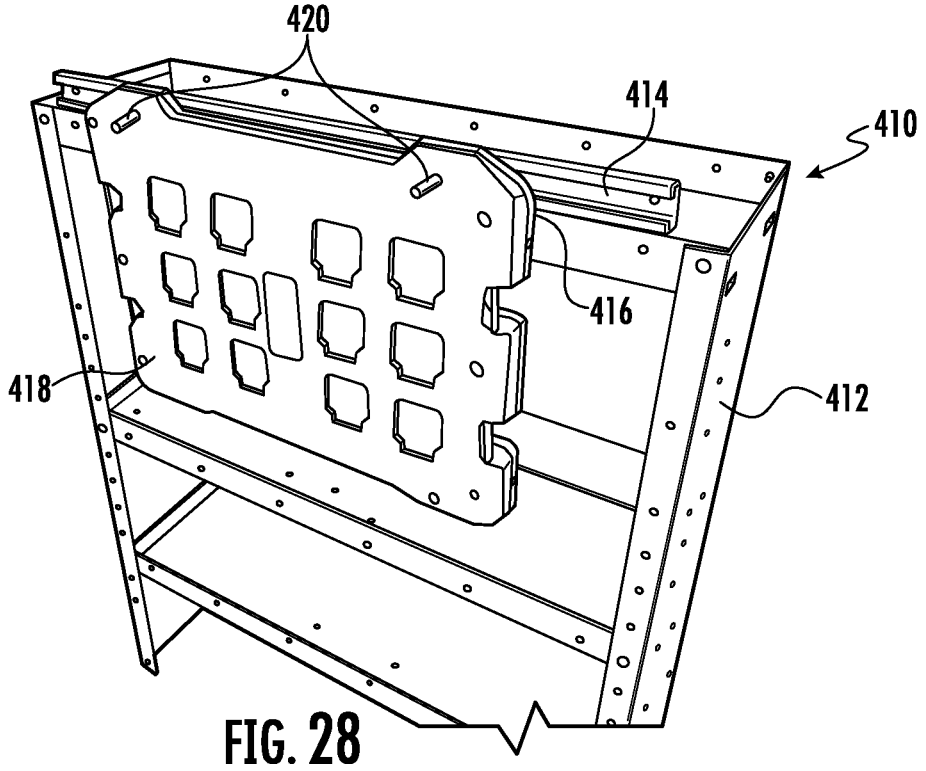
FIG. 28 show a perspective view of a support platform, according to another exemplary embodiment.

Referring to FIG. 28, support platform 410 is shown according to an exemplary embodiment. Support platform 410 is substantially the same as support platform 110, support platform 260, support platform 310 or support platform 360 except for the differences discussed herein.

A rail 414 is coupled to a frame 412 that is configured to receive and store utility modules. Door 416 is slidably engaged with rail 414 such that door 416 actuates laterally along a front of frame 412. Locking mechanisms 420 (e.g., screws) are coupled to door 416 to secure door 416 in various positions with respect to frame 412. Plate 418 is coupled to door 416 such that plate 418 and door 416 collectively define a plurality of female couplers that are functionally and/or structurally the same as female couplers 170.

Figure 29:
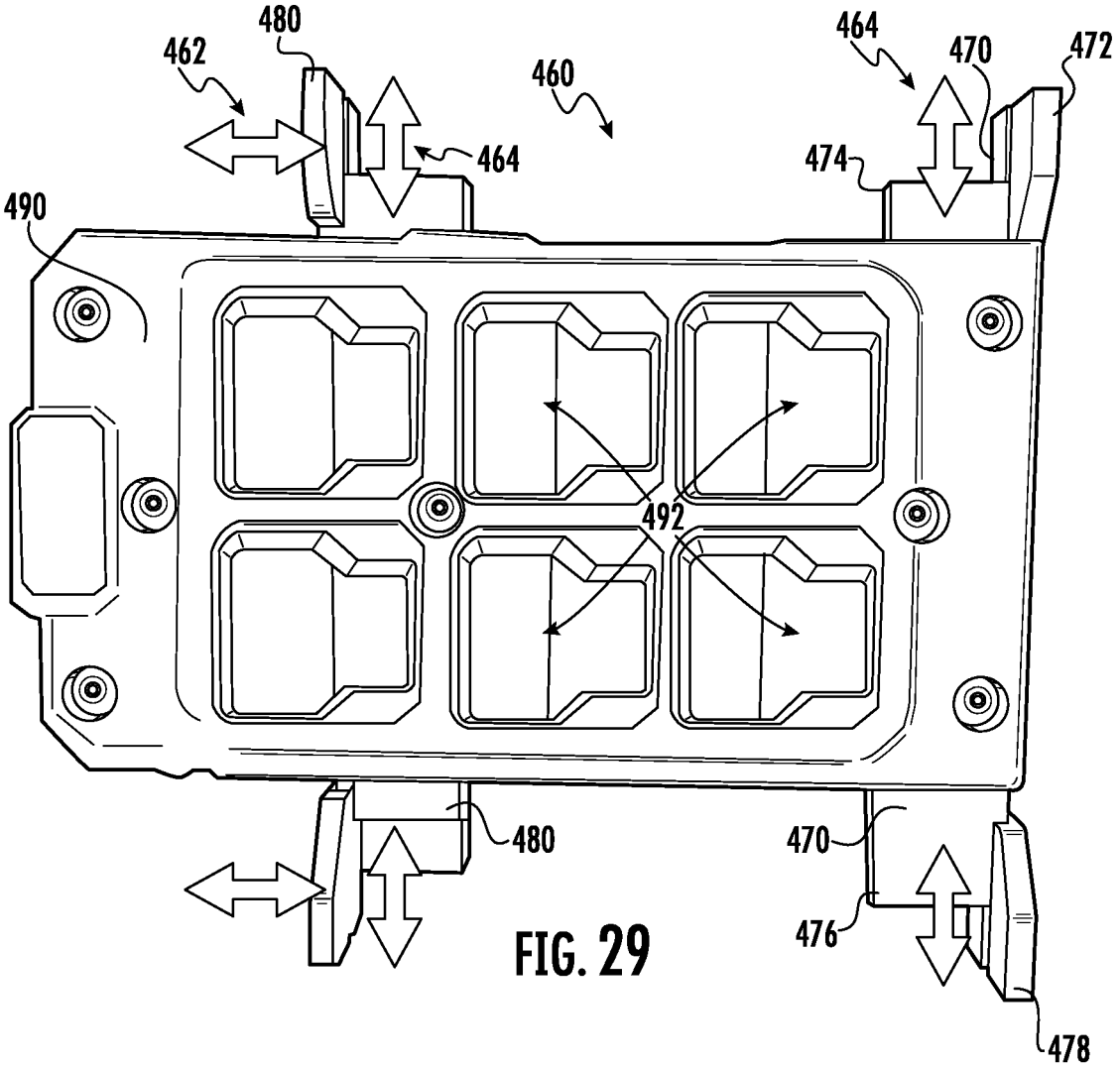
FIGS. 29-31 show various views of a support platform, according to another exemplary embodiment.
Figure 30:
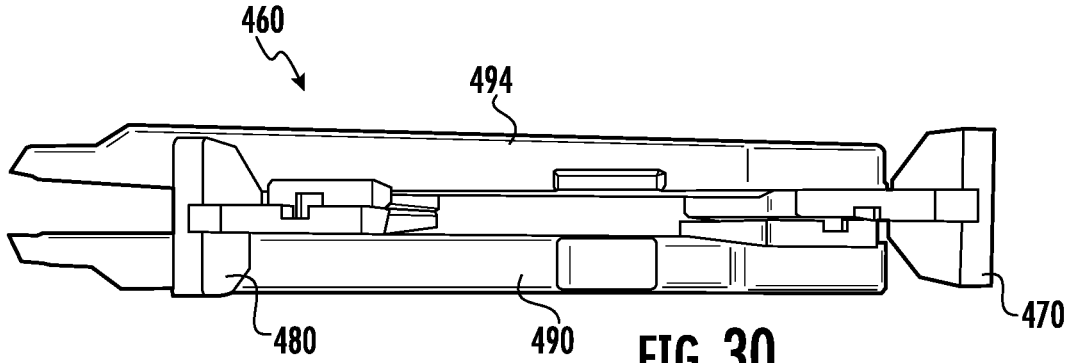
Figure 31:
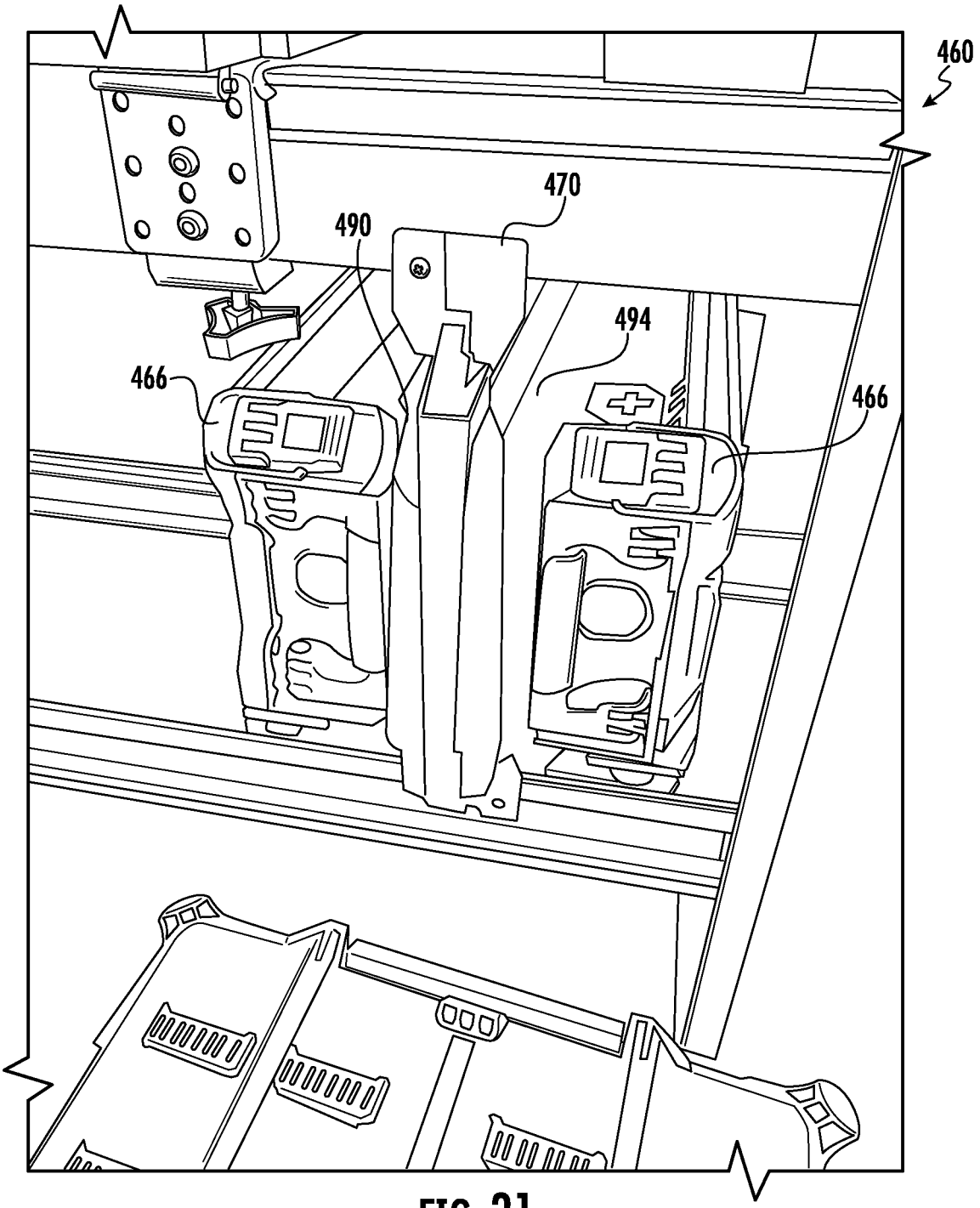
Figure 32:
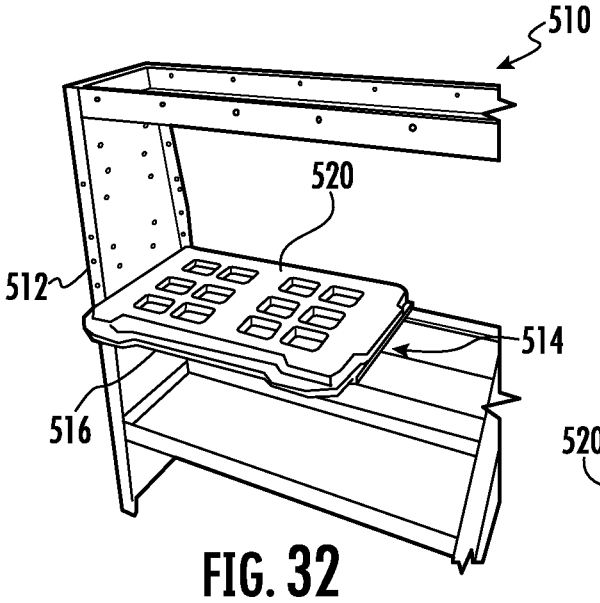
FIGS. 32-35 show various views of a support platform, according to another exemplary embodiment.
Figure 33:
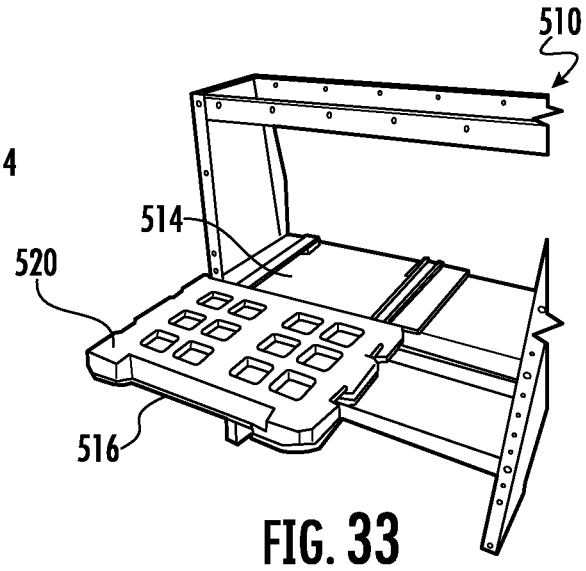
Figure 34:
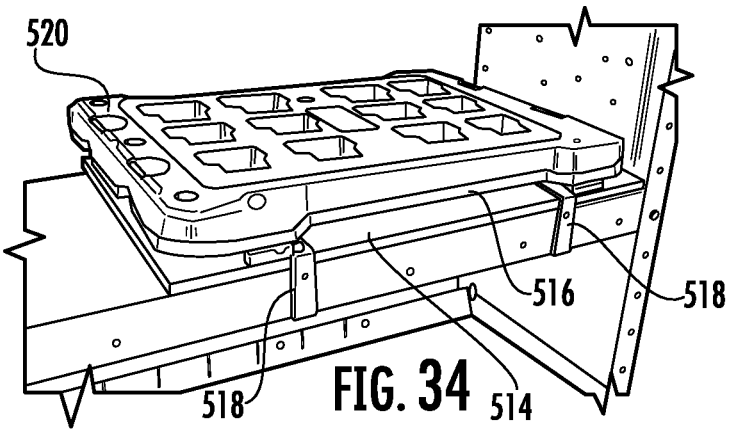
Figure 35:
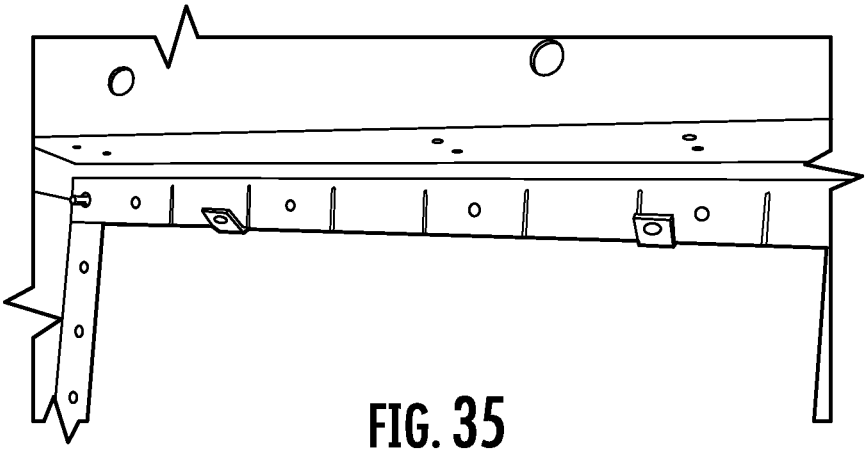
Figure 36:
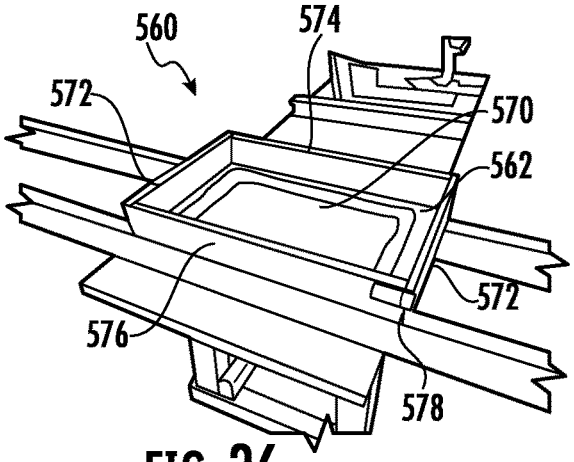
FIGS. 36-40 show various views of a support platform, according to another exemplary embodiment.
Figure 37:
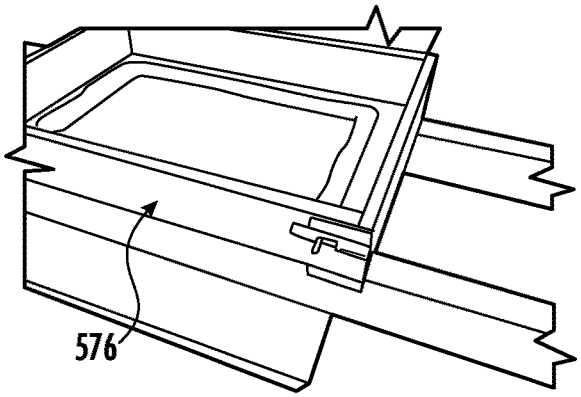
Figure 38:
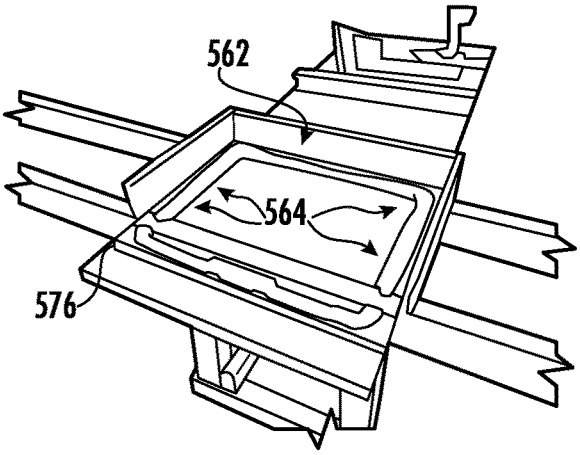
Figure 39:
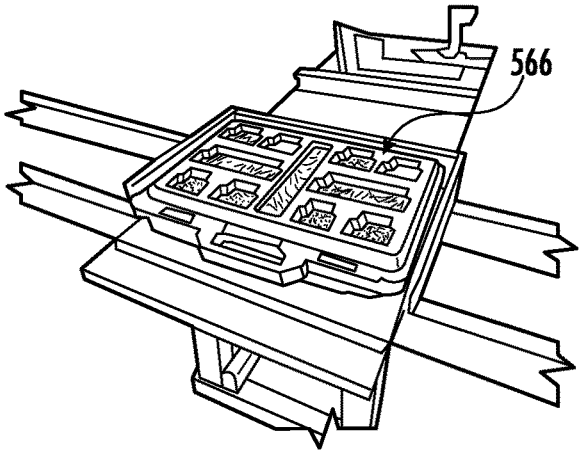

Referring to FIGS. 29-30, support platform 460 is shown according to an exemplary embodiment. Support platform 460 is substantially the same as support platform 110, support platform 260, support platform 310, support platform 360 or support platform 410 except for the differences discussed herein.

Support platform 460 can adjusted to varying heights (e.g., along the vertical axis 464) and depths (e.g., along the lateral axis 462) based on the size and configuration of the support structure (e.g., shelf) that the support platform 460 is being inserted into.

According to one exemplary method of installing support platform 460, front unit 470 is coupled to a front of a shelf. In particular, upper plate 472 and/or lower plate 478 are coupled to a front of a shelf, such as inserting one or more screws through upper plate 472 and/or lower plate 478. First middle plate 474 is coupled to upper plate 472 (e.g., rigidly coupled), and second middle plate 476 is coupled to lower plate 478 (e.g., rigidly coupled).

First middle plate 474 and second middle plate 476 are slidably engaged with each other. This slidable engagement permits upper plate 472 to be positioned at varying heights above lower plate 478 to match the height of the shelf that front unit 470 is being installed into. After front unit 470 is coupled to the shelf, one or more plates, such as plate 490 and plate 494, are coupled to front unit 470. In various embodiments plate 490 includes one or more female couplers 492 that are functionally and/or structurally the same or similar to female couplers 170, and plate 494 similarly includes one or more female couplers that are functionally and/or structurally the same or similar to female couplers 170.

Then, rear unit 480 is coupled to the one or more plates (e.g., plate 490 and/or plate 494). Rear unit 480 is functionally and/or structurally similar to the front unit 470. Finally, rear unit 480 is coupled to the shelf, such as via screws through the upper plate and/or lower plate.

Once installed in the shelf, one or more utility modules 466 can be coupled to the support platform 460.

Referring to FIGS. 32-35, support platform 510 is shown according to an exemplary embodiment. Support platform 510 is substantially the same as support platform 110, support platform 260, support platform 310, support platform 360, support platform 410 or support platform 460 except for the differences discussed herein.

Base 514 is fixedly coupled to frame 512, such as via one or more lips 518 coupled to base 514 that are secured around a rear of frame 512 and/or via bolts through the base 514 into the top of the shelf 516. Shelf 516 is slidably coupled to base 514 such that shelf 516 actuates into and out of the storage area defined by support platform 510. Plate 520 is coupled to shelf 516 such that plate 520 and shelf 516 collectively define a plurality of female couplers that are functionally and/or structurally the same as female couplers 170.

In various embodiments, the shelf 516 can lock using a lock design and/or using commodity locking drawer slides.

Referring to FIGS. 36-40, support platform 560 is shown according to an exemplary embodiment. Support platform 560 is substantially the same as support platform 110, support platform 260, support platform 310, support platform 360, support platform 410, support platform 460 or support platform 510 except for the differences discussed herein.

Support platform 560 includes a base 570 and one or more walls extending upward from base 570. In various embodiments, support platform 560 includes sidewalls 572 and back wall 574 extending upward from base 570. Front wall 576 is pivotally coupled to base 570 opposite back wall 574. Front wall 576 is captured in a closed configuration (FIG. 36) by latch 578.

Coupling structure 562 is coupled to base 570, such as an upper surface of base 570. Coupling structure 562 includes couplers 564 configured to couple to male couplers. As shown, couplers 564 are each a portion of a female coupler (e.g., a half of a female coupler). In use, a utility module 566 with couplers (e.g., male couplers) extending from a bottom are inserted into support platform 560 and engaged with the couplers 564.

Figure 40:
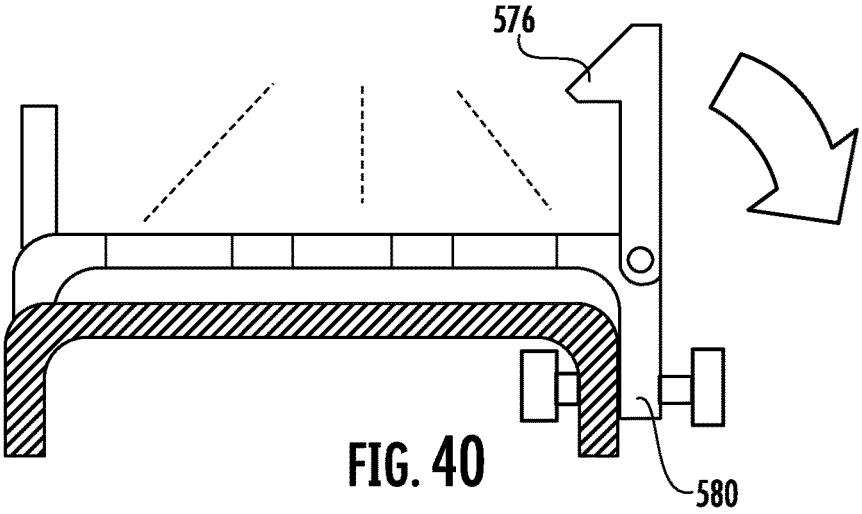

Referring to FIG. 40, to install support platform a fastener (e.g., a screw) is inserted through a lower front wall 580 coupled to a front of base 570 below front wall 576.

Figure 41:
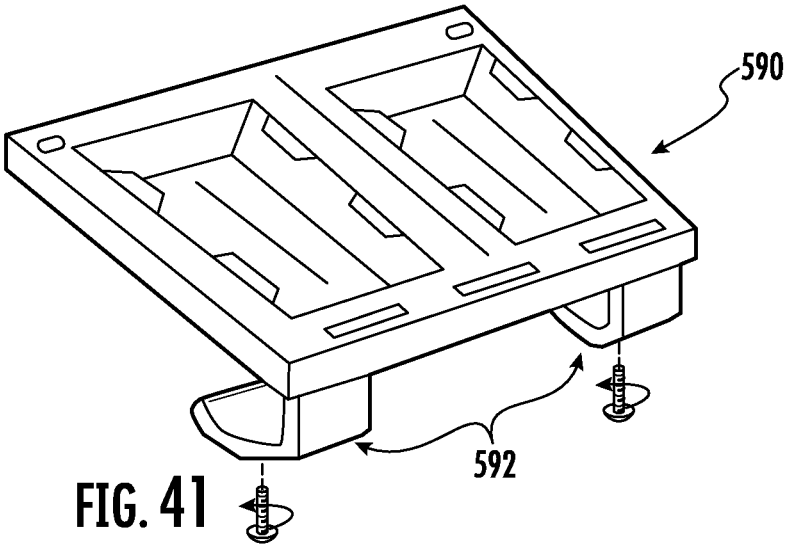
FIGS. 41-42 show various views of a support platform, according to another exemplary embodiment.
Figure 42:
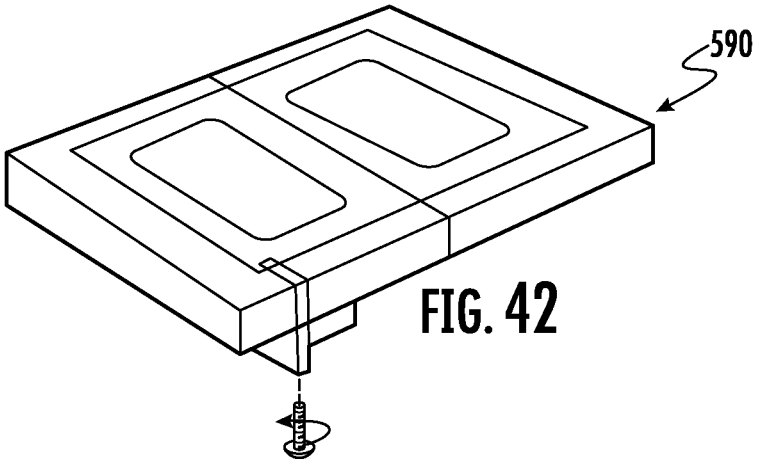

Referring to FIGS. 41-42, support platform 590 is shown according to an exemplary embodiment. Support platform 590 is substantially the same as support platform 560 except for the differences discussed herein. In particular, support platform 590 includes one or more clamps 592 that couple support platform 590 to an object, such as a shelf that support platform 590 is resting on.

Figure 43:
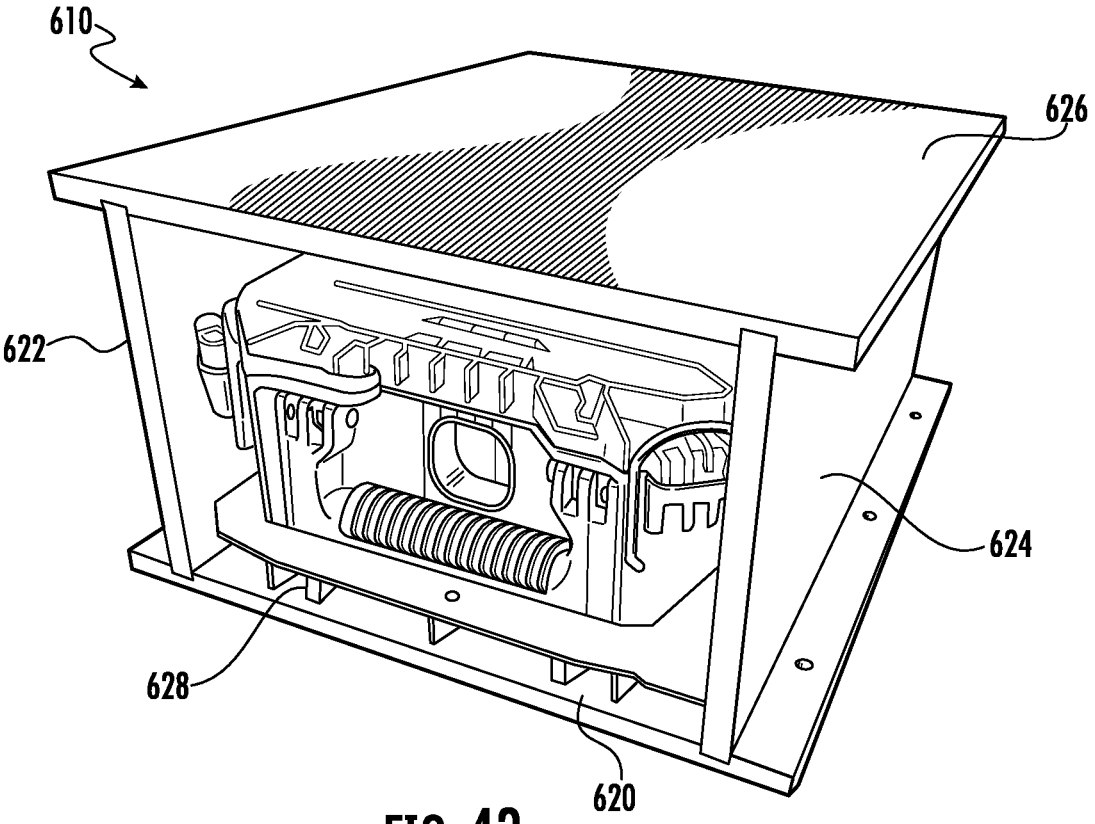
FIG. 43 show a perspective view of a support platform, according to another exemplary embodiment.
Figure 44:
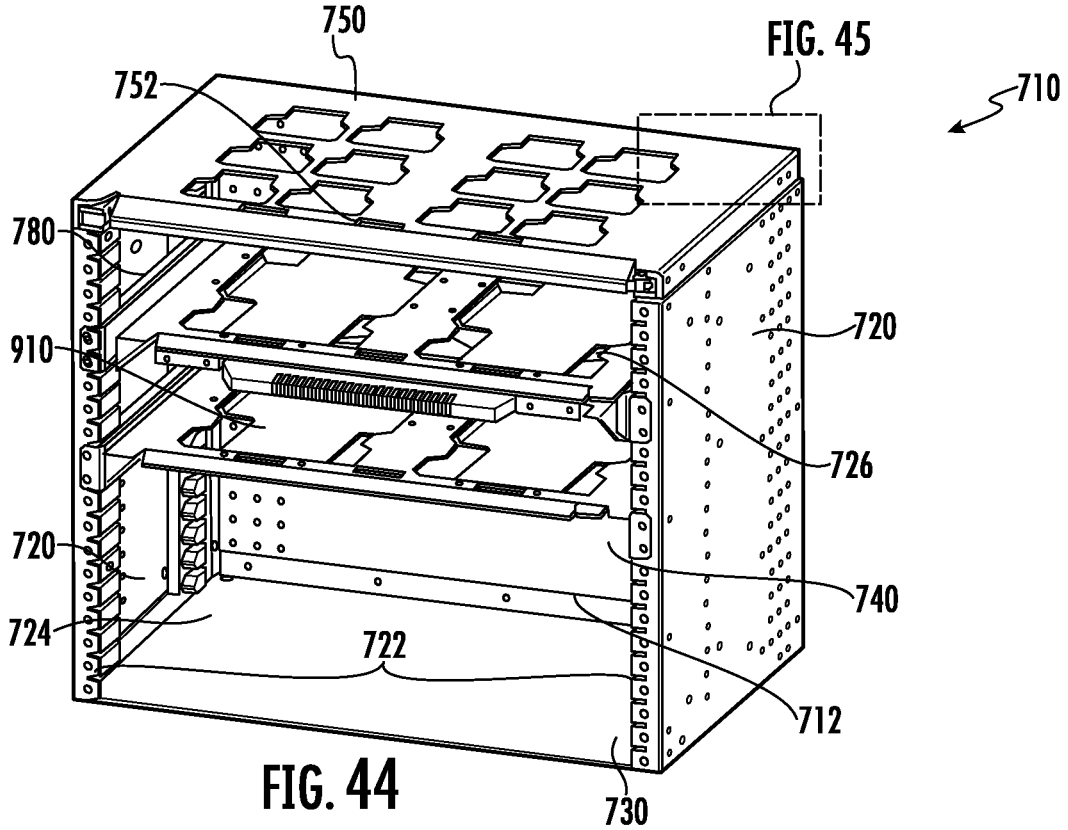
FIGS. 44-59 show various views of a support system and a utility module, according to exemplary embodiments.

Referring to FIG. 43, support platform 610 is shown according to an exemplary embodiment. Support platform 610 is substantially the same as support platform 110, support platform 260, support platform 310, support platform 360, support platform 410, support platform 460, support platform 510 or support platform 560 except for the differences discussed herein.

In various embodiments, support platform 610 is substantially the same as support platform 110. In various embodiments, support platform 610 is sized to receive a single utility module. In various embodiments, support platform 610 is coupled (e.g., screwed) to an underside of a shelf to mount to an existing rack. In various embodiments, multiple support platforms 610 are stacked to form a larger module.

Base 620, first wall 622, second wall 624, and lid 626 collectively define a storage area for support platform 610. A plate 628 is coupled to base 620 such that plate 628 and base 620 collectively define a plurality of female couplers that are functionally and/or structurally the same as female couplers 170.

Referring to FIGS. 44-57, a modular support system, shown as support structure 710, is shown according to an exemplary embodiment. Support structure 710 is substantially the same as support platform 110, support platform 260, support platform 310, support platform 360, support platform 410, support platform 510, support platform 560, or support platform 610 except for the differences discussed herein. In various embodiments and as discussed in more detail below, support structure 710 is configured to provide for convenient and strong attachment to a wall (e.g., an internal wall) of a vehicle (e.g., a van, such as a van for contractors), and for easy assembly and attachment by the end user. In various embodiments, support structure 710 is configured to be added to a small footprint (e.g., tools, hardware, and items can be densely packed within support system 710, which occupies a small amount of lateral space relative to the volume of items contained), be quickly and easily installed, and when installed the storage units within the support platform are quickly accessible. As discussed, in more detail below, support structure 710 is configured to provide one or more of these functional improvements while at the same time providing for secure storage in moving vehicle, such as a work van, transit van, etc. Support structure 710 is for coupling to and supporting a utility module (e.g., utility module 1010) for transit, the support structure 710 detachably coupling to one or more male couplers (e.g., coupler 1020 of the utility module (e.g., utility module 1010).

Figure 75:
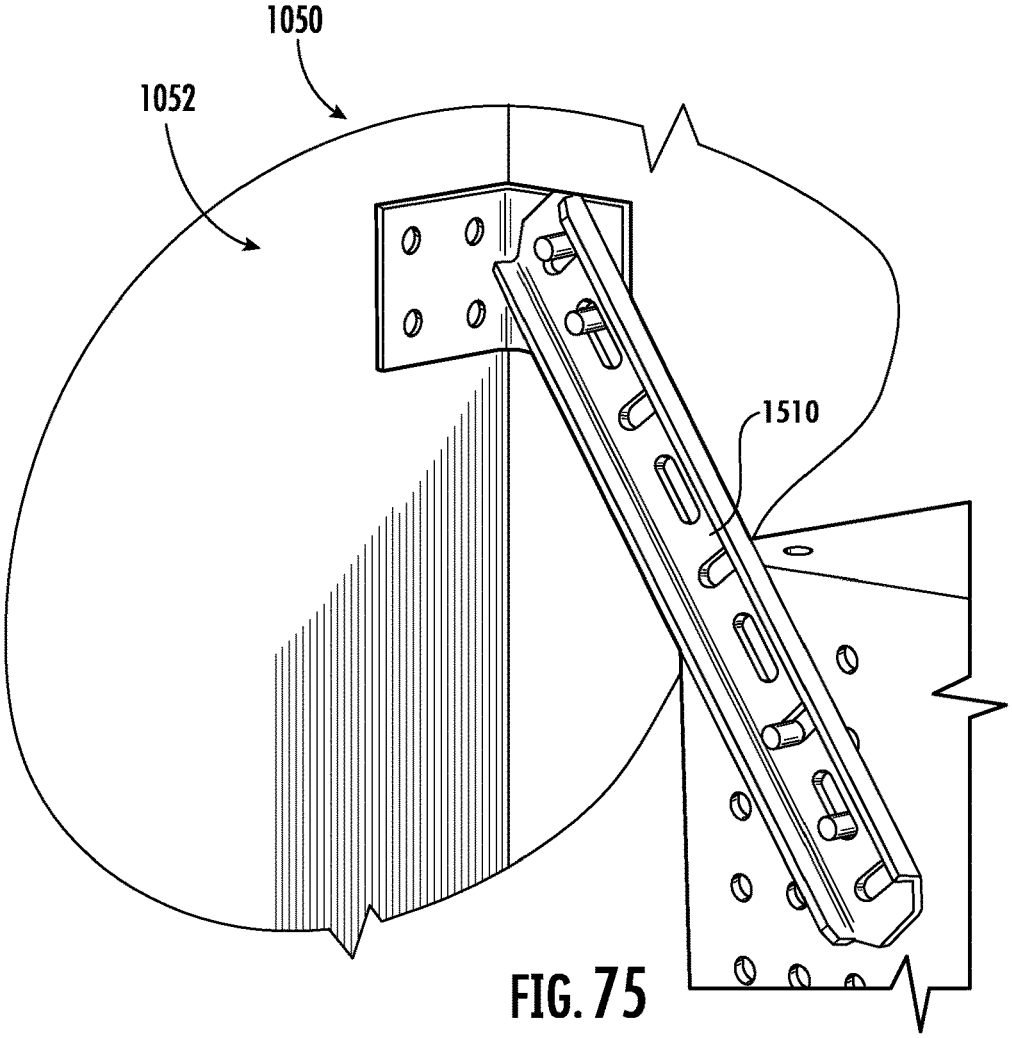
Figure 76:
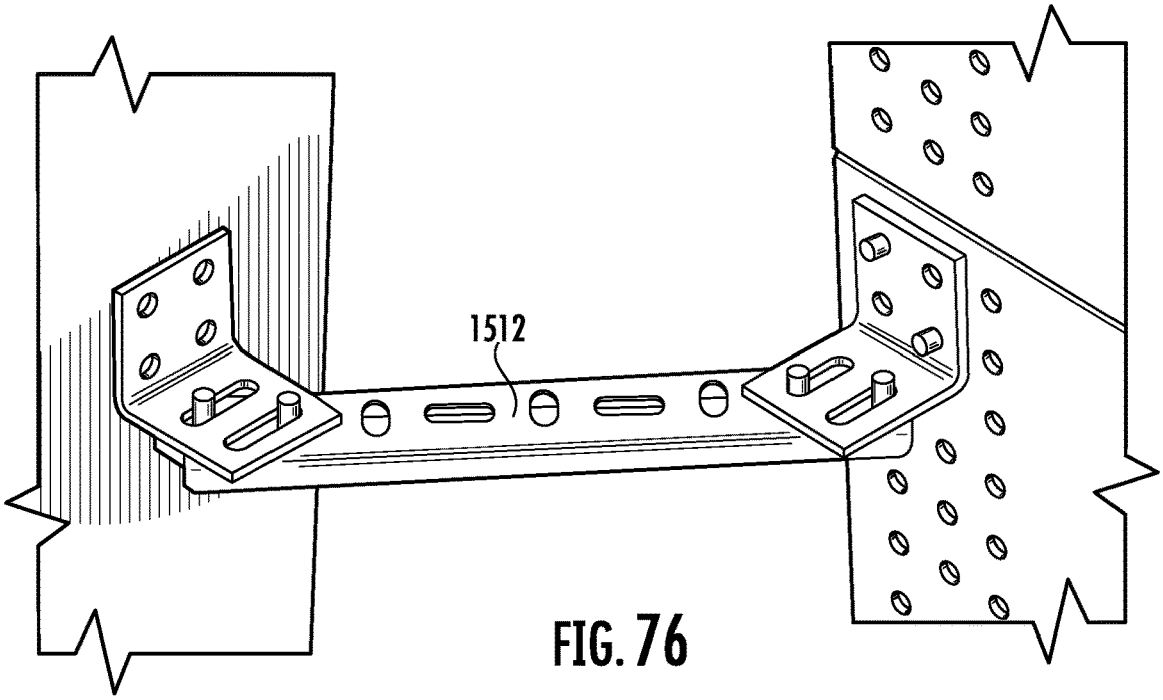
Figure 77:
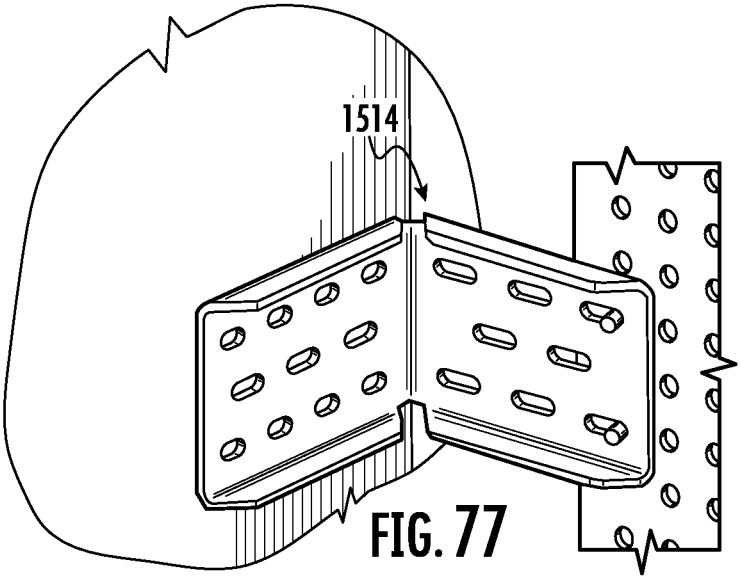
Figure 78:
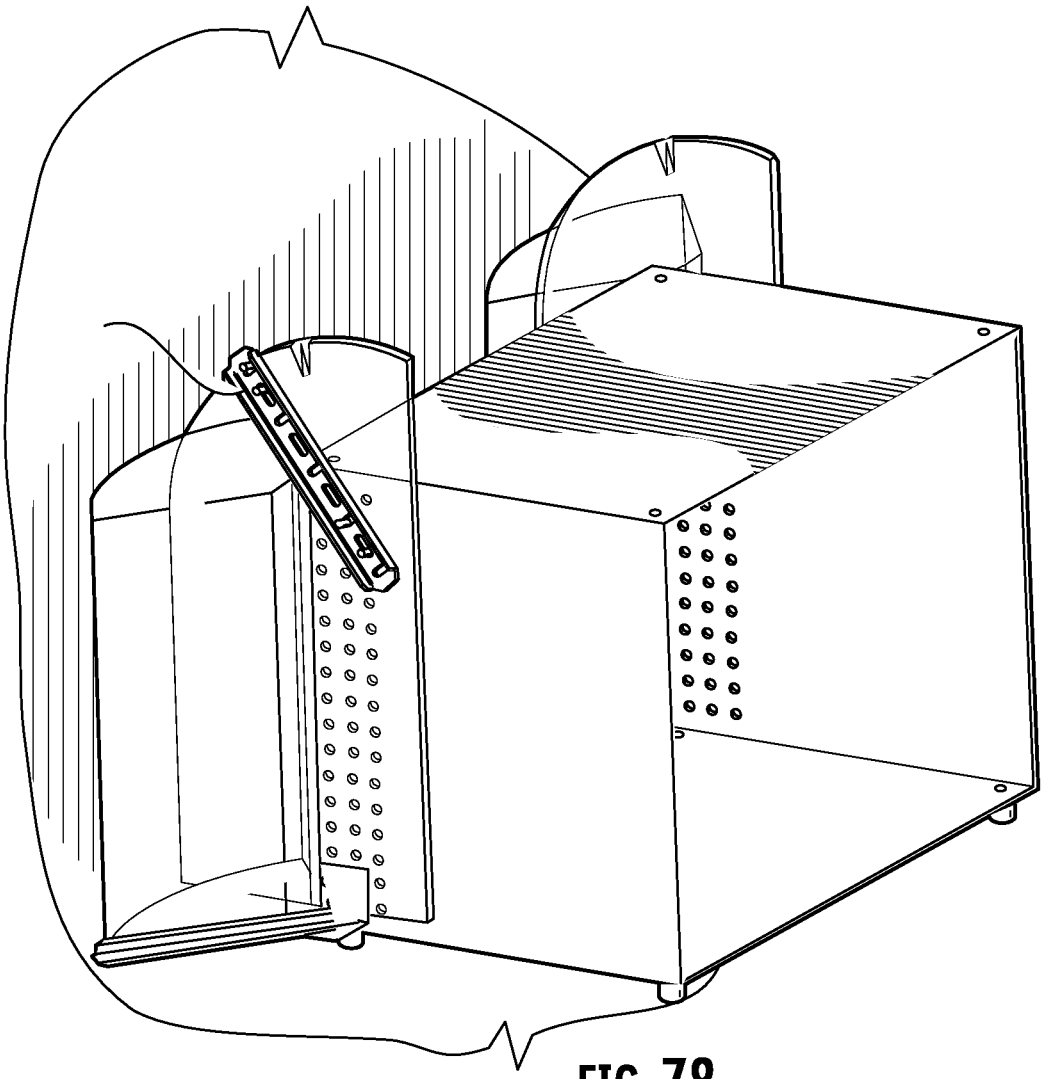

Support structure 710 includes base 730, a first wall 720 coupled to, such as detachably coupled, and extending upward from base 730, a second wall 721 coupled to, such as detachably coupled, and extending upward from base 730 opposite the first wall 720, and a storage area 712 collectively defined by the base 730, first wall 720 and second wall 721. In various embodiments, first wall 720 is configured to detachably couple to a support bar (e.g., one of support bars 1510, 1512, 1514, and 1516 in FIGS. 75-78), the support bar coupling the first wall 720 to a wall (e.g., wall 1052 in FIG. 75) of a vehicle (e.g., vehicle partially shown in FIGS. 75 and 79).

Support structure 710 includes a first shelf 726 slidably engaged with first wall 720 and second wall 721, such as via brace 780. In various embodiments, support structure 710 includes brace 780. Brace 780 is coupled to, such as rigidly coupled, and extending between sidewalls 720, 721. First shelf 726 slidably actuates along axis 732 between a stowed position (FIG. 55) and an extended position (FIG. 54) with respect to the first wall 720 and the second wall 721. First shelf 726 defines a length 734 along axis 732. When first shelf 726 is in the stowed position, greater than 50% of the length 734 of the first shelf 726 is within the storage area 712, and when the first shelf 726 is in the extended position, greater than 50% of the length 734 of the first shelf 726 is extended out of the storage area 712. A shelf (e.g., first shelf 726, shelf 810) is within the storage area 712 and positioned above the brace 780 when the shelf is in the stowed position and the shelf extends out of the storage area 712 when the shelf is in the extended position. The shelf (e.g., first shelf 726, shelf 810, shelf 910) at least partially covers a top surface 789 of the brace 780 when the shelf is in the stowed position, and the shelf uncovers the top surface 789 of the brace 780 as the shelf actuates from the stowed position to the extended position.

First shelf 726 extends between first sidewall 720 and second sidewall 721. Support structure 710 includes second shelf 910 coupled to sidewalls 720, 721. In various embodiments, brace 780 is coupled to sidewalls 720, 721 via two fasteners (e.g., screws) on each side of brace 780 extending through apertures 722.

In various embodiments, brace 780 and/or second shelf 910 provide structural stability to support structure 710 by functioning as cross-members. In various embodiments, when a first support structure 710 is stacked on a second support system 710, the upper wall is removed from the lower support structure 710 and attached to the second (upper) support system 710.

Sidewalls 720, 721 include apertures 722. Brace 780 and/or shelves 726, 910 are coupled to apertures 722 via fasteners, which extend through the brace 780 and/or shelves 726, 910 into apertures 722. Brace 780 and shelf 726 are slidably engaged between railings 724 coupled to sidewalls 720, 721. In various embodiments, railings 724 are spaced such that shelves and/or braces 780 can be placed at 1 inch intervals. In various embodiments railings 724 are formed from a material including a polymer.

Rear wall 740 is coupled to sidewalls 720, 721 and base 730. Top panel 750 is coupled to sidewalls 720, 721 and rear wall 740 opposite base 730. Top panel 750 defines a plurality of female couplers 760. In various embodiments, shelf 910 is coupled to sidewalls 720, 721 via two fasteners (e.g., screws) on each side of shelf 910.

In various embodiments support structure 710 is not coupled to a wall via fasteners (e.g., screws) extending through rear wall 740. Applicant has observed that coupling support structure 710 to walls via the coupling mechanisms discuss herein (e.g., support bars 1510, 1512, 1514, 1516 extending from a side of support structure 710 discussed below) facilitate moving support system 710, such as by not requiring support structure 710 to be emptied before the fasteners can be accessed. Specifically in a modular transport storage device, such as support system 710, Applicant has identified that configuring support structure 710 such support structure 710 can be decoupled from the vehicle wall without disassembling the platform to access rear mounting fasteners provides for more efficient rearrangement and customization of the layout of support structure 710 for a particular user, vehicle, etc.

Figure 45:
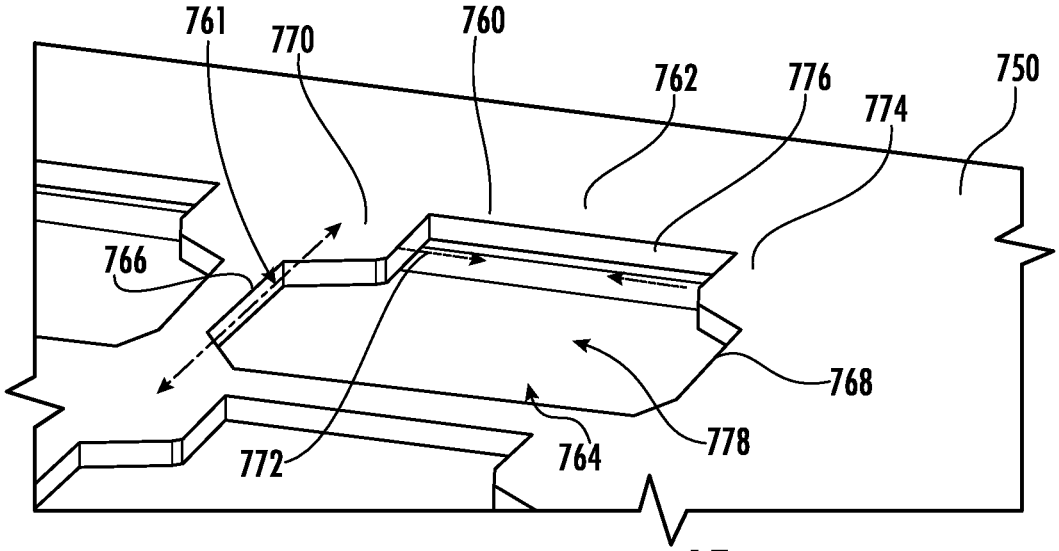

Referring to FIG. 45, female couplers 760 include rear wall 762, front wall 764 opposite rear wall 762, first sidewall 766, second sidewall 768 opposite first sidewall 766, and aperture 778 between rear wall 762, front wall 764, first sidewall 766, and second sidewall 768. Female couplers 760 include first rib 770 extending in first direction 772 from first sidewall 766 towards second sidewall 768, and second rib 774 extending in second direction 776 opposite first direction 772 towards first sidewall 766. Top panel 750 also defines latch recess 752. In use, latch recess 752 receives a latch to secure a utility module engaged with female couplers 760 (e.g., via male couplers extending from a bottom of the utility module).

In various embodiments, a first utility module (e.g., utility module 1010) slides along an axis 761 with respect to the top panel 750 to engage the first male coupler (e.g., coupler 1020) with the first female coupler (e.g., coupler 760), and each of the first rib 770 and the second rib 774 extend along the axis 761 from the back wall 762 towards the front wall 764. In various embodiments, the first utility module (e.g., utility module 1010) slides along an axis 761 with respect to the top panel 750 to engage the first male coupler (e.g., coupler 1020) with the first female coupler (e.g., coupler 760), and the first rib 770 extends from the first sidewall 766 towards the second sidewall 768 in a first direction 772 perpendicular to the axis 761, and the second rib 774 extends from the second sidewall 768 towards the first sidewall 766 in a second direction 776 opposite the first direction 772 and perpendicular to the axis 761.

Figure 46:
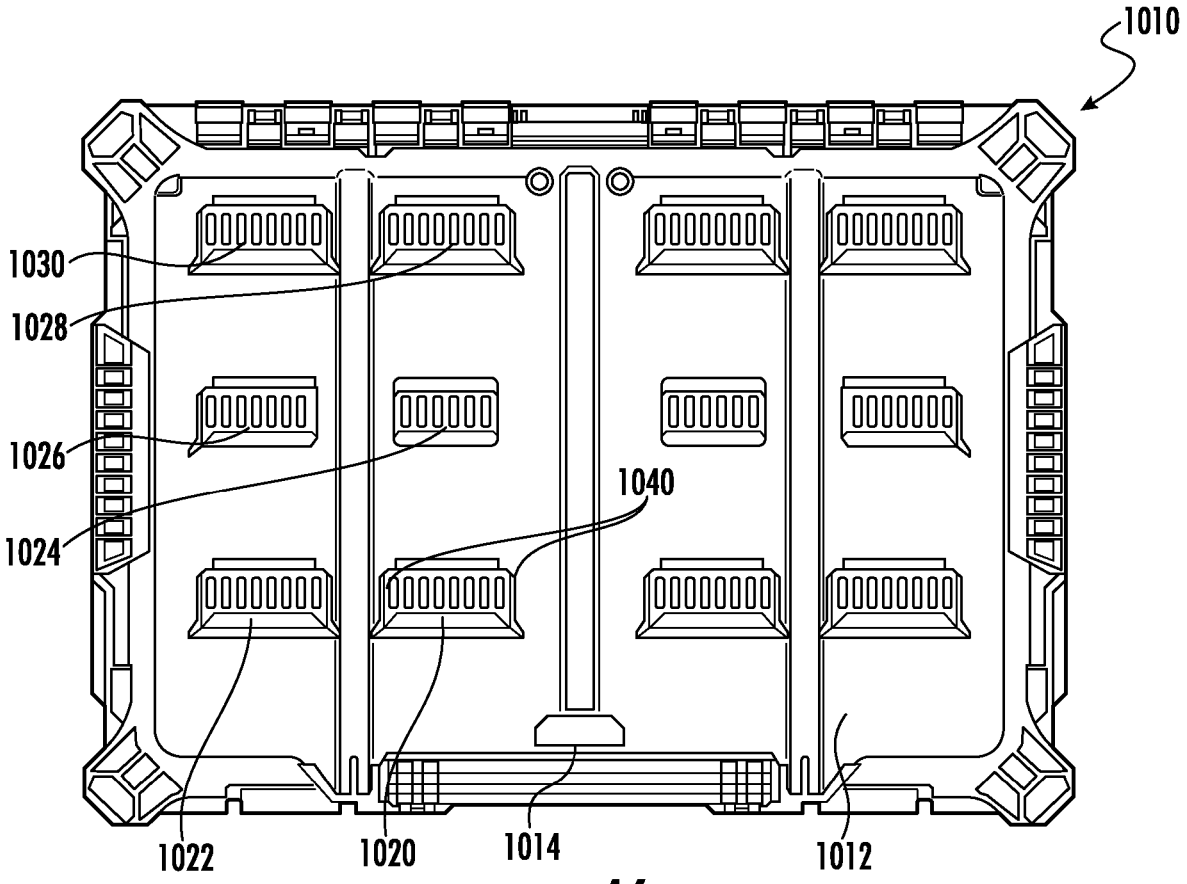
Figure 47:
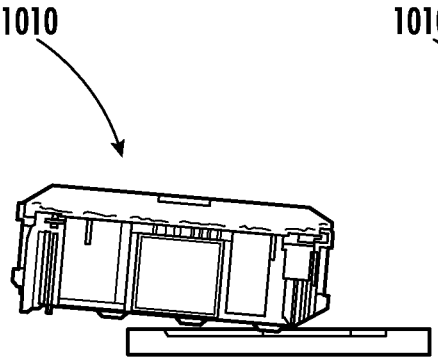
Figure 48:
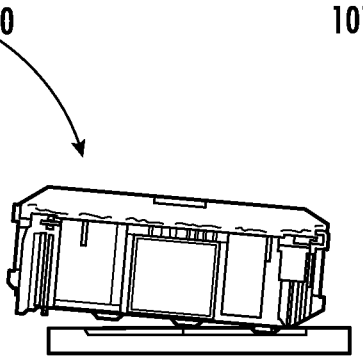

Referring to FIG. 46, an exemplary utility module 1010 is shown. Utility module 1010 couples to one or more of shelves 726, 810, 910, such as via the male couplers extending from the bottom of utility module 1010. Utility module 1010 defines bottom surface 1012 and includes latch 1014 slidably extending past bottom surface 1012. Utility module 1010 includes one or more male couplers, shown as male coupler 1020, male coupler 1022, male coupler 1024, male coupler 1026, male coupler 1028, and male coupler 1030.

One or more of the male couplers extending from bottom surface 1012 of utility module 1010 include one or two tongues 1040 extending from the male coupler, the tongues 1040 extending below and offset from bottom surface 1012. For example, male coupler 1020 includes two tongues 1040, male coupler 1022 includes two tongues 1040, male coupler 1024 includes zero tongues 1040, male coupler 1026 includes one tongue 1040, male coupler 1028 includes two tongues 1040, and male coupler 1030 includes two tongues 1040.

Figure 49:
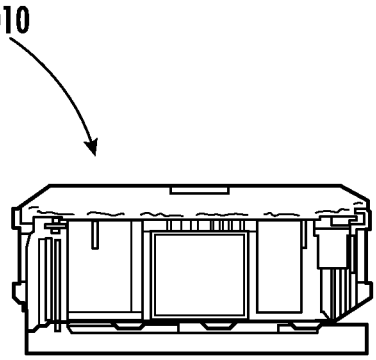

Referring to FIGS. 47-51, various aspects are shown of sliding or positioning a utility module 1010 onto a shelf (e.g., shelf 726, shelf 810, shelf 910) designed for dense packing and low clearance with respect to neighboring shelves. In particular, Applicant has designed shelves for use with support structure 710 that include specifically positioned coupling structures (e.g., female coupling structures) that allow utility module 1010 to be slid onto the shelf at very low angle (nearly horizontal) relative to the shelf. Applicant has determined that configuring a modular support system, such as support system 710, with shelves 726, 810, 910 that provide for low angle modular storage attachment allows for dense packing of the utility modules (tight clearance between upper surfaces of utility modules and the lower surface of the adjacent shelf) while still providing convenient attachment/detachment. Specifically, as shown in FIGS. 47-51 as utility module 1010 is being slid onto a shelf (FIG. 47), if the middle of the shelf includes female couplers to engage the tongues of utility module 1010 (see transition from FIG. 47 to FIG. 48), then the user will be prevented from sliding utility module 1010 to the final resting position on shelf (FIG. 49). Therefore, the designs of the coupling arrangements of the shelves discussed herein (e.g., shelf 726, shelf 810, and shelf 910) facilitate sliding utility module 1010 onto the shelf by including a linear wall that extends where a female coupler would otherwise be located.

Figure 50:
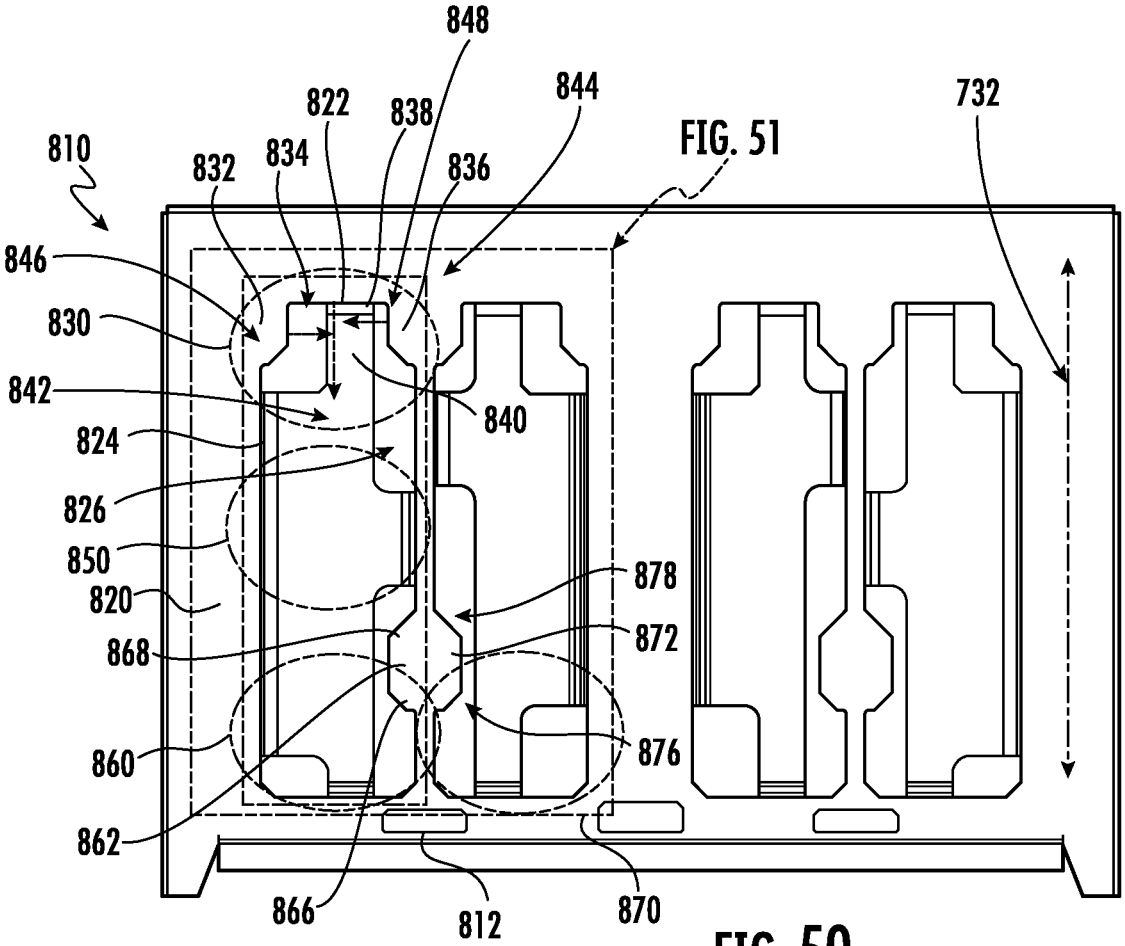
Figure 51:
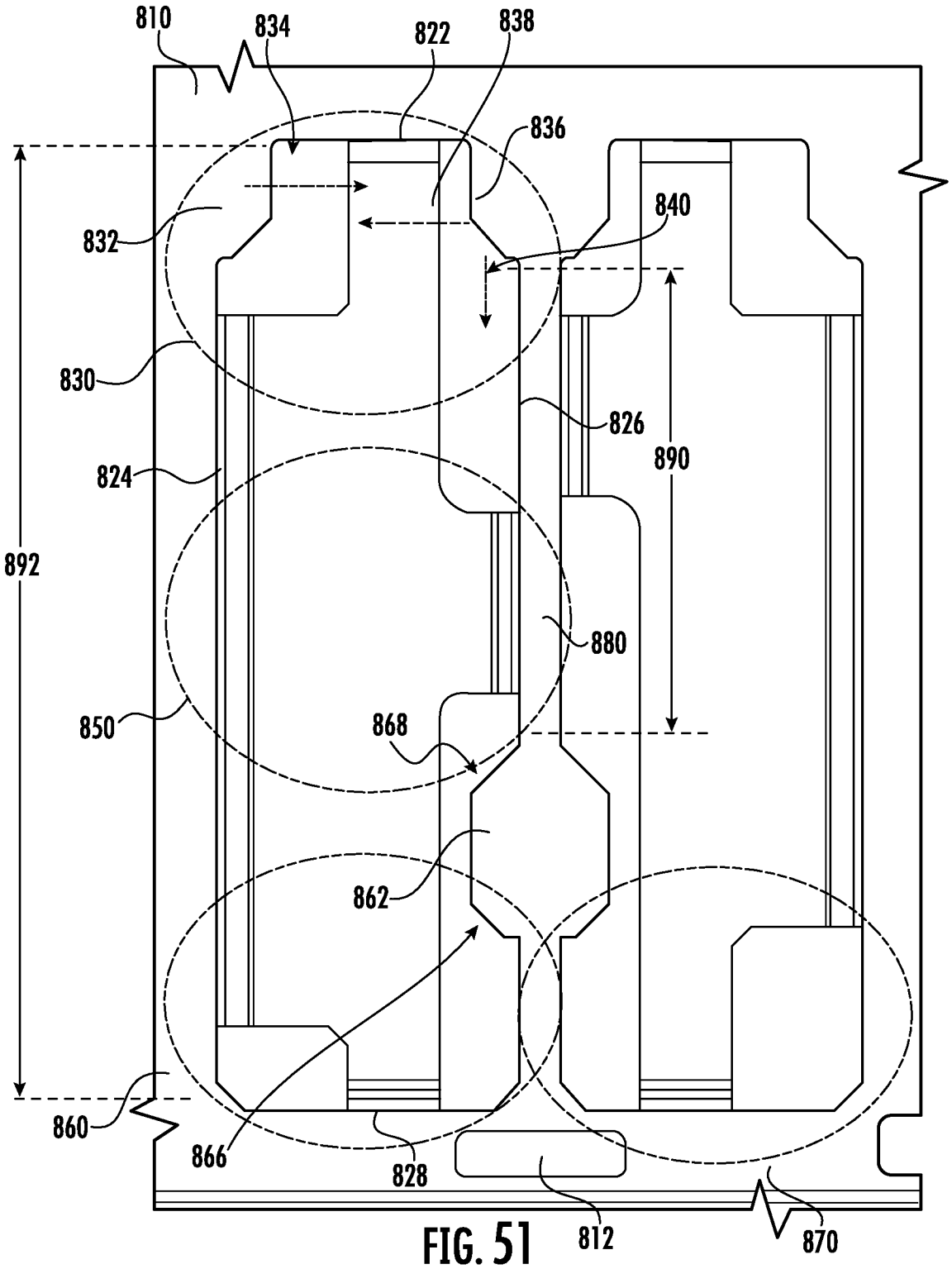

Referring to FIGS. 50-51, a shelf 810 is shown. Similar to shelf 910 (FIG. 44), shelf 810 is configured to be coupled to sidewalls 720, 721. Shelf 810 is similar to shelf 910 (FIG. 44) and except that shelf 810 includes a central wall 880 from which ribs extend towards the sidewalls 824, 826. In particular, in one embodiment shelf 810 is slidably engaged with brace 780 that is coupled to sidewalls 720, 721. In another embodiment shelf 810 is coupled to sidewalls 720, 721 via a fastener that couples shelf 810 to apertures 722 of sidewalls 720, 721.

Shelf 810 includes a coupling structure 820. Coupling structure 820 includes back wall 822, front wall 828 opposite back wall 822, first sidewall 824 extending between back wall 822 and front wall 828, and second sidewall 826 extending between back wall 822 and front wall 828 opposite first sidewall 824.

Shelf 810 and coupling structure 820 include one or more female couplers. In various embodiments, shelf 810 and coupling structure 820 include female coupler 830 and female coupler 860. Ribs of female couplers 830, 860 are the same or similar to ribs 770, 774 of female couplers 760 except as otherwise described.

In a specific embodiment, a support platform or structure (e.g., support structure 710) includes a first female coupler (e.g., female coupler 830) defined by a shelf (e.g., shelf 810). The first female coupler includes a back wall 822, a first sidewall 824, a second sidewall 826 opposite the first sidewall 824, a first rib 832 extending from the first sidewall 824 towards the second sidewall 826, and a second rib 836 extending from the second sidewall 826 towards the first sidewall 824. The first female coupler is configured to slidably engage with a first male coupler (e.g., coupler 1020) of a first utility module (e.g., utility module 1010).

It will be observed that shelf 810 and coupling structure 820 include space 850 large enough to include a third female coupler. However, unlike some utility module (e.g., utility module 1010) engaging platforms with a centrally located female coupler, space 850 does not include ribs that engage tongues of utility module 1010 to facilitate sliding utility module 1010 onto shelf 810 (see transition from FIG. 47 to FIG. 49) in a manner that provides for dense packing and relatively small vertical gap between adjacent shelves in support system 710.

Female coupler 830 includes first rib 832 extending in direction 834 from first sidewall 824 towards second sidewall 826, and second rib 836 extending in direction 838 from second sidewall 826 towards first sidewall 824. Each of first rib 832 and second rib 836 extend in direction 840 from back wall 822. Female coupler 830 is configured to slidably engage with a male coupler (e.g., coupler 1020) of a first utility module (e.g., utility module 1010).

Female coupler 860 includes rib 862 extending from central wall 880 towards first sidewall 824 (e.g., parallel to second direction 838). Female coupler 860 includes first chamfered edge 866 facing away at an angle from central wall 880 and towards front wall 828, and second chamfered edge 868 facing away at an angle from central wall 880 and towards back wall 822.

Female coupler 870 is next to female coupler 860. Female coupler 870 includes rib 872 extending from central wall 880 away from first sidewall 824 (e.g., parallel to first direction 834). Female coupler 870 includes first chamfered edge 876 facing away at an angle from central wall 880 and towards front wall 828, and second chamfered edge 878 facing away at an angle from central wall 880 and towards back wall 822.

Referring to FIGS. 50 and 51, as noted above, to provide the low angle utility module attachment to shelf 810, the coupling arrangement includes a central area that does not include a female coupling structure. Specifically, central wall 880 defines a length 890 that is the length of the central wall 880 located between ribs 836 and 862. The central section of central wall 880 is uninterrupted by any coupling structure and in the specific embodiment shown defines a generally planar wall extending the entire length 890. In this embodiment, length 890 of central wall 880 without a female coupling structure is at least ⅓ of the entire length 892 of shelf 810 between front wall 828 and back wall 822. In a specific embodiment, the rear most third of the shelf includes one or more female couplers, the front most third of the shelf includes one or more female couples and the middle third of the shelf (measured from back wall 822 to front wall 828) includes no female couplers. In a specific embodiment, coupling structure 820 of shelf 810 includes only two female couplers and three ribs. In a specific embodiment, shelf 810 includes four coupling structures 820, each of which include only two female couplers and three ribs.

Shelf 810 includes latch recess 812. Latch recess 812 receives a latch to secure a utility module that is engaged with female couplers 830, 860 (e.g., via male couplers extending from a bottom of the utility module).

In one embodiment shelf 810 is rigidly coupled to sidewalls 720, 721. In another embodiment shelf 810 is slidably coupled to sidewalls 720, 721 via brace 780.

In various embodiments, each of the first rib 832 and the second rib 836 extend along axis 732 from the back wall 822 towards the front wall 828. In various embodiments, first rib 832 extends from the first sidewall 824 towards the second sidewall 826 in a first direction 834 perpendicular to the axis 732 (FIG. 50), and the second rib 836 extends from the second sidewall 826 towards the first sidewall 824 in a second direction 838 opposite the first direction 834 and perpendicular to the axis 732.

In various embodiments, the first female coupler 830 includes a recessed surface 842, and each of the first rib 832 and the second rib 836 extend above and are offset from the recessed surface 842.

Figure 54:
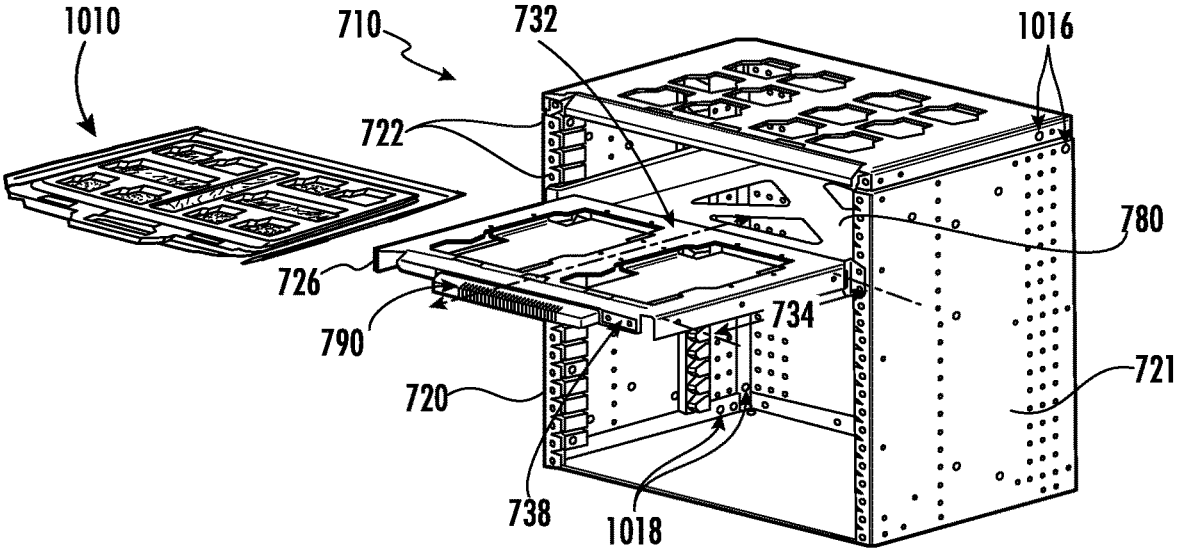

In various embodiments, the first female coupler 830 is defined by a top surface 844 of the first shelf 810, and each of the first rib 832 and the second rib 836 include an upper surface (e.g., upper surface 846 and upper surface 848, respectively) that faces upward and away from the base 730 of support structure 710 (see FIG. 54).

Figure 52:
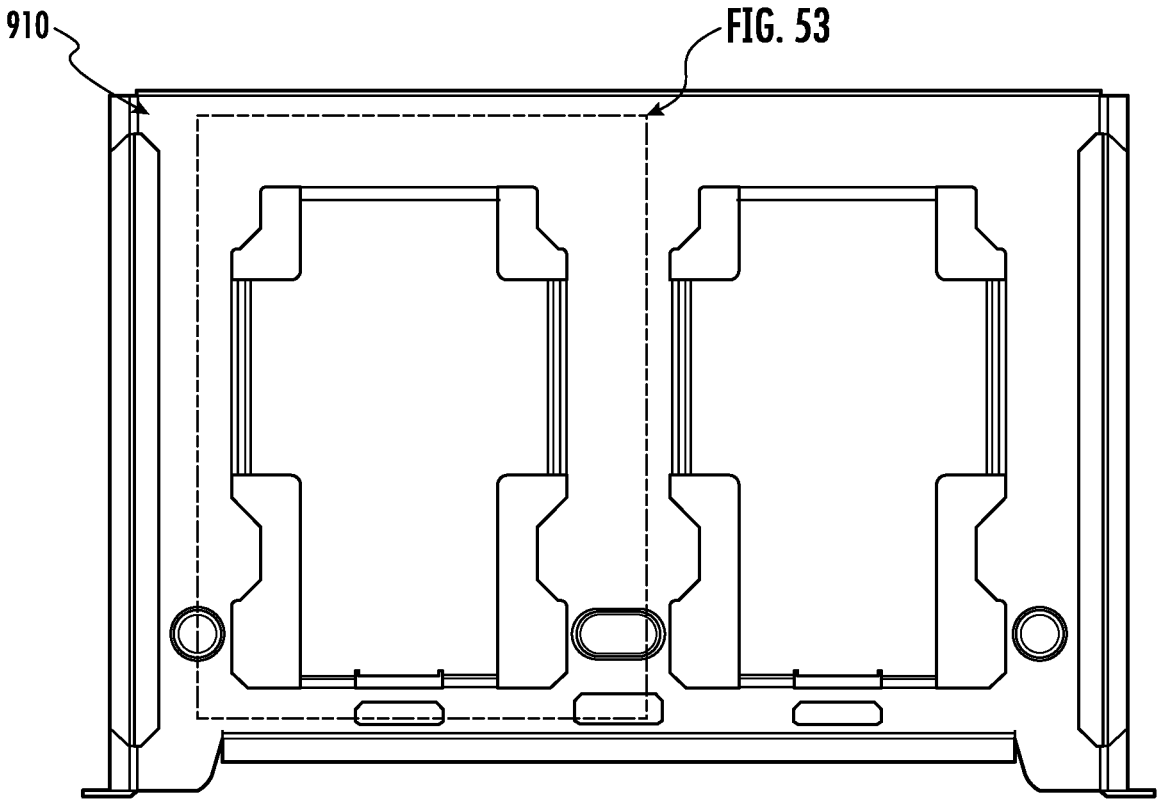
Figure 53:
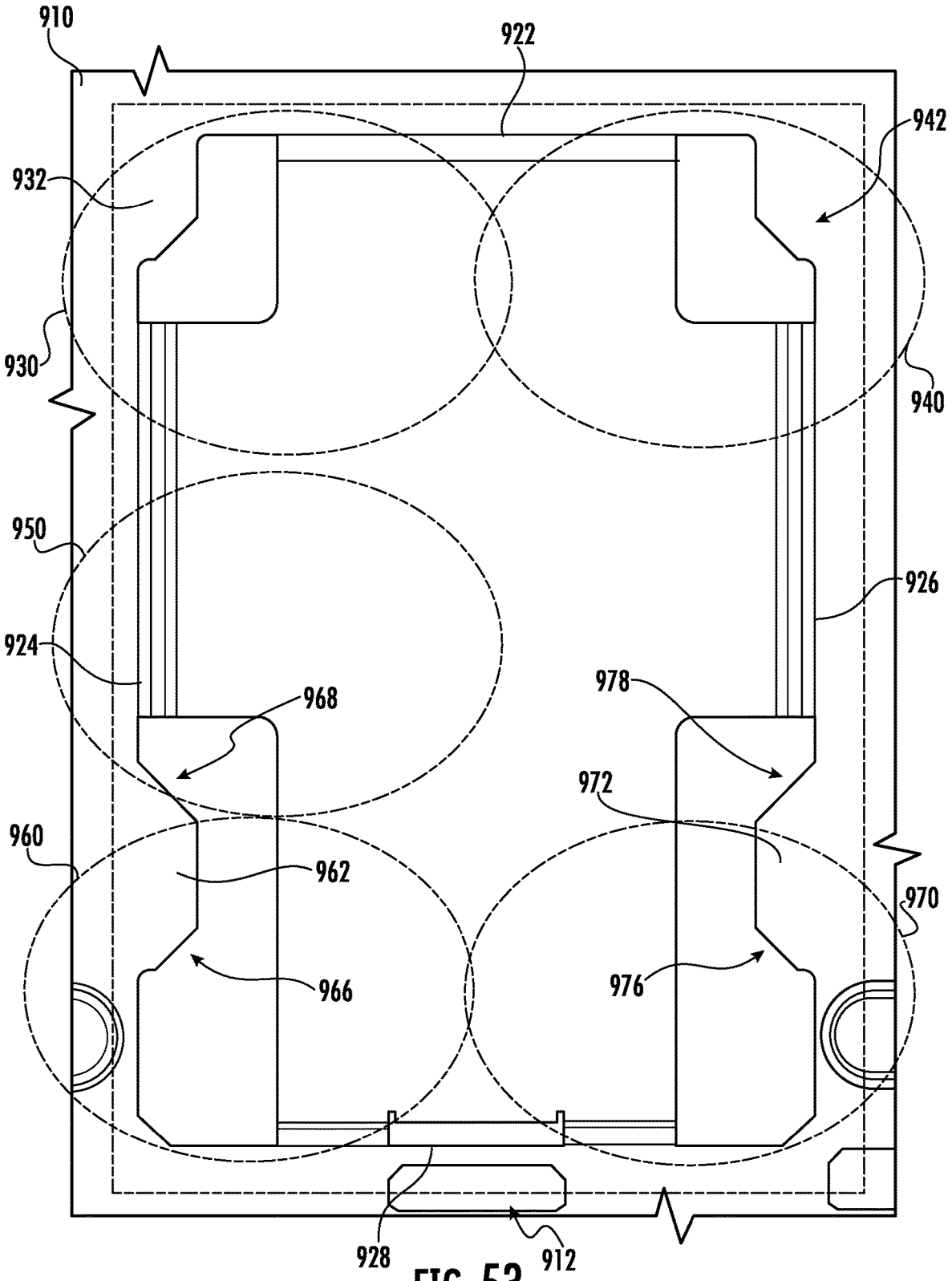

Referring to FIGS. 52-53, various aspects of shelf 910 are shown. Shelf 910 includes a coupling structure 920. Coupling structure 920 includes back wall 922, front wall 928 opposite back wall 922, first sidewall 924 extending between back wall 922 and front wall 928, and second sidewall 926 extending between back wall 922 and front wall 928 opposite first sidewall 924.

Shelf 910 and coupling structure 920 include one or more female couplers. In various embodiments, shelf 910 and coupling structure 920 include female coupler 930, female coupler 940, female coupler 960, and female coupler 970. Ribs of female couplers 930, 940, 960, and 970 are the same or similar to ribs 770, 774 of female couplers 760 except as otherwise described.

It will be observed that shelf 910 and coupling structure 920 include space 950 large enough to include a third female coupler. However, space 950 does not include ribs that engage tongues of utility module 1010 to facilitate sliding utility module 1010 onto shelf 910 (see transition from FIG. 47 to FIG. 49).

Shelf 910 is different than shelf 810 in that shelf 910 includes ribs 962, 972 on the front external walls of coupling structure 920. Thus, shelf 910 may catch tongues of male coupler 1026 of utility module 1010 when utility module 1010 is being inserted onto shelf 910 unless the user vertically supports utility module 1010 high enough so that male coupler 1026 does not engage ribs 962, 972.

Female coupler 930 includes rib 932 extending from first sidewall 924 towards second sidewall 926. Female coupler 940 includes rib 942 extending from first sidewall 924 towards second sidewall 926.

Female coupler 960 includes rib 962 extending from first sidewall 924 towards second sidewall 926. Female coupler 960 includes first chamfered edge 966 facing away at an angle from first sidewall 924 and towards front wall 928, and second chamfered edge 968 facing away at an angle from first sidewall 924 and towards back wall 922.

Female coupler 970 includes rib 972 extending from second sidewall 926 towards first sidewall 924. Female coupler 970 includes first chamfered edge 976 facing away at an angle from second sidewall 926 and towards front wall 928, and second chamfered edge 978 facing away at an angle from second sidewall 926 and towards back wall 922.

Shelf 910 includes latch recess 912. Latch recess 912 receives a latch to secure a utility module that is engaged with female couplers 930, 940, 960, 970 (e.g., via male couplers extending from a bottom of the utility module).

In one embodiment shelf 910 is rigidly coupled to sidewalls 720, 721. In another embodiment shelf 910 is slidably coupled to sidewalls 720, 721 via brace 780.

Figure 55:
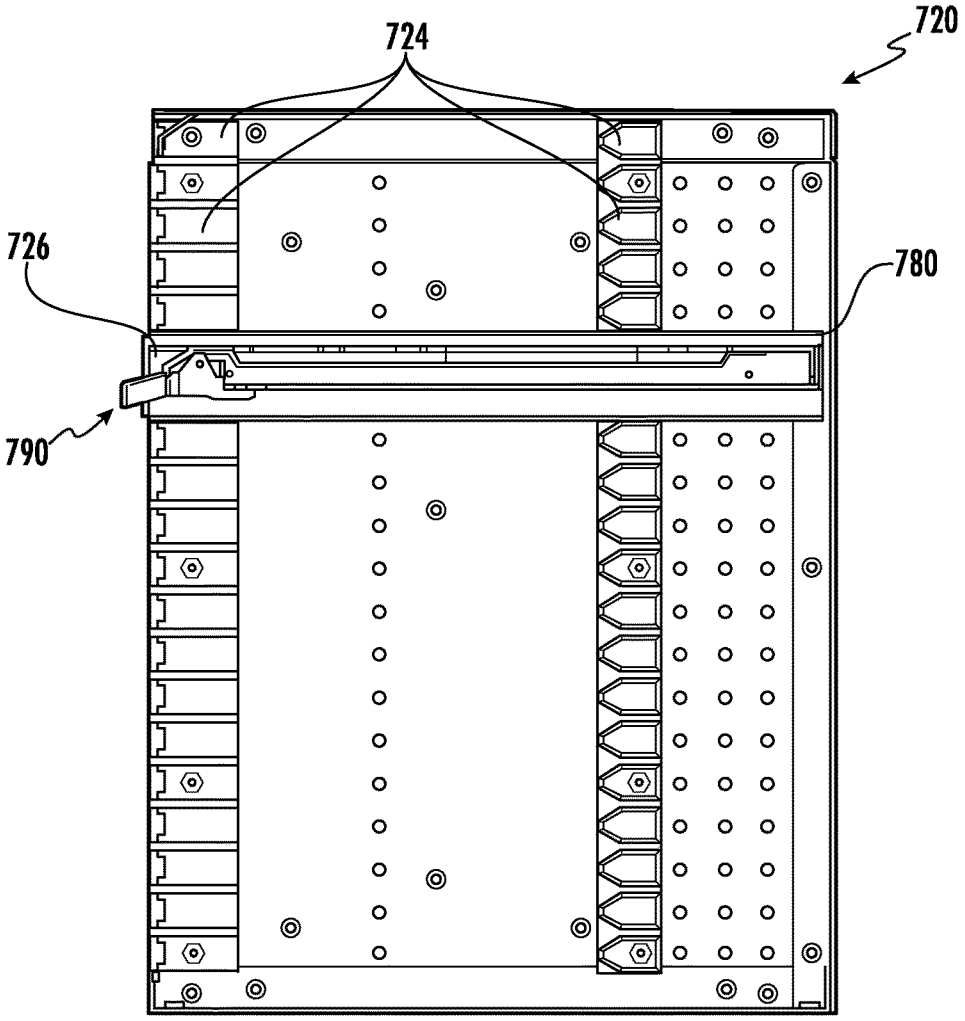

Referring to FIGS. 54-57, various aspects of support structure 710 are shown. Brace 780 is coupled to sidewalls 720 and 721, such as via fasteners (e.g., screws) coupling brace 780 to sidewalls 720, 721. First shelf 726 is slidably engaged with brace 780. Referring to FIG. 55, brace 780 is first slidably engaged with sidewalls 720, 721 via sliding between railings 724. Then, a fastener (e.g., a screw) is inserted through brace 780 and into apertures 722.

In various embodiments, support structure 710 includes a lateral wall (e.g., rear wall 740), a first wall 720 coupled to the lateral wall, a second wall 721 coupled to the lateral wall opposite the first wall 720, and a storage area 712 collectively defined by the first wall 720, the second wall 721, and the lateral wall (e.g., rear wall 740).

In various embodiments, the walls (e.g., rear wall 740, first wall 720, and second wall 721) are coupled together via a fastener, shown as bolt 1016, and a fastener receiver, shown as pem nut 1018. In various embodiments, the bolt 1016 is a flathead ¾"-20 bolt, and the screw is sized to ½" long to avoid interference with components proximate the walls being coupled (e.g., to avoid interference with shelves). In various embodiments, the fastener receivers are attached to the walls so the user does not need to hold a nut while inserting the fastener (e.g., the bolt).

As shown in FIG. 54, first shelf 726 is the same as shelf 910 shown in FIG. 53. In another embodiment, support structure 710 includes shelf 810 in FIGS. 50-51 that is slidably engaged with brace 780 in place of first shelf 726.

In a specific embodiment, a first utility module (e.g., utility module 1010) slides along axis 732 with respect to first shelf (e.g., shelf 810) to engage the first male coupler 1020 with the first female coupler (e.g., coupler 830 of shelf 810 in FIGS. 50-51), such that a first tongue (e.g., tongue 1040, see FIG. 46) extending from the first male coupler (e.g., coupler 1020) is disposed below one of the first rib 832 and the second rib 836 when the first male coupler (e.g., coupler 102) is engaged with the first female coupler (coupler 830).

Figure 56:
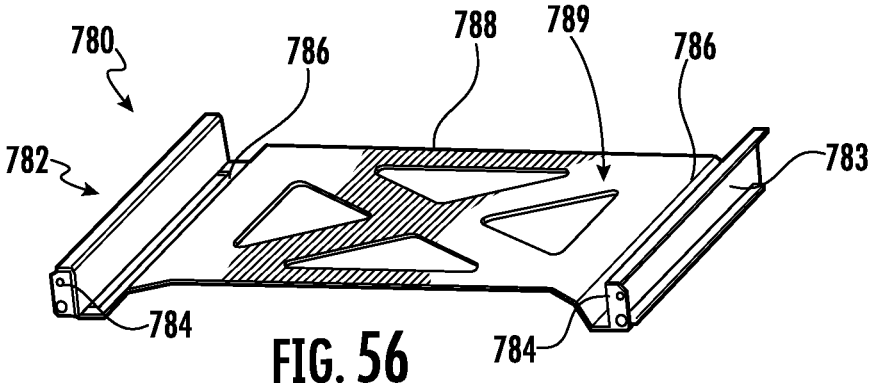

Referring to FIG. 56, brace 780 includes opposing sidewalls 782, 783. Apertures 784 receive a fastener (e.g., a screw) that couples brace 780 to sidewalls 720, 721. In various embodiments, brace 780 includes a third sidewall 782 rigidly coupled to the first wall 720 (of support structure 710), and a fourth sidewall 783 rigidly coupled to the second sidewall 721 (of support structure 710). First shelf 726 slides within recesses 786 on opposing sides of brace 780 proximate sidewalls 782, 783. Bottom wall 788 extends between recesses 786. In various embodiments, first shelf 726 interfaces with recesses 786 and/or bottom wall 788 when sliding into and out of support system 710.

Figure 57:
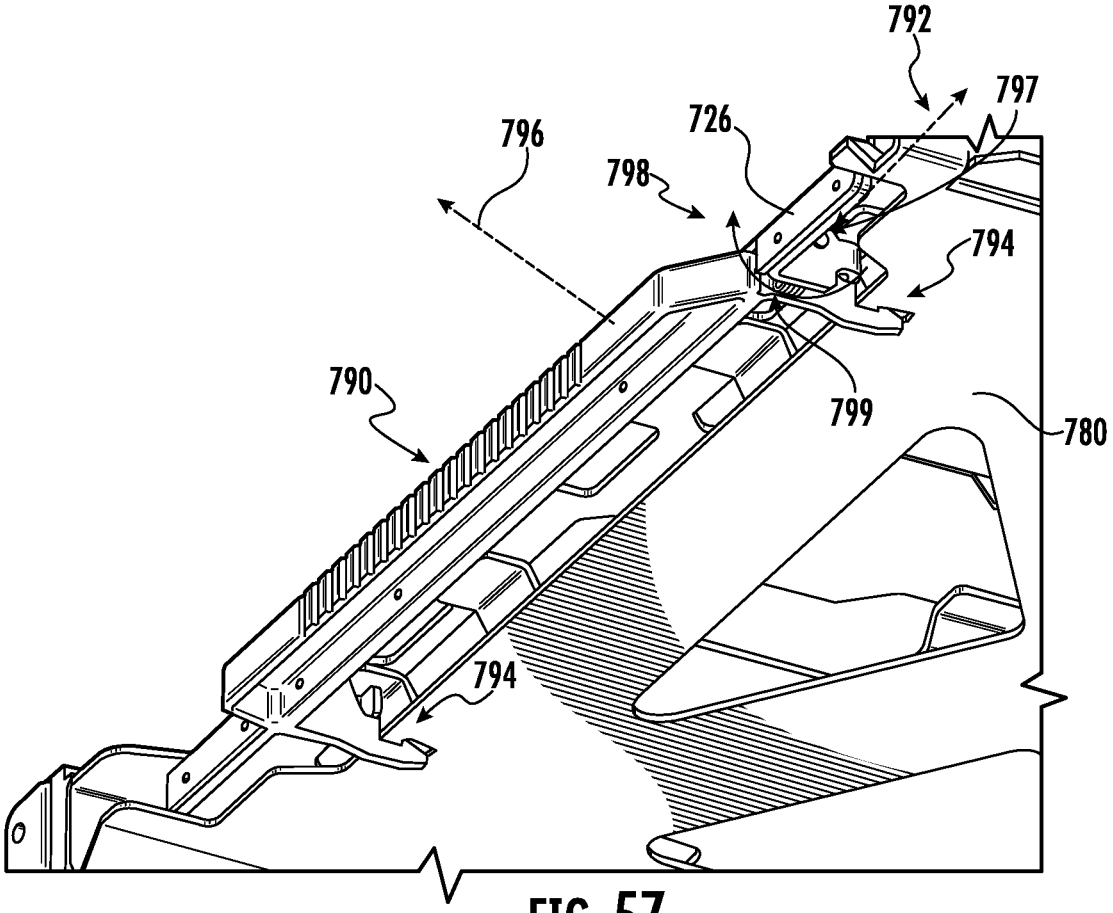

Referring to FIG. 57, various aspects of handle 790 are shown. Handle 790 is coupled, such as pivotally coupled to a shelf (e.g., first shelf 726, shelf 810), such as to a front 738 of a shelf. In various embodiments, handle 790 extends across most of the front of first shelf 726. Handle 790 actuates between a locked position and an unlocked position. When in the locked position, handle 790 couples first shelf 726 to brace 780, such as by hooks 794 engaging with brace 780, thereby biasing first shelf 726 to remain retracted within storage area 712 of support system 710. First shelf 726 is slidable relative to the first wall 720 and the second wall 721 when the handle 790 is in the unlocked position, and first shelf 726 is biased to remain retracted within the storage area 712 when the handle 790 is in the locked position.

In various embodiments, handle 790 is spring biased in the direction opposite direction 798, thereby biasing hooks 794 to engage with brace 780. For example, biasing element, shown as spring 799, interfaces with handle 790 and first shelf 726 (e.g., via fastener, shown as bolt 797, that couples spring 799 to first shelf 726) to bias handle 790 in direction opposite the rotational direction 798. In various embodiments, handle 790 has a minimum protrusion past the front of support structure 710 to reduce a catch point when walking past. In various embodiments, the interface between the shelf 726 and brace 780 includes a detent to resist the shelf 726 detaching from brace 780 when shelf 726 is opened and support structure 710 is positioned on a slanted surface (e.g., a hill).

In various embodiments, the space on first shelf 726 to either side of handle 790 is configured to receive a label (e.g., the space is flat and receives a sticky label).

To actuate handle 790 to the unlocked position, a user pulls on handle 790 in direction 796. Handle 790 then rotates in direction 798 around axis 792 with respect to first shelf 726 and brace 780, thereby disengaging hooks 794 from brace 780. As a result, first shelf 726 is permitted to slide out of storage area 712 of support system 710.

Figure 58A:
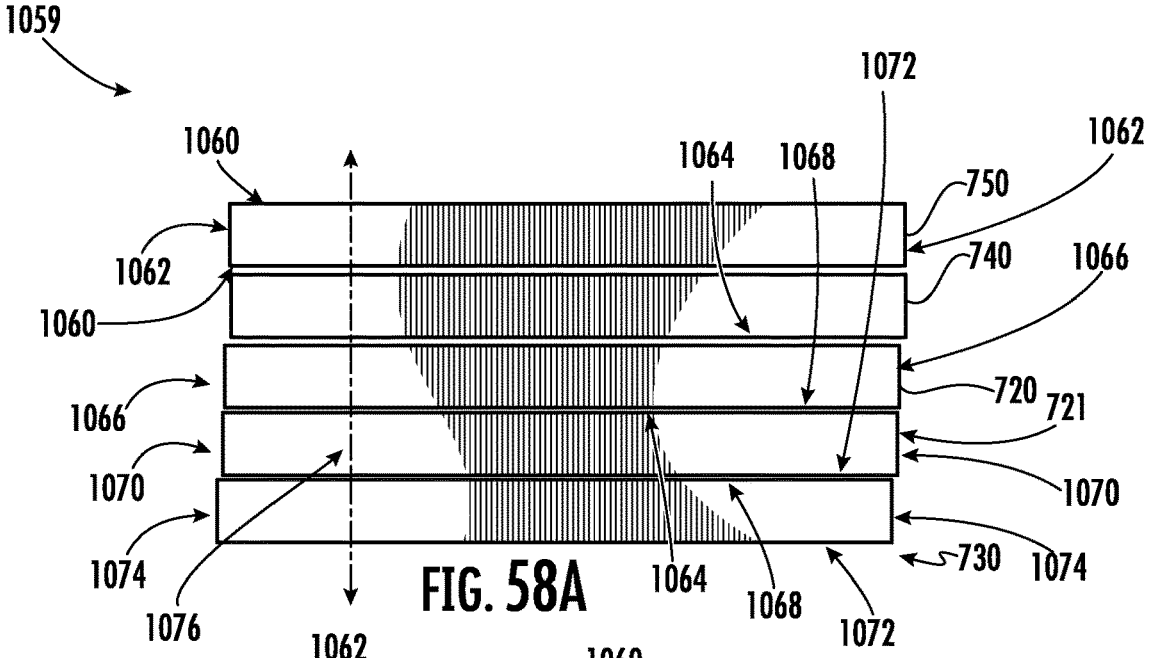
Figure 58B:
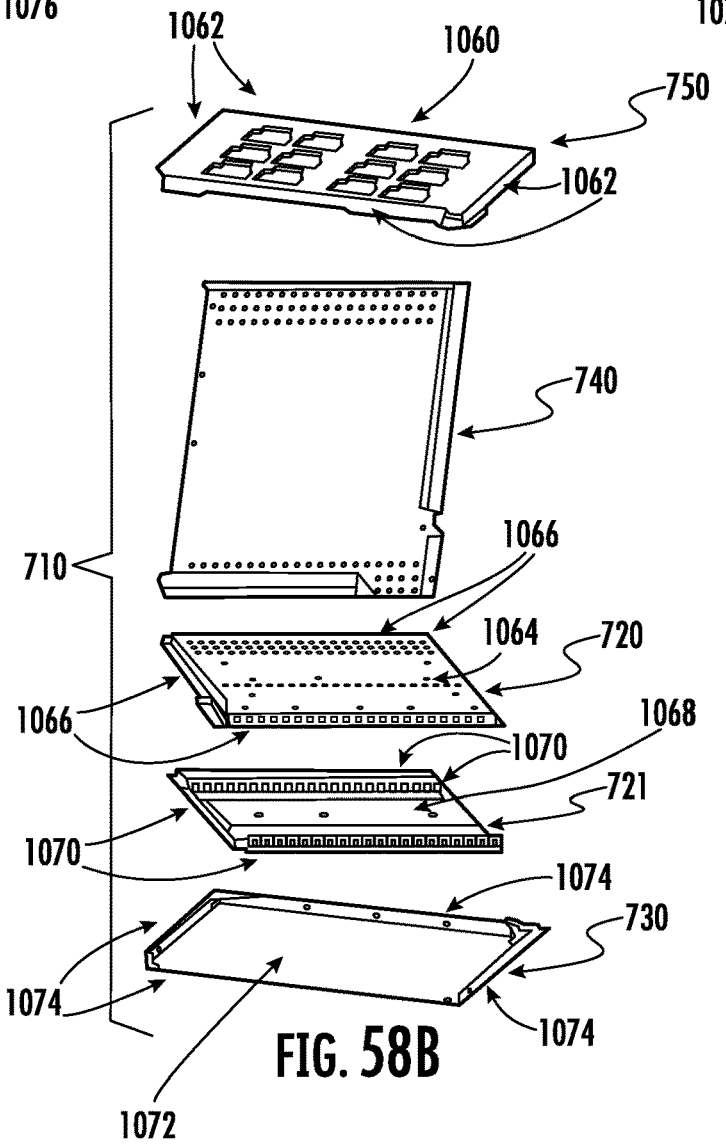
Figure 59:
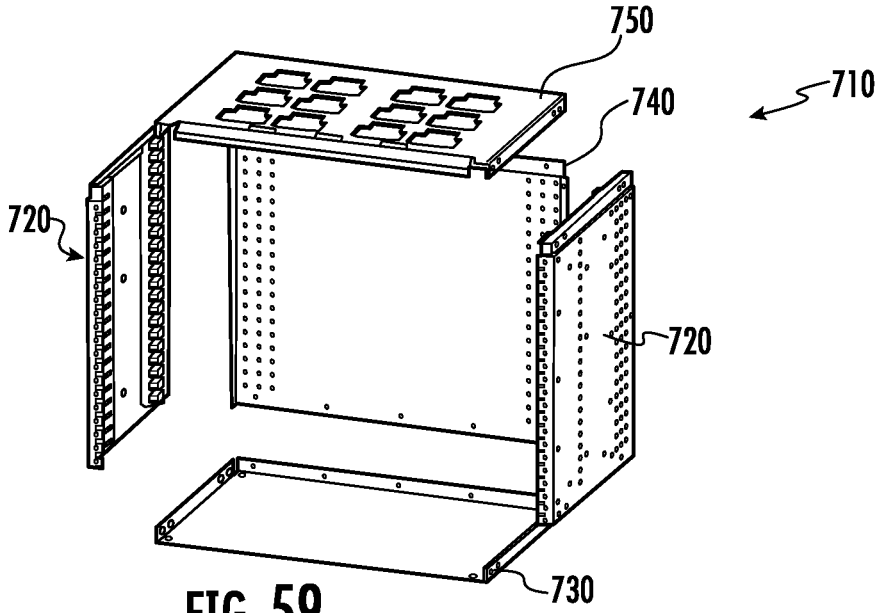

Referring to FIGS. 58A-59, in various embodiments, the components of support structure 710 are structured to provide for low volume (e.g., lay flat stacking) to provide for easy packaging and transport to a user prior to assembly. FIG. 58A depicts a schematic representation of the components of support structure 710 stacked for transportation. In various embodiments, before being assembled the components of support structure 710 can be stacked on top of each other for easier shipping that uses less volume (FIG. 58A). For example, base 730, sidewalls 720 and 721, top panel 750 and rear wall 740 can be stacked on each other. FIG. 58B depicts an intermediate step of assembly as components of support structure 710 are being unpacked and aligned ready for assembly. When a user receives support system 710, then base 730, sidewalls 720 and 721, top panel 750, and rear wall 740 can be coupled to each other in the configuration shown in FIG. 58B.

In a specific embodiment, a stack 1059 of a plurality of components of a support structure (e.g., support structure 710) for coupling to and supporting a utility module (e.g., utility module 1010) for transit are provided. The stack 1059 of the plurality of components includes a base 730, a first wall 720, a second wall 721, and top panel 750. Top panel 750 defines a first female coupler 760 including a back wall 762, a front wall 764 opposite the back wall 762, a first sidewall 766, a second sidewall 768 opposite the first sidewall 766, a first rib 770, and a second rib 774, the first rib 770 extending from the first sidewall 766 towards the second sidewall 768 and from the back wall 762 towards the front wall 764, the second rib 774 extending from the second sidewall 768 towards the first sidewall 766 and from the back wall 762 towards the front wall 764 (see FIG. 45). In various embodiments, first coupler 760 is configured to slidably engage with a first male coupler (e.g., coupler 1020) of a first utility module (e.g., utility module 1010).

In various embodiments, base 730 includes two major side surfaces 1060 and four edge surfaces 1062, the major side surfaces 1060 defining the largest sides of base 730 and edge surfaces 1062 peripherally surrounding major side surfaces 1060. Similarly, first wall 720 includes two major side surfaces 1064 and four edge surfaces 1066, second wall 721 includes two major side surfaces 1068 and four edge surfaces 1070, and top panel 750 includes two major side surfaces 1072 and four edge surfaces 1074.

The base 730, first wall 720, second wall 721, and top panel 750 are stacked on top of one another in an unassembled configuration (FIG. 58A) such that a major side surface 1060, 1064, 1068, 1072 of one of the base 730, the first wall 720, the second wall 721, and the top panel 750 faces a major side surface 1060, 1064, 1068, 1072 of an adjacent one of the base 730, the first wall 720, the second wall 721, and the top panel 750 in the stack 1059. The base 730, the first wall 720, the second wall 721, and the top panel 750 are configured to be coupled together to form an assembled configuration, wherein when the base 730, the first wall 720, the second wall 721, and the top panel 750 are in the assembled configuration (FIG. 54) such that the first wall 720 is coupled to and extending upward from the base 730, the second wall 721 is coupled to and extending upward from the base 730 opposite the first wall 720, and the top panel 750 is coupled to and extends between the first wall 720 and the second wall 721 above the base 730.

When base 730, first wall 720, second wall 721, and top panel 750 are stacked on top of one another in an unassembled configuration (FIG. 58A), the side surfaces 1062, 1066, 10770, 1074 are parallel to each other.

In various embodiments, the base 730 includes two major side surfaces 1060, each of which are facing along an axis 1076, and each of the first wall 720, the second wall 721, and the top panel 750 includes two major side surfaces 1064, 1068, 1072, each of which are facing along the axis 1076 when the base 730, the first wall 720, the second wall 721, and the top panel 750 are stacked on top of one another in an unassembled configuration.

Figure 60:
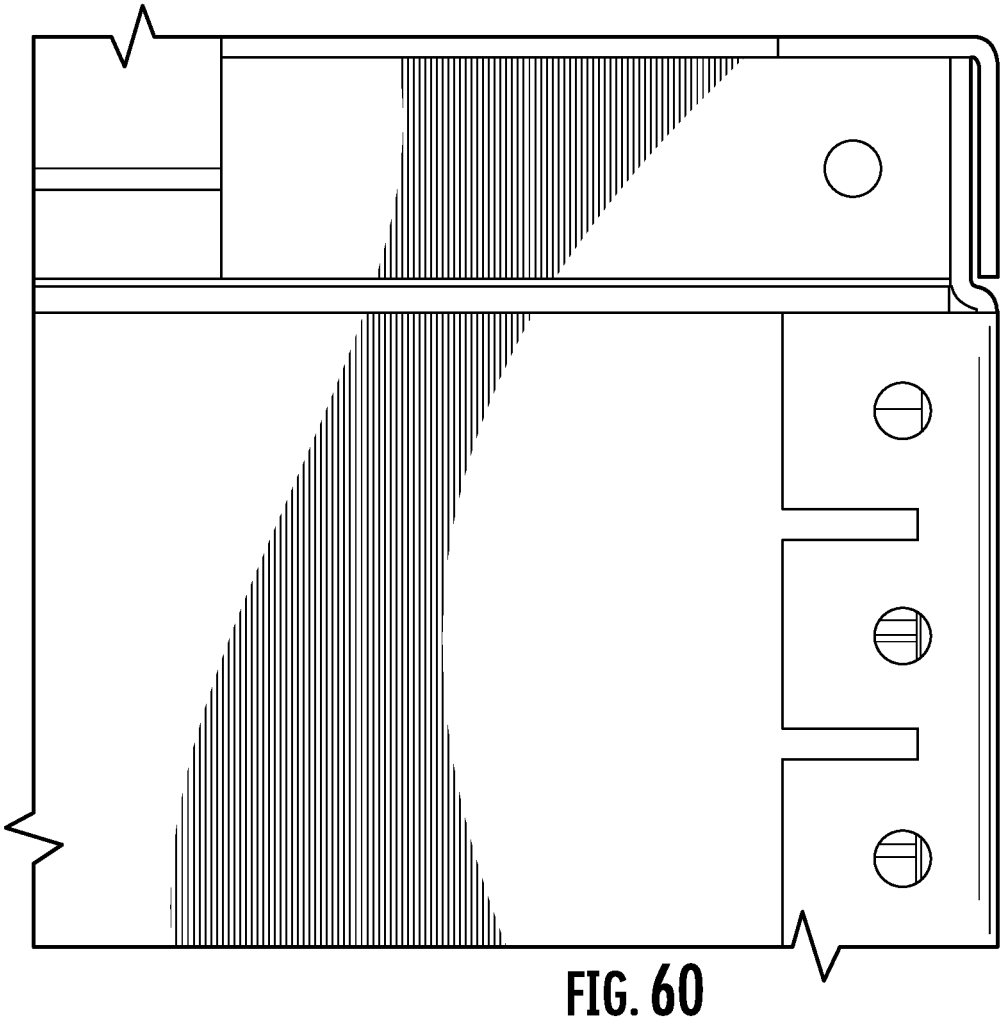
FIGS. 60-105 depict various aspects of support systems, locker systems, and support platforms, according to exemplary embodiments.

In various methods of assembling support system 710, the sidewalls 720, 721 and rear wall 740 are assembled first, then base 730 and top panel 750 are coupled to sidewalls 720, 721 and rear wall 740. Then, shelves and/or braces are optionally added to support system 710. Referring to FIG. 60, in various embodiments panels nest into one another (see circled portion) to help with alignment while support structure 710 is being assembled.

In various embodiments, one or more of support system 710, base 730, sidewalls 720 and 721, top panel 750 and rear wall 740 are made from sheet metal panels. In various embodiments, the holes in support system 710, base 730, sidewalls 720 and 721, top panel 750 and/or rear wall 740 to assembly support structure 710 have permanent nut inserts.

Figure 61:
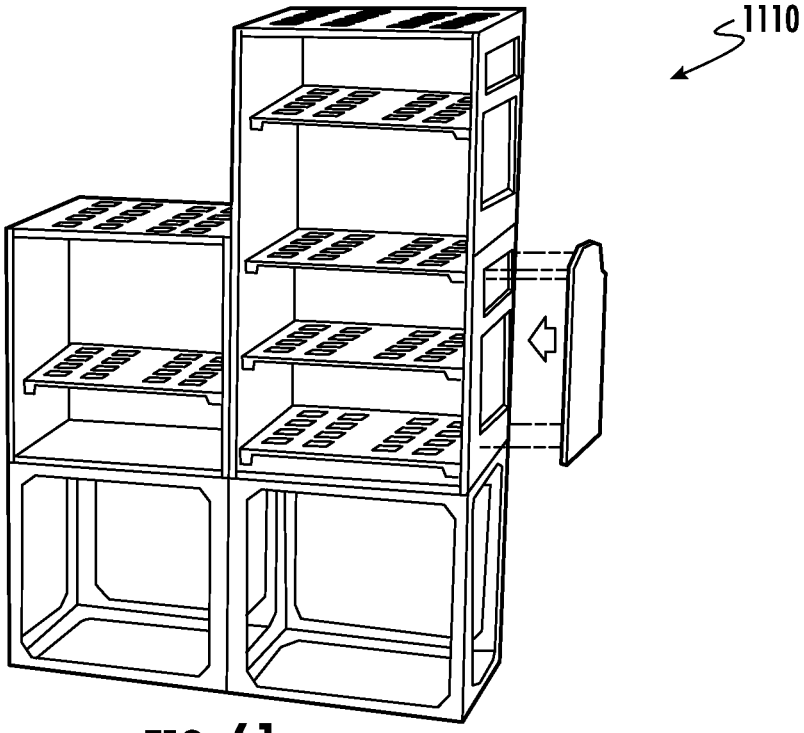
Figure 62:
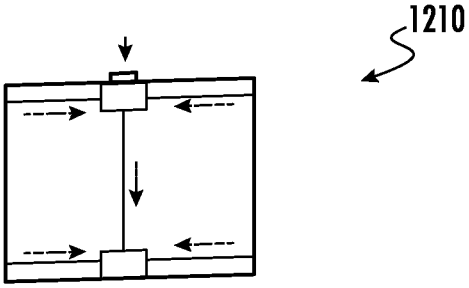
Figure 63:
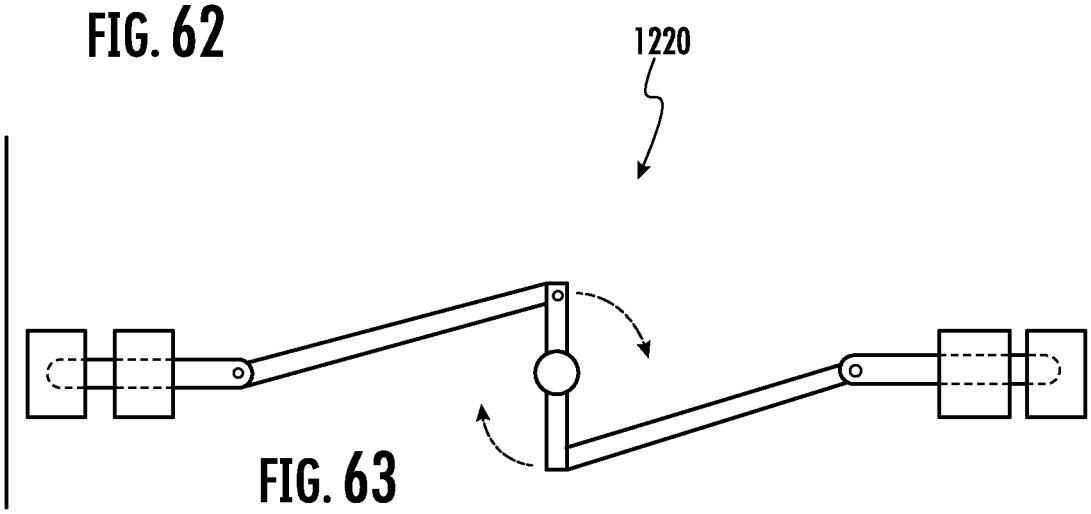
Figure 64:
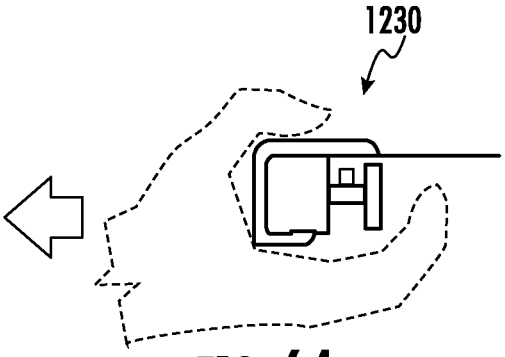
Figure 65:
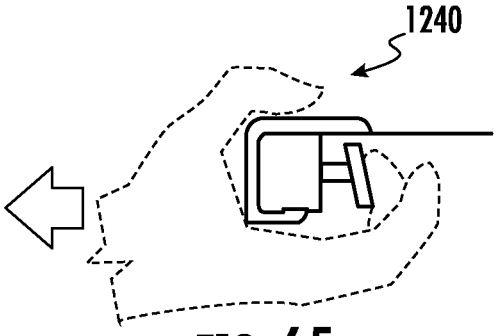
Figure 66:
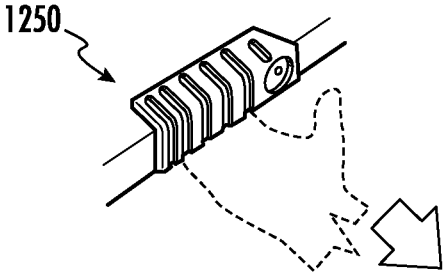
Figure 67:
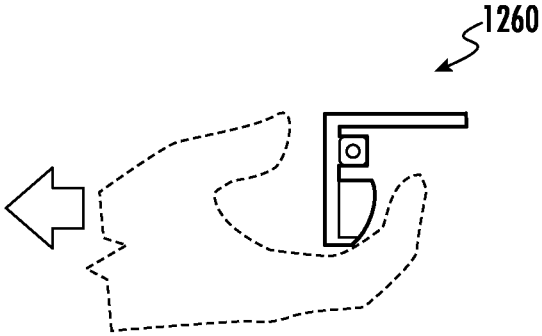
Figure 68:
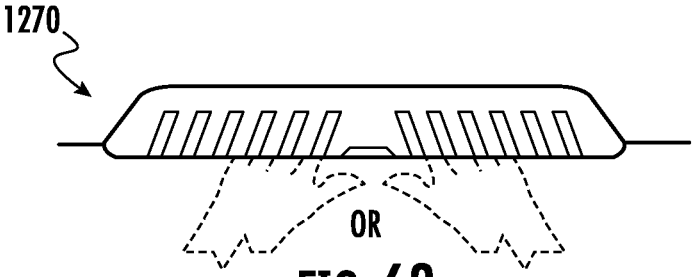

Referring to FIG. 61, various aspects of support system 1110 are shown. In various embodiments, support system 1110 includes one or more support systems 710 coupled to each other. In various embodiments, support system 1110 includes a mounting plate (e.g., a plate on right side attaching to a side of the platform), and the mounting plate is configured to couple to other objects (e.g., the mounting plate includes female couplers to receive male couplers extending from a utility module). In various embodiments, support structure 710 is sized to couple to a mounting plate coupled to the side of support system 710. In various embodiments, support structure 710 is 21 inches tall to accommodate a sufficiently large mounting plate coupled to the side.

In various embodiments, the support platform(s) in support system 1110 include mounting holes on the side panels and/or the rear panels to receive a fastener to mount the respective support platform.

In various embodiments, support system 1110 includes a featureless base (e.g., the two empty areas at the bottom). In various embodiments, the featureless base is configured to receive an object, such as a wheel well on the inside of a van. The featureless base makes reaching boxes more ergonomic compared to a non-featureless base, and/or permits storage of bulky and/or long items in the featureless base.

Referring to FIGS. 62-68, various locker systems for securing shelves (e.g., shelf 726, shelf 810, shelf 910) are shown. For locker system 1210, a push button retracts locking pins, and in various embodiments the locking pins are biased to project outward. For locker system 1220, a rotating action retracts the locking pins. For locker system 1230, a push button behind the handle retracts the locking component. For locker system 1240, a lever behind the handle retracts the locking component. For locker system 1250, a button on the right side in the handle retracts the locking component. For locker system 1260, a button behind the handle retracts the locking component. For locker system 1270, a centrally located button on handle retracts the locking component.

Figure 69:
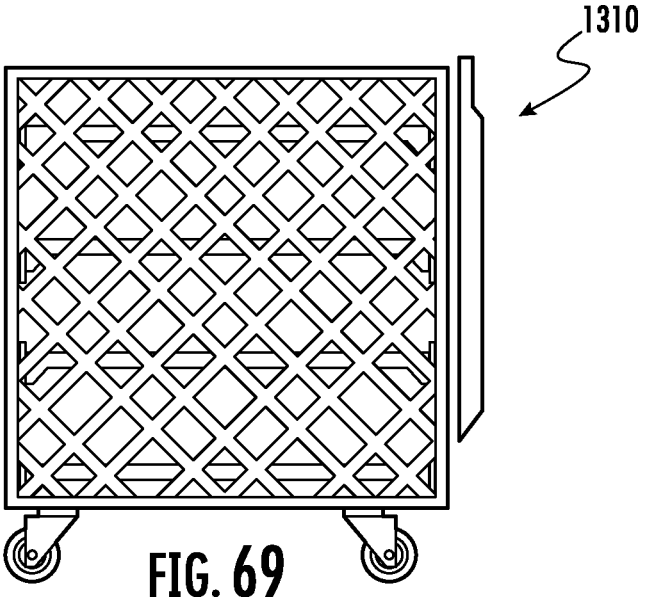

Referring to FIG. 69, various aspects of support platform 1310 are shown. Support platform 1310 is substantially the same as support structure 710 except as otherwise noted. In particular, support platform 1310 includes one or more security components. In various embodiments, support platform 1310 includes lock boxes through existing lock holes (e.g., female couplers) and through the top plate to prevent boxes from coming off shelves, and/or support platform 1310 includes a hinged and/or lockable door (e.g., solid or wire mesh) in front of the module, and/or support platform 1310 includes a thru hole to the module frame near the back to chain the module stack to an object.

Figure 70:
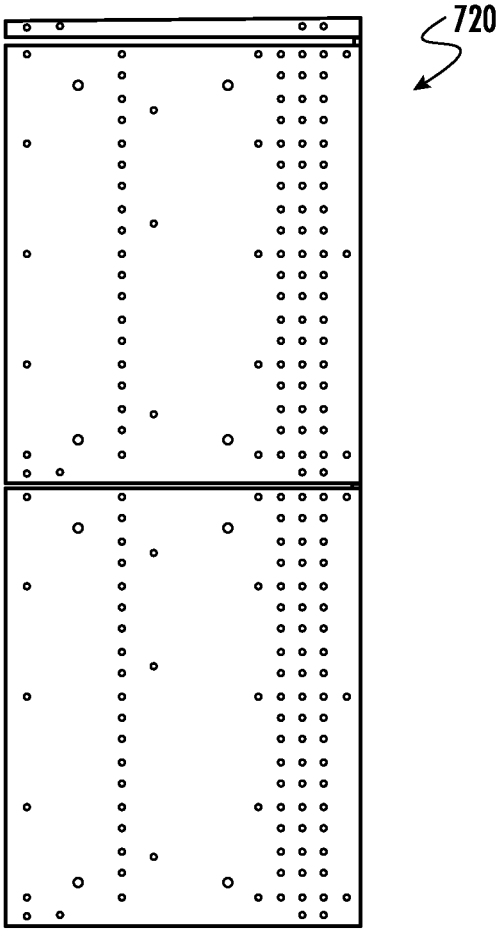

Referring to FIG. 70, various aspects of sidewalls 720, 721 are shown. In various embodiments, sidewalls 720, 721 include preexisting mounting holes with permanent nut inserts to facilitate receiving and coupling to a fastener (e.g., a screw or bolt).

Figure 71:
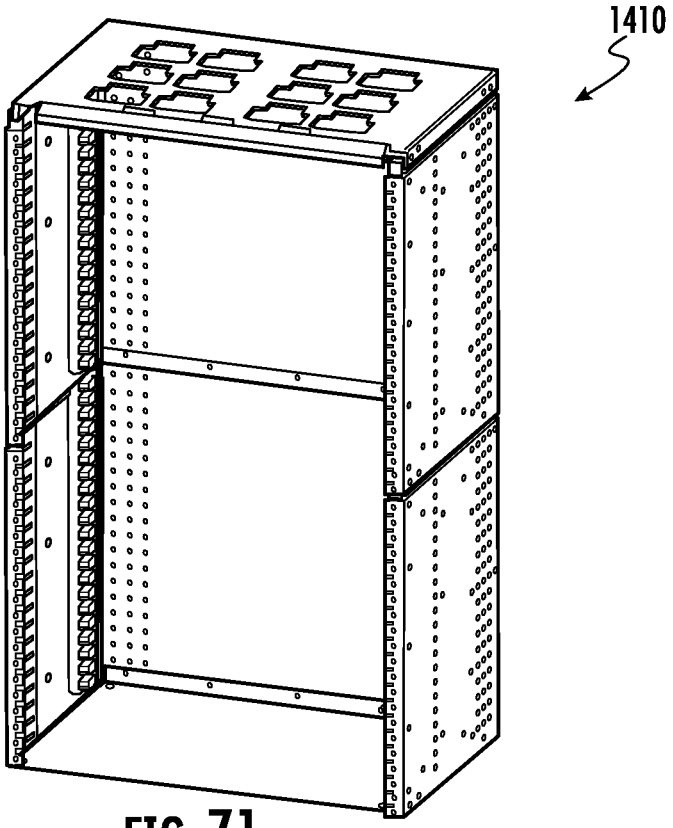

Referring to FIG. 71, various aspects of support platform 1410 are shown. Support platform 1410 includes two pairs of sidewalls 720, 721 stacked on top of each other, and two rear walls 740 stacked on top of each other. Top panel 750 is removed from the lower sidewalls 720, 721 and rear wall 740 and added to the top of support platform 1410. Support platform 1410 receives shelves and/or braces within the storage area, including overlapping the transition between the lower and upper sidewalls 720, 721.

Figure 72:
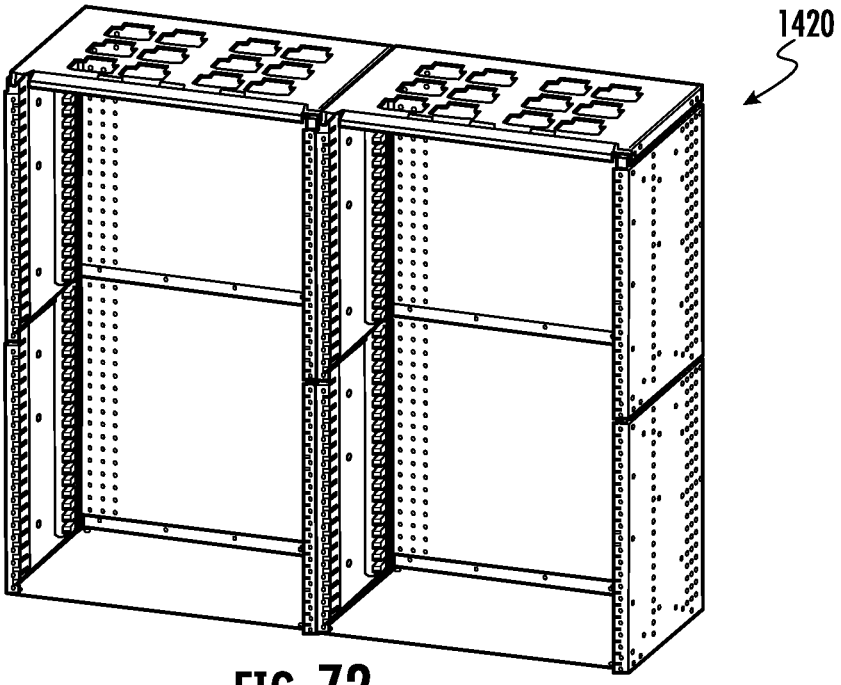

Referring to FIG. 72, support platform 1420 includes multiple support systems 710 stacked vertically and horizontally in a 2×2 configuration.

Figure 73:
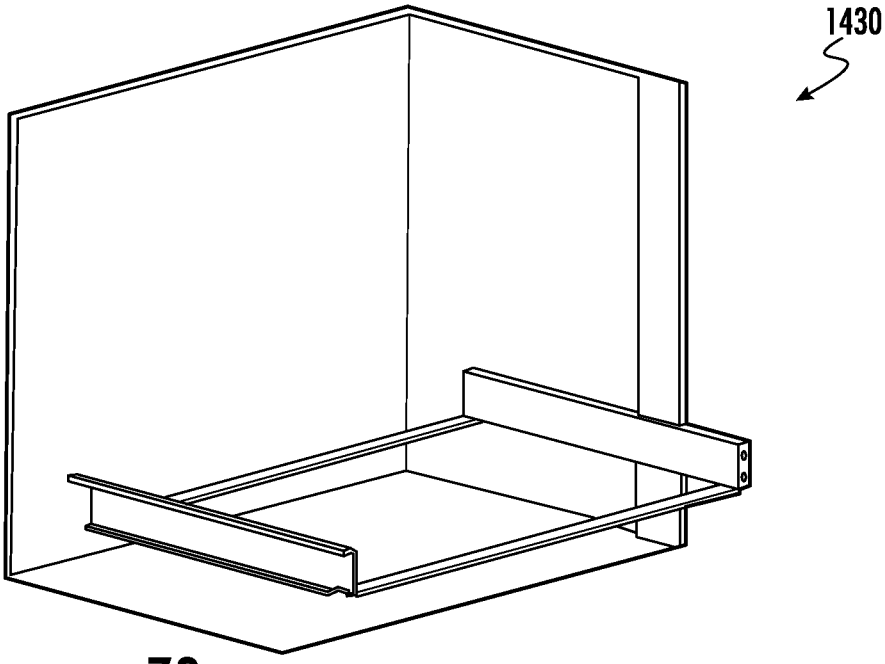

Referring to FIG. 73, support platform 1430 is substantially the same as support structure 710 except as otherwise described. In particular, rather than including railings, support platform 1430 includes folded over metal slots.

Figure 74:
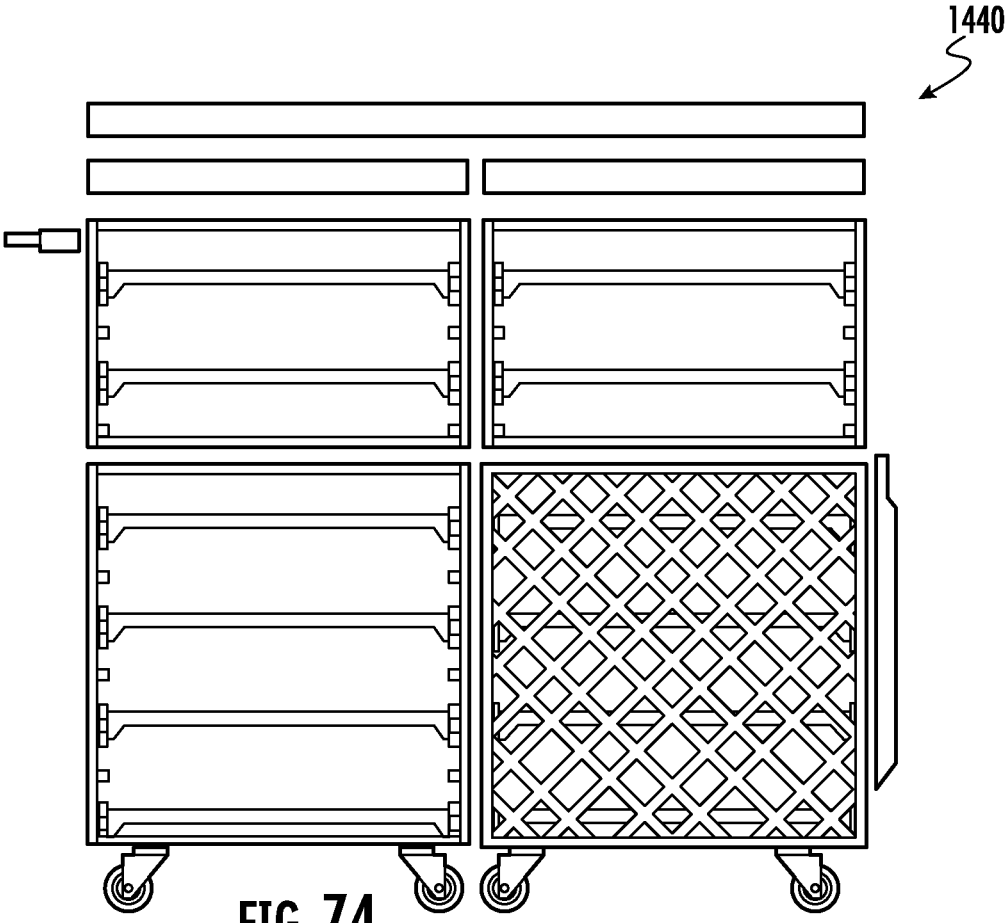

Referring to FIG. 74, support platform 1440 is substantially the same as support structure 710 except as otherwise described. In particular, support platform 1440 includes swivel wheels to facilitate movement, a flat work top that can function as a worktable, and/or a door (see bottom right) that secures objects within support platform 1440. In various embodiments, adjustable feet are coupled to a bottom of support platform 1440 to raise support platform 1440 such that the wheels no longer are touching the floor, thereby making support platform 1440 stationary.

Referring to FIGS. 75-78, various methods of coupling support systems to walls, such as the internal walls of a van, are shown. Support bars 1510, 1512, 1514, 1516 can be coupled to a side of support systems (e.g., support system 710) to an internal wall of a working van.

In various embodiments, one or more damping elements is coupled to the support platform to reduce movement and/or bouncing, and the damping element is formed from a high durometer rubber material. In various embodiments, the damping elements are coupled to the bottom of the support platform and/or the rear of the support platform.

Figure 79:
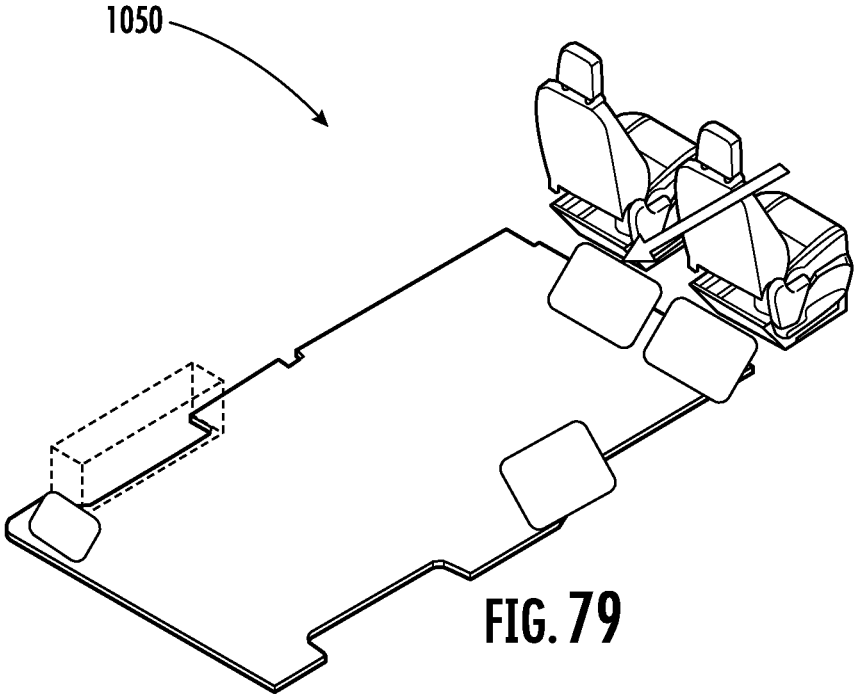

Referring to FIG. 79, various size footprints for support platforms are contemplated herein. For each of the rectangular shapes shown in the storage area of vehicle 1050 (e.g., a van), it is contemplated herein that a support platform (e.g., support structure 710; the support structure shown in FIGS. 80-84) can be placed at that location.

Figure 80:
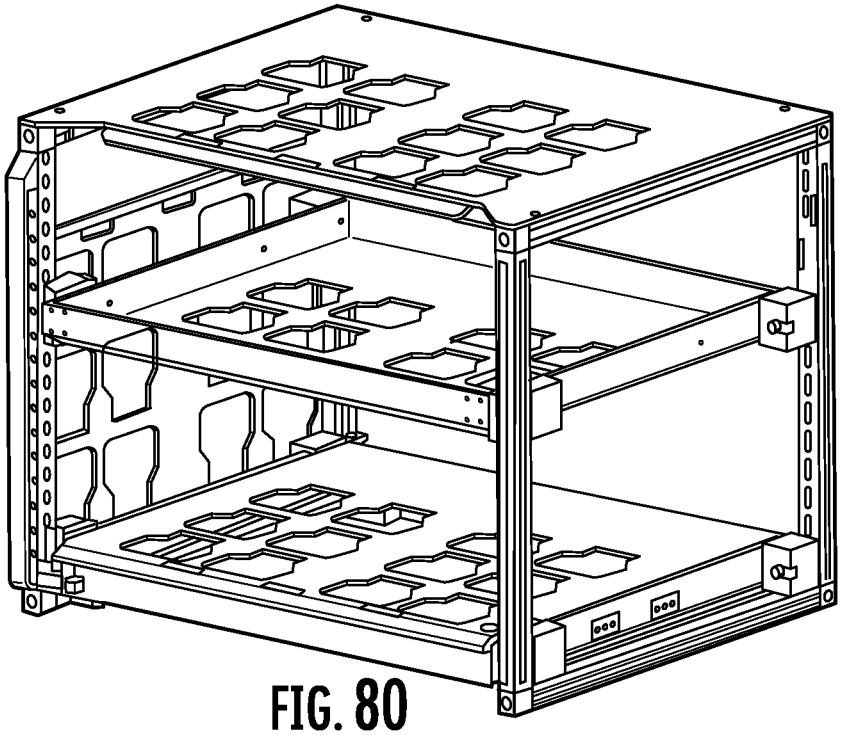

Referring to FIG. 80, in various embodiments the support platform has a 20 inch height, a 25 inch width, and a 20 inch depth. In various embodiments, the support platform flat pack ships as 2 sides and 2 cross beams, and one or more shelves. In various embodiments, one or more shelves are sliding and one or more shelves or not sliding. In various embodiments, one or more shelves include male and female couplers as described herein, and one or more shelves do not include such couplers.

Figure 81:
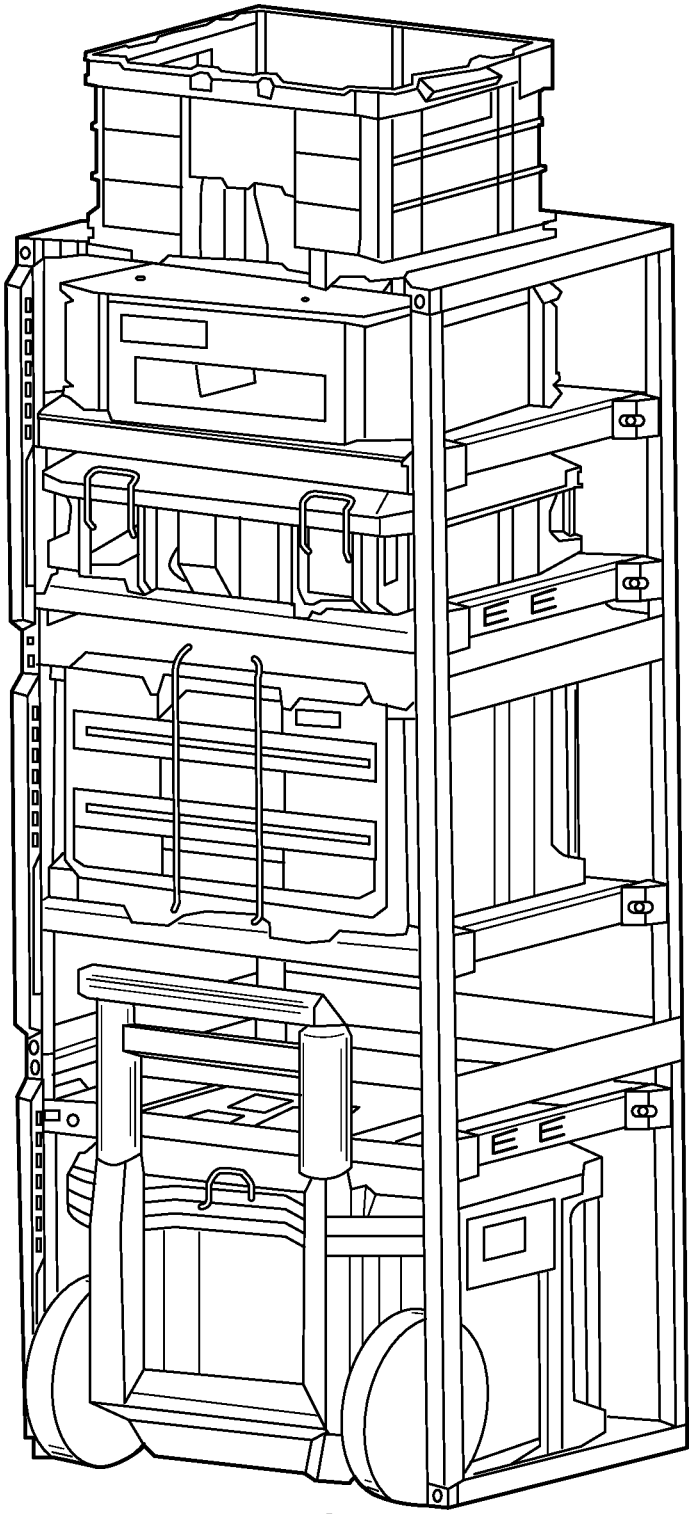

Referring to FIG. 81, in various embodiments the lower zone is configured to receive a rolling storage device, the middle zone is configured to include one or more sliding shelves, and the upper zone is configured to include a non-sliding shelf because the shelves may be too high for a user to see in them without removing the shelf and/or item.

Figure 82:
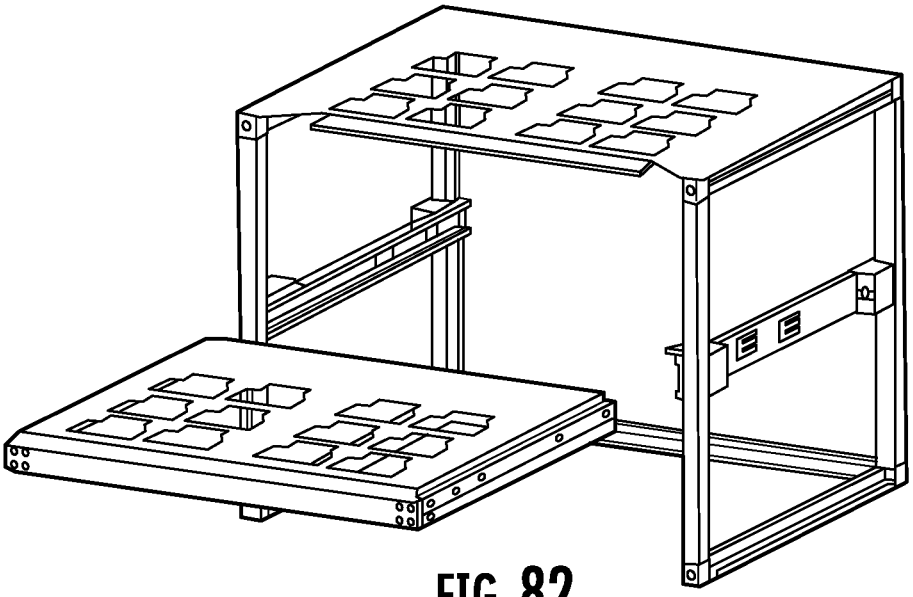

Referring to FIG. 82, in various embodiments sliders are coupled to the frame at a desired height, and then the shelf is coupled (e.g., slidably coupled) to the sliders.

In various embodiments, the support platforms described herein are assembled via bolting back bars to the sides, bolting the top, installing slides at the desired height, installing drawers on the slides, and bolting the support platform to a floor and/or a wall or bulkhead.

Figure 83:
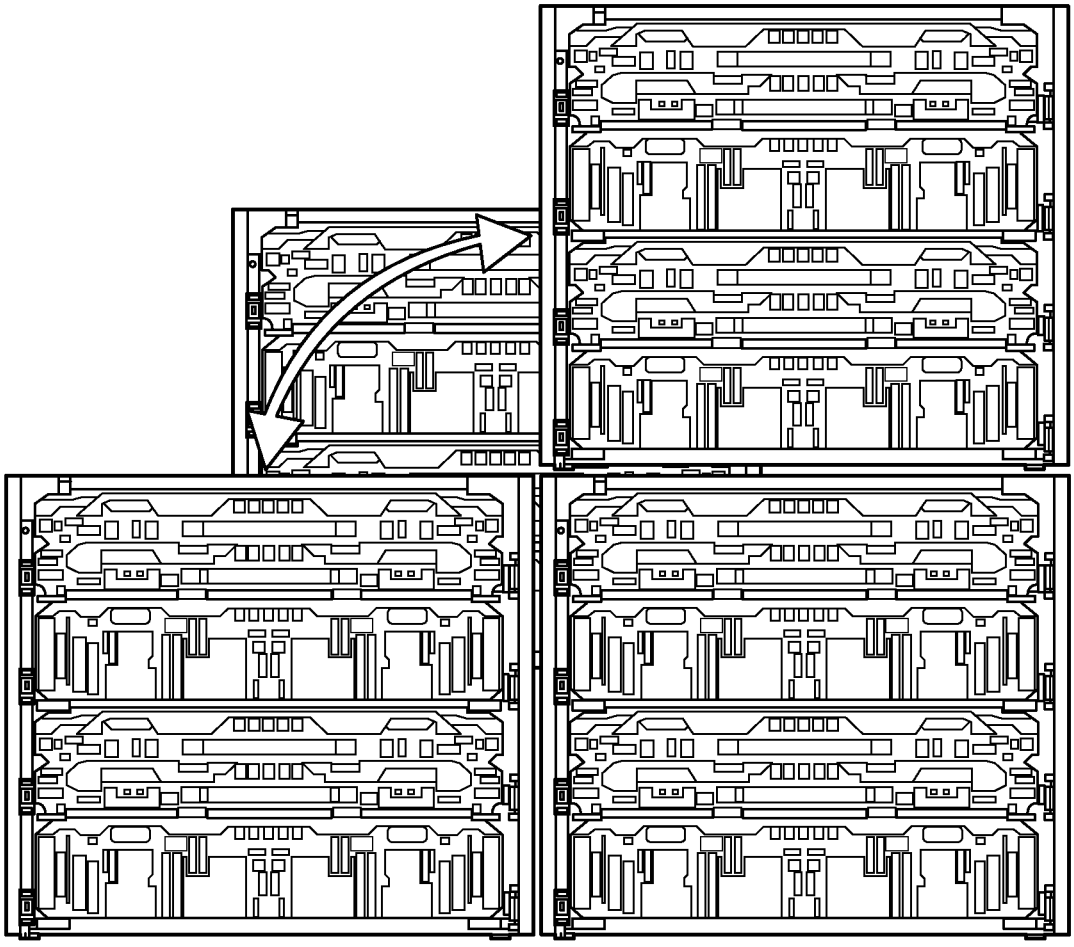

Referring to FIG. 83, in various embodiments the support platforms within a support system stack vertically and/or horizontally. In various embodiments, the support platforms are 19.5" H×22.5" W×18.25" D. In various embodiments, the drawers are at fixed height and are not adjustable (FIG. 83).

Figure 84:
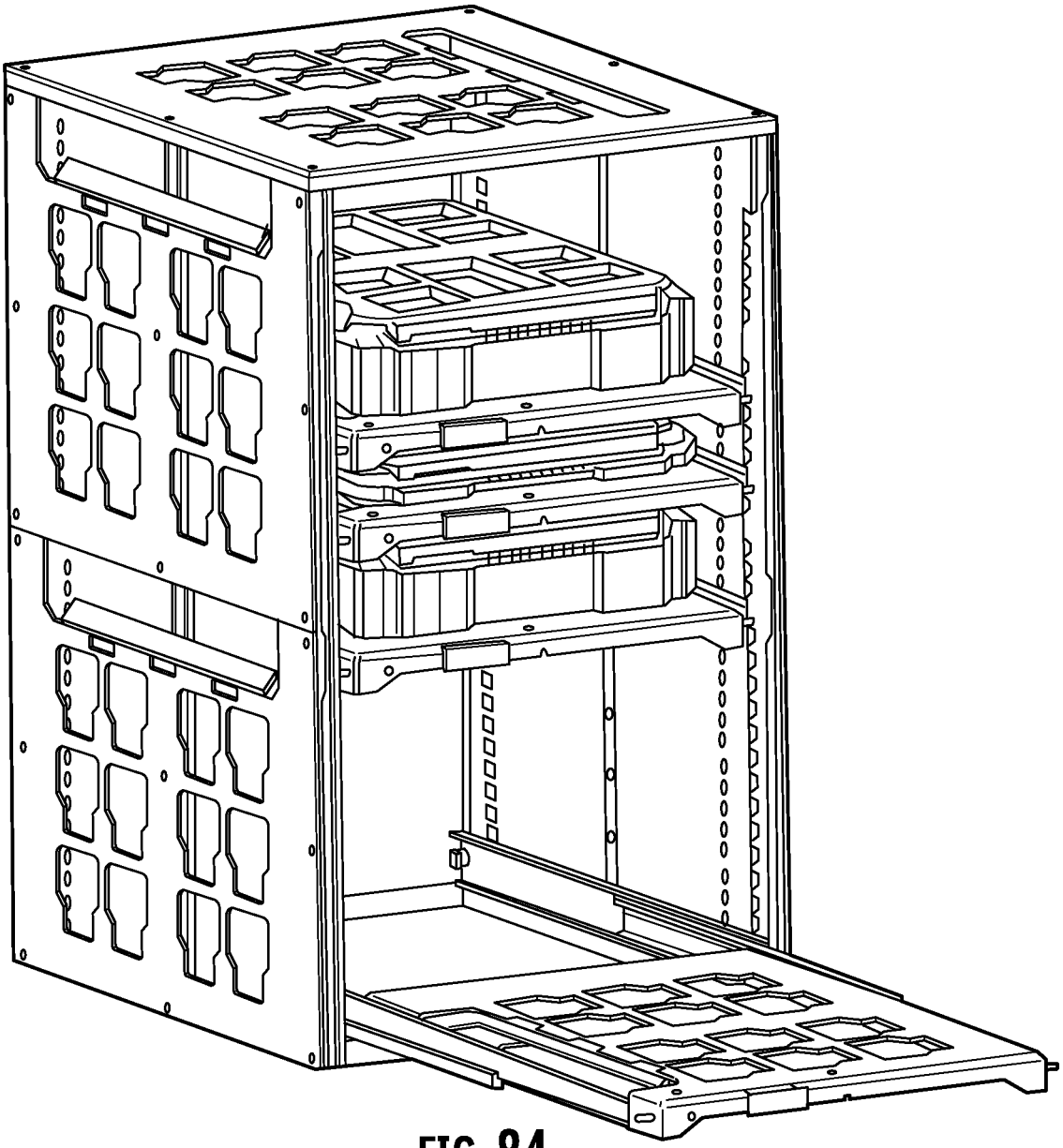

Referring to FIG. 84, in various embodiments a support platform is 36" H×25" W×22" D. In various embodiments, the support platform in FIG. 84 ships as 5 flat panels and 4 shelves plus a hardware pack, the entirety of which is flat packed. In various embodiments, the drawers include female couplers to couple to utility module 1010 and/or a second utility module that is half the width of utility module 1010. In various embodiments, a push button is engaged by the palm of the user to unlock individual drawers. In various embodiments, a lock bar on one or more shelves engages both sides of the drawer. In various embodiments, the side mount is 11 gauge, the upper wall is 11 gauge, and the inner wall is 18 gauge.

Figure 85:
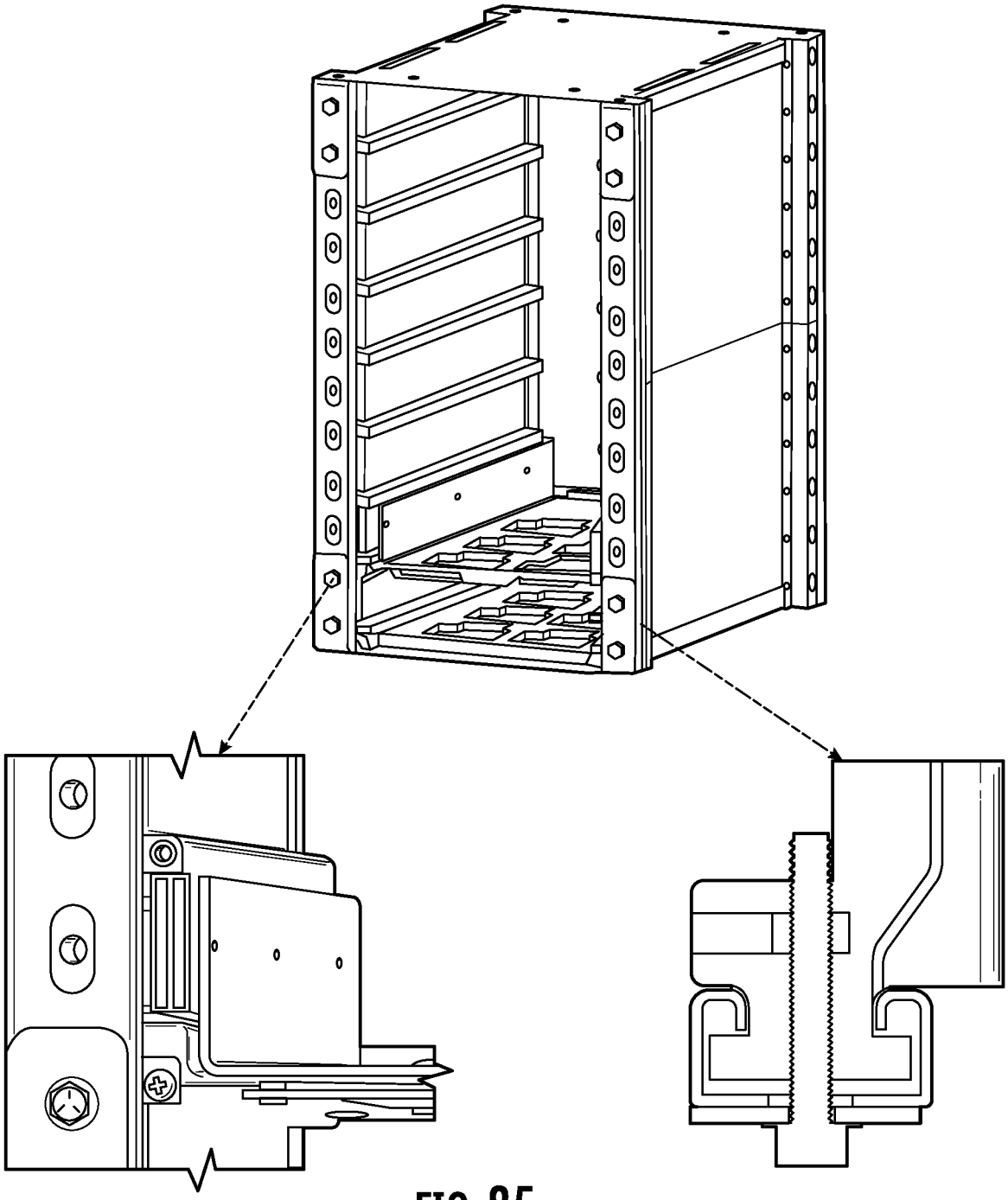

Referring to FIG. 85, various aspects of a support platform are shown. In various embodiments, polymer molded side panes can slide into uni-strut rails to form each sidewall. In various embodiments, each wall assembly gets secured with bolts to the top and bottom cap plates. In various embodiments, shelf modules slid on top of each ridge of the side panel and are constrained under the next ridge. In various embodiments, shelf modules are secured from the front by a fastener (e.g., a Phillips-head screw on each side). In various embodiments, assembly of the utility module in FIG. 85 starts by sliding side panels into Uni-strut to build each wall. Then the walls are placed on the bottom plate and secured with QTY 8 bolts. Then a top plate is placed on top of walls and secured with QTY 8 bolts. Then drawers are slid in at the desired heights and secured with screws.

Figure 86:
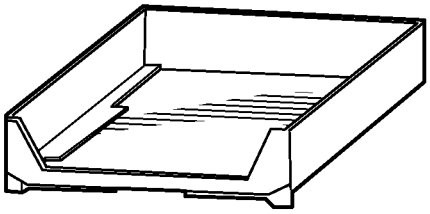
Figure 87:
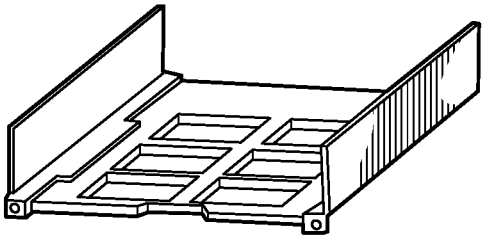
Figure 88:
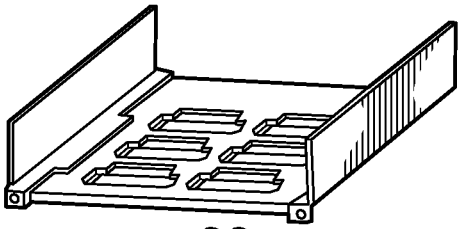
Figure 89:
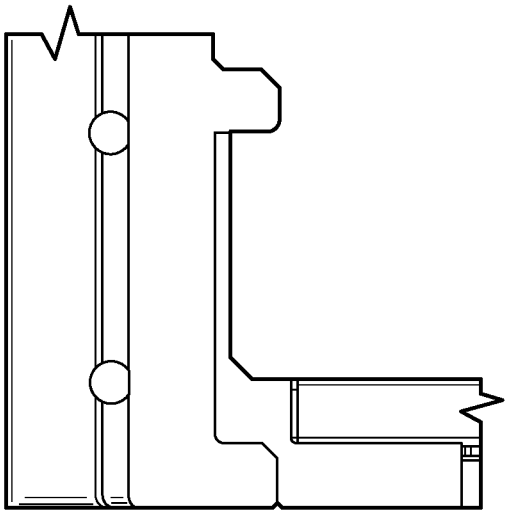
Figure 90:
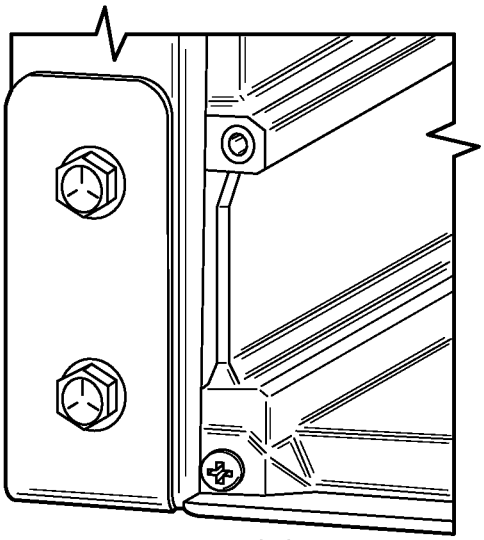

Referring to FIGS. 86-90, various aspects of one or more shelving units are shown. FIG. 87 depicts a base shelf, FIG. 86 depicts the base shelf with a first tray, and FIG. 88 depicts the base shelf with a second tray. Referring to FIG. 89, in various embodiments one or more shelf bases slide on and between ridges. Referring to FIG. 90, the base is secured to the walls via a fastener, such as a screw. In various embodiments the shelf includes one or more female couplers structurally the same or similar to female couplers 760.

Figure 91:
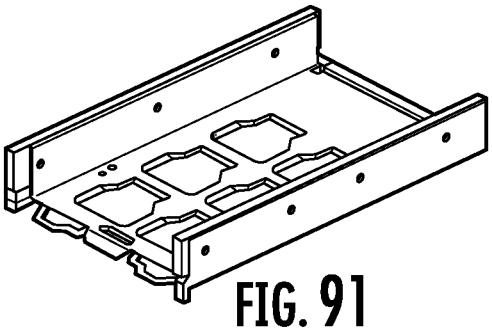
Figure 92:
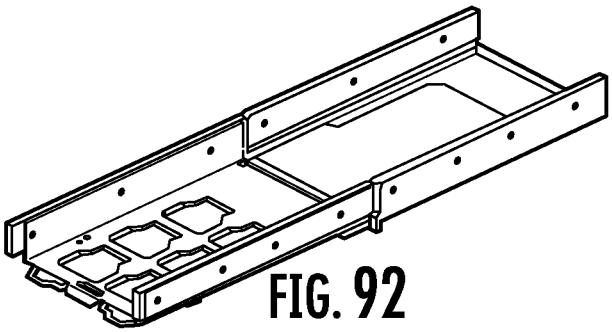
Figure 93:
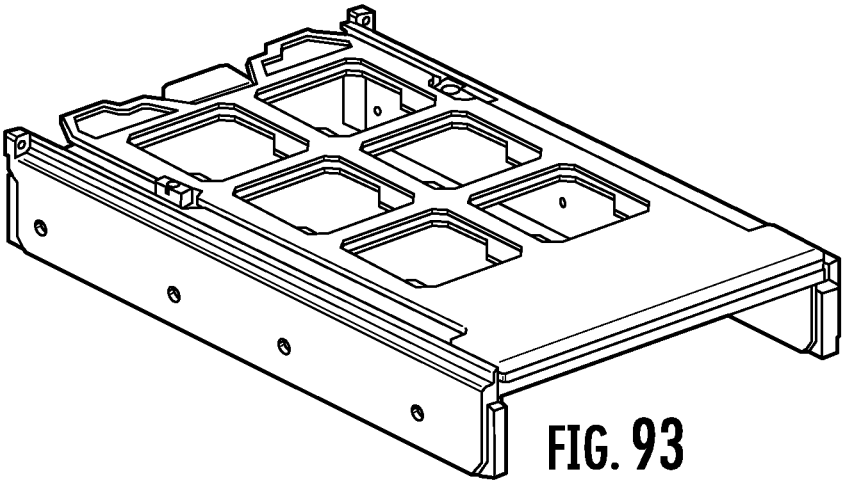
Figure 94:
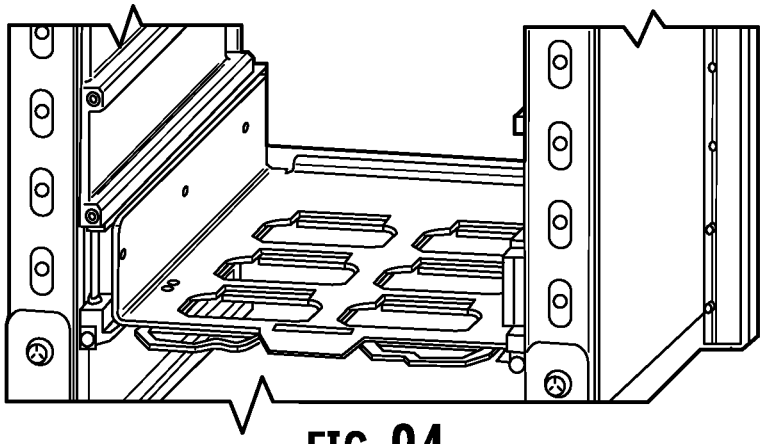

Referring to FIGS. 91-94, various aspects of a shelving unit are shown. FIG. 91 depicts a drawer retracted, and FIG. 92 depicts a drawer extended. In various embodiments, one or more shelves can lock while in the retracted configuration to be secure during movement. In various embodiments, the drawer base slides into the module and is screwed to the side panels. that are functionally and/or structurally the same or similar to female couplers 760.

Figure 95:
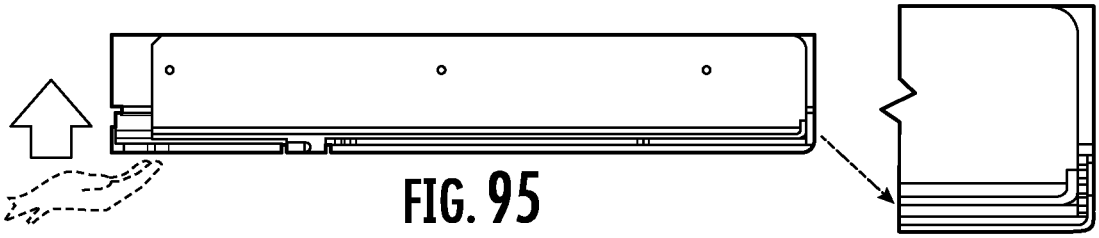
Figure 96:
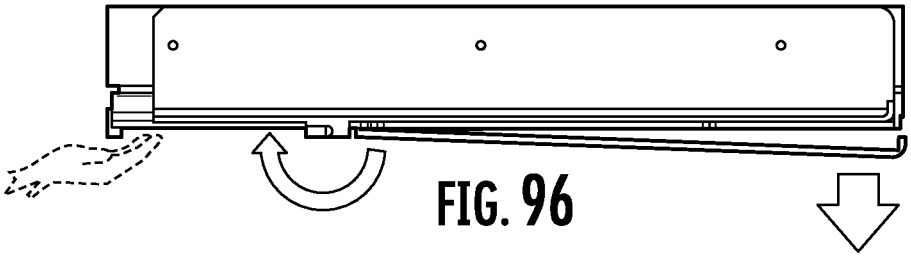
Figure 97:
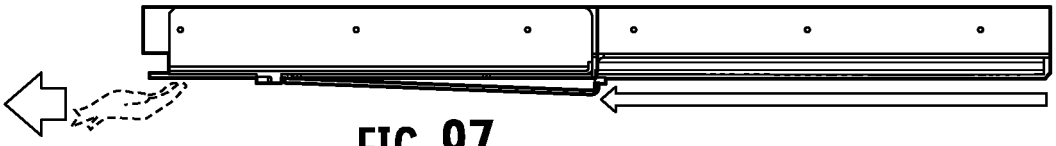
Figure 98:
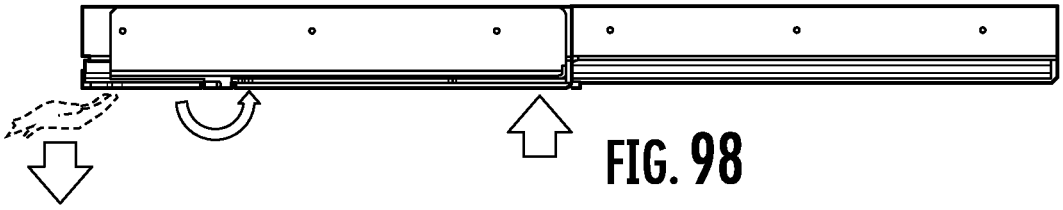
Figure 99:
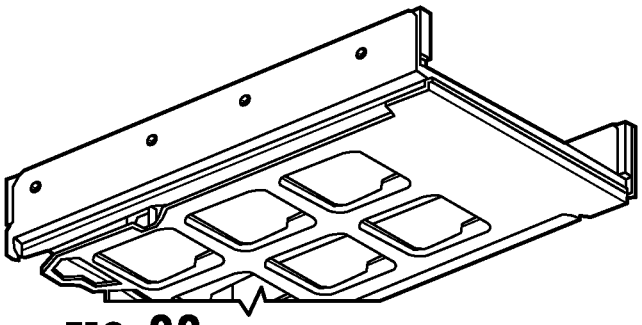
Figure 100:
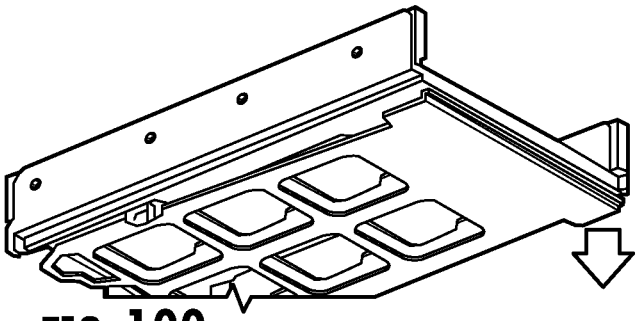
Figure 101:
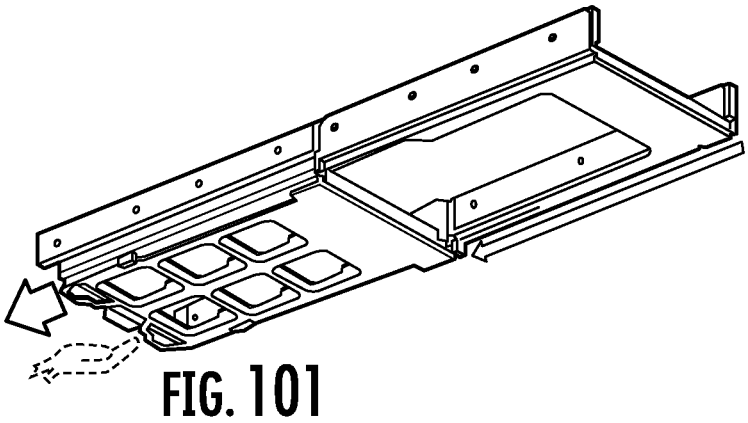
Figure 102:
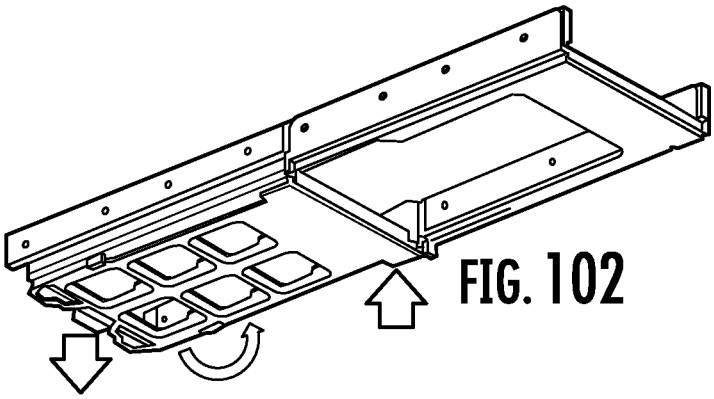

Referring to FIGS. 95-102, various aspects of a drawer shelf are shown. To remove the drawer, the plate is touched upward (FIG. 95 and FIG. 99). This decouples the hook at the end of the plate, thereby permitting the drawer to be extended (FIGS. 96-97 and FIGS. 100-101). Then the user stops biasing the plate, and the hook reengages with the base, thereby locking the drawer in the extended position (FIG. 98 and FIG. 102).

Figure 103:
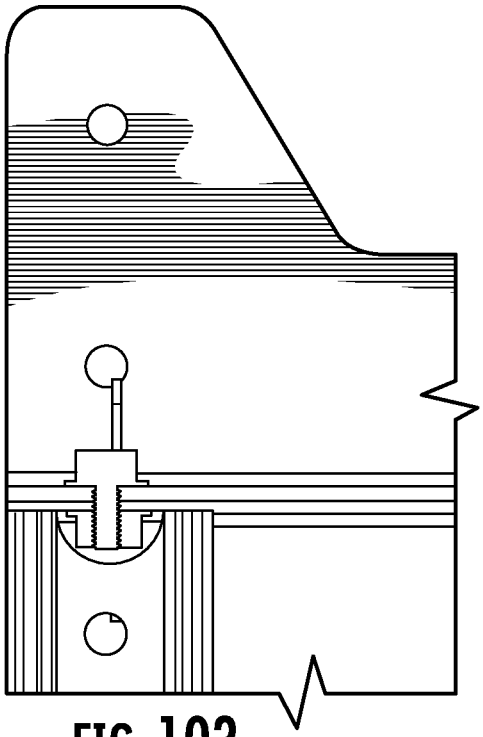

Referring to FIG. 103, taller modules may be built by coupling modules vertically and/or replacing the panels (e.g., sidewalls) with longer panels. Modules can be joined horizontally by using flat brackets across front bolts.

Figure 104:
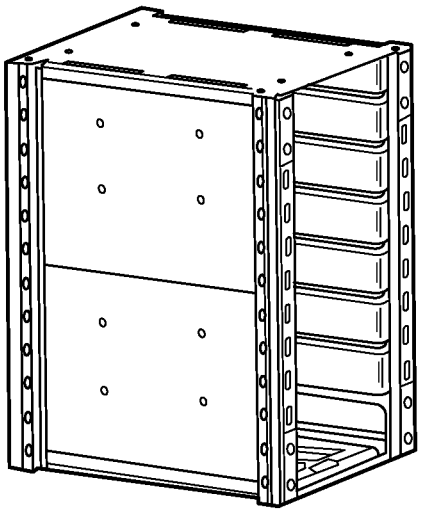
Figure 105:
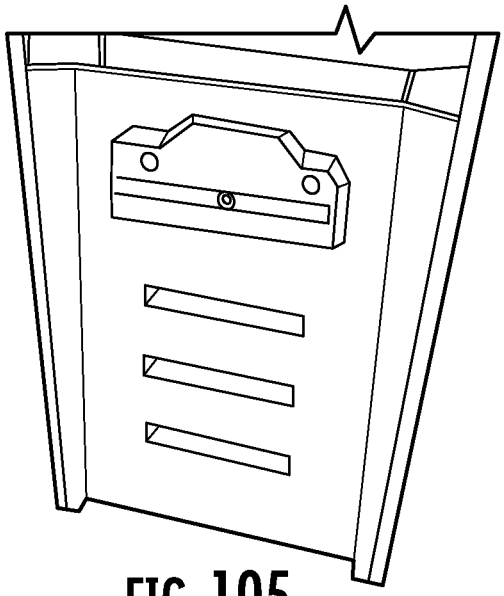

Referring to FIGS. 104-105, various aspects of the side of a support platform are shown. The external surfaces of the sidewalls of the support platform includes apertures, such as threaded inserts, that are configured to couple a wall mount (e.g., see FIG. 105) to the side of the support platform.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature. As used herein, "rigidly coupled" refers to two components being coupled in a manner such that the components move together in a fixed positional relationship when acted upon by a force.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A support structure for coupling to and supporting a utility module for transit, the support structure detachably coupling to one or more male couplers of the utility module, the support structure comprising:

a base;

a first wall coupled to and extending upward from the base, the first wall configured to detachably couple to a support bar, the support bar coupling the first wall to a wall of a vehicle;

a second wall coupled to and extending upward from the base opposite the first wall;

a storage area collectively defined by the first wall, the second wall, and the base;

a first shelf slidably engaged with the first wall and the second wall, the first shelf slidably actuating along an axis between a stowed position and an extended position with respect to the first wall and the second wall, the first shelf defining a length along the axis, wherein, when the first shelf is in the stowed position, greater than 50% of the length of the first shelf is within the storage area, and, when the first shelf is in the extended position, greater than 50% of the length of the first shelf is extended out of the storage area;

a handle coupled to the first shelf, the handle actuating between a locked position and an unlocked position, wherein the first shelf is slidable relative to the first wall and the second wall when the handle is in the unlocked position, and the first shelf is biased to remain retracted within the storage area when the handle is in the locked position; and a first female coupler defined by the first shelf, the first female coupler comprising a back wall, a first sidewall, a second sidewall opposite the first sidewall, a first rib extending from the first sidewall towards the second sidewall, and a second rib extending from the second sidewall towards the first sidewall, the first female coupler configured to slidably engage with a first male coupler of a first utility module.

2. The support structure of claim 1, wherein the first utility module slides along the axis with respect to the first shelf to engage the first male coupler with the first female coupler, wherein a first tongue extending from the first male coupler is disposed below one of the first rib and the second rib when the first male coupler is engaged with the first female coupler.

3. The support structure of claim 1, wherein each of the first rib and the second rib extend along the axis from the back wall towards a front wall opposite the back wall.

4. The support structure of claim 1, wherein the first rib extends from the first sidewall towards the second sidewall in a first direction perpendicular to the axis, and wherein the second rib extends from the second sidewall towards the first sidewall in a second direction opposite the first direction and perpendicular to the axis.

5. The support structure of claim 1, wherein the first female coupler comprises a recessed surface, and wherein each of the first rib and the second rib extend above and are offset from the recessed surface.

6. The support structure of claim 1, wherein the first female coupler is defined by a top surface of the first shelf, and each of the first rib and the second rib comprise an upper surface that faces upward and away from the base.

7. The support structure of claim 1, wherein the handle is pivotally coupled to the first shelf.

8. The support structure of claim 1, wherein the handle is coupled to a front of the first shelf.

9. A support structure for coupling to and supporting a utility module for transit, the support structure detachably coupling to one or more male couplers of the utility module, the support structure comprising:

a base;

a lateral wall coupled to the base;

a first wall coupled to and extending upward from the base, the first wall configured to detachably couple to a support bar, the support bar coupling the first wall to a wall of a vehicle;

a second wall coupled to and extending upward from the base opposite the first wall;

a storage area collectively defined by the base, the first wall, the second wall, and the lateral wall;

a brace coupled to and extending between the first wall and the second wall;

a first shelf slidably engaged with the first wall and the second wall, the first shelf slidably actuating along an axis between a stowed position and an extended position with respect to the first wall and the second wall, the first shelf defining a length along the axis, wherein the first shelf is within the storage area and positioned above the brace when the first shelf is in the stowed position and the first shelf extends out of the storage area when the first shelf is in the extended position, when the first shelf is in the stowed position, greater than 50% of the length of the first shelf is within the storage area, and, when the first shelf is in the extended position, greater than 50% of the length of the first shelf is extended out of the storage area;

a handle coupled to the first shelf, the handle actuating between a locked position and an unlocked position, wherein the first shelf is slidable relative to the first wall and the second wall when the handle is in the unlocked position, and the first shelf is biased to remain retracted within the storage area when the handle is in the locked position; and a first female coupler defined by the first shelf, the first female coupler comprising a back wall, a first sidewall, a second sidewall opposite the first sidewall, a first rib extending from the first sidewall towards the second sidewall, and a second rib extending from the second sidewall towards the first sidewall, the first female coupler configured to slidably engage with a first male coupler of a first utility module.

10. The support structure of claim 9, wherein the brace is rigidly coupled to the first wall and the second wall.

11. The support structure of claim 10, wherein the first shelf at least partially covers a top surface of the brace when the first shelf is in the stowed position, and wherein the first shelf uncovers the top surface of the brace as the first shelf actuates from the stowed position to the extended position.

12. The support structure of claim 9, the brace comprising a third sidewall rigidly coupled to the first wall, and a fourth sidewall rigidly coupled to the second sidewall, the brace comprising recesses that extend on opposing sides of the brace.

13. The support structure of claim 9, wherein the first utility module slides along the axis with respect to the first shelf to engage the first male coupler with the first female coupler, wherein a first tongue extending from the first male coupler is disposed below one of the first rib and the second rib when the first male coupler is engaged with the first female coupler.

14. The support structure of claim 9, wherein each of the first rib and the second rib extend along the axis from the back wall towards a front wall opposite the back wall.

15. The support structure of claim 9, wherein the first rib extends from the first sidewall towards the second sidewall in a first direction perpendicular to the axis, and wherein the second rib extends from the second sidewall towards the first sidewall in a second direction opposite the first direction and perpendicular to the axis.

16. A stack of a plurality of components of a support structure for coupling to and supporting a utility module for transit comprising:

a base;

a first wall;

a second wall; and a top panel, the top panel defining a first female coupler comprising a back wall, a front wall opposite the back wall, a first sidewall, a second sidewall opposite the first sidewall, a first rib, and a second rib, the first rib extending from the first sidewall towards the second sidewall and from the back wall towards the front wall, and the second rib extending from the second sidewall towards the first sidewall and from the back wall towards the front wall, the first female coupler configured to slidably engage with a first male coupler of a first utility module;

wherein the base, the first wall, the second wall, and the top panel are stacked on top of one another in an unassembled configuration such that a major side surface of one of the base, the first wall, the second wall, and the top panel faces a major side surface of an adjacent one of the base, the first wall, the second wall, and the top panel in the stack;

wherein the base, the first wall, the second wall, and the top panel are configured to be coupled together to form an assembled configuration, wherein when the base, the first wall, the second wall, and the top panel are in the assembled configuration:

the first wall is coupled to and extending upward from the base;

the second wall is coupled to and extending upward from the base opposite the first wall; and the top panel is coupled to and extends between the first wall and the second wall above the base.

17. The stack of claim 16, wherein the base comprises two major side surfaces, each of which are facing along an axis, and wherein each of the first wall, the second wall, and the top panel comprises two major side surfaces, each of which are facing along the axis when the base, the first wall, the second wall, and the top panel are stacked on top of one another in an unassembled configuration.

18. The stack of claim 16, wherein the first utility module slides along an axis with respect to the top panel to engage the first male coupler with the first female coupler, wherein each of the first rib and the second rib extend along the axis from the back wall towards the front wall.

19. The stack of claim 16, wherein the first utility module slides along an axis with respect to the top panel to engage the first male coupler with the first female coupler, and wherein the first rib extends from the first sidewall towards the second sidewall in a first direction perpendicular to the axis, and wherein the second rib extends from the second sidewall towards the first sidewall in a second direction opposite the first direction and perpendicular to the axis.

* * * * *